US007629103B2

(12) United States Patent
Ikuno et al.

(10) Patent No.: US 7,629,103 B2
(45) Date of Patent: Dec. 8, 2009

(54) PHOTOCONDUCTOR, MANUFACTURING METHOD THEREOF, IMAGE FORMING PROCESS AND IMAGE FORMING APPARATUS USING PHOTOCONDUCTOR, AND PROCESS CARTRIDGE

(75) Inventors: Hiroshi Ikuno, Yokohama (JP); Hiroshi Tamura, Susono (JP); Tetsuro Suzuki, Fuji (JP); Yoshiki Yanagawa, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 583 days.

(21) Appl. No.: 11/157,060

(22) Filed: Jun. 21, 2005

(65) Prior Publication Data

US 2005/0282075 A1 Dec. 22, 2005

(30) Foreign Application Priority Data

Jun. 22, 2004 (JP) ..... 2004-183736

(51) Int. Cl.
*G03G 5/07* (2006.01)

(52) U.S. Cl. ..... 430/135; 430/136

(58) Field of Classification Search ..... 430/135, 430/136

See application file for complete search history.

(56) References Cited

U.S. PATENT DOCUMENTS 5,322,753 A 6/1994 Tamura et al.
5,492,784 A 2/1996 Yoshikawa et al.
5,608,010 A 3/1997 Tamura et al.
5,871,876 A 2/1999 Ikuno et al.
6,030,733 A 2/2000 Kami et al.
6,066,428 A 5/2000 Katayama et al.
6,107,452 A * 8/2000 Miller et al. ..... 528/422
6,151,468 A 11/2000 Kami et al.
6,194,535 B1 2/2001 Katayama et al.
6,210,848 B1 4/2001 Nagai et al.
6,410,195 B1 * 6/2002 Tanaka et al. ..... 430/56
6,432,596 B2 8/2002 Ikuno et al.
6,686,114 B2 2/2004 Sakon et al.
2001/0049022 A1 * 12/2001 Takeuchi et al. ..... 428/423.1
2003/0077531 A1 4/2003 Suzuki et al.
2003/0224268 A1 12/2003 Ikuno et al.
2004/0053152 A1 3/2004 Nagai et al.

(Continued)

FOREIGN PATENT DOCUMENTS

JP 56-48637 5/1981

(Continued)

OTHER PUBLICATIONS

U.S. Appl. No. 11/941,355, filed Nov. 16, 2007, Ikuno, et al.

(Continued)

*Primary Examiner*—Hoa V Le
(74) *Attorney, Agent, or Firm*—Oblon, Spivak, McClelland, Maier & Neustadt, L.L.P.

(57) ABSTRACT

A photoconductor comprising a photosensitive layer disposed on an support, wherein the photosensitive layer has at least a crosslinked layer and the crosslinked layer is produced by curing at least a radical polymerizable monomer having three or more functionalities and no charge transport structure and a radical polymerizable compound having a charge transport structure through irradiating a light energy in an atmosphere having a low oxygen concentration of 0.001 vol % to 2.0 vol %.

14 Claims, 4 Drawing Sheets

U.S. PATENT DOCUMENTS

| | | | | |
|---|---|---|---|---|
| 2004/0248024 | A1 | 12/2004 | Suzuki et al. | |
| 2004/0253527 | A1 | 12/2004 | Suzuki et al. | |
| 2005/0106483 | A1 | 5/2005 | Shoshi et al. | |
| 2005/0175796 | A1* | 8/2005 | Nakamura et al. | 428/32.8 |

FOREIGN PATENT DOCUMENTS

| | | |
|---|---|---|
| JP | 64-1728 | 1/1989 |
| JP | 03-086948 | 4/1991 |
| JP | 4-281461 | 10/1992 |
| JP | 5-216249 | 8/1993 |
| JP | 2000-66425 | 3/2000 |
| JP | 2000-147814 | 5/2000 |
| JP | 2001-175016 | 6/2001 |
| JP | 3194392 | 6/2001 |
| JP | 3262488 | 12/2001 |
| JP | 2003-026960 | 1/2003 |

OTHER PUBLICATIONS

U.S. Appl. No. 12/000,239, filed Dec. 11, 2007, Fujiwara, et al.
U.S. Appl. No. 11/563,710, filed Nov. 28, 2006, Inaba, et al.
U.S. Appl. No. 11/616,523, filed Dec. 27, 2006, Fujiwara, et al.
U.S. Appl. No. 11/621,805, filed Jan. 10, 2007, Suzuki, et al.
U.S. Appl. No. 12/030,886, filed Feb. 14, 2008, Toda, et al.
U.S. Appl. No. 12/035,016, filed Feb. 21, 2008, Iwamoto, et al.
U.S. Appl. No. 12/047,011, filed Mar. 12, 2008, Kami, et al.
U.S. Appl. No. 11/684,520, filed Mar. 9, 2007, Toshine, et al.
U.S. Appl. No. 11/685,441, filed Mar. 13, 2007, Yanagawa, et al.
U.S. Appl. No. 11/692,682, filed Mar. 28, 2007, Mori, et al.
U.S. Appl. No. 11/068,180, filed Mar. 1, 2005, Tamoto, et al.
U.S. Appl. No. 11/082,833, filed Mar. 18, 2005, Suzuki, et al.
U.S. Appl. No. 11/033,802, filed Jan. 13, 2005, Yanagawa, et al.
U.S. Appl. No. 10/974,814, filed Oct. 28, 2004, Tamoto, et al.
U.S. Appl. No. 10/944,003, filed Sep. 20, 2004, Yanagawa, et al.
U.S. Appl. No. 11/736,258, filed Apr. 17, 2007, Kawasaki, et al.
U.S. Appl. No. 11/750,570, May 18, 2007, Ikuno, et al.
U.S. Appl. No. 11/157,998, filed Jun. 22, 2005, Tamura, et al.
U.S. Appl. No. 11/480,517, filed Jul. 5, 2006, Yanagawa, et al.
U.S. Appl. No. 11/834,240, filed Aug. 6, 2007, Hirose, et al.
U.S. Appl. No. 11/500,352, filed Aug. 8, 2006, Toshine, et al.

* cited by examiner

PHOTOCONDUCTOR, MANUFACTURING METHOD THEREOF, IMAGE FORMING PROCESS AND IMAGE FORMING APPARATUS USING PHOTOCONDUCTOR, AND PROCESS CARTRIDGE

BACKGROUND OF THE INVENTION

1. Field of the Invention

The present invention relates to a photoconductor to which high durability and a high image quality are imparted by disposing in the photoconductor, a photosensitive layer having advantageous film surface properties, high wear resistance and advantageous electrical properties; and a manufacturing method thereof. The present invention relates also to an image forming process, image forming apparatus and process cartridge for the image forming apparatus using the above-noted photoconductor having long life and high performance.

2. Description of the Related Art

Recently, organic photoconductors (OPC) are widely employed in copiers, facsimiles, laser printers, and composite apparatuses thereof owing to excellent performance and various advantages, in place of conventional inorganic photoconductors. Specific grounds thereof are thought as follows: (i) optical properties such as absorbable wavelength and absorption rate, (ii) electrical properties such as higher sensitivity and stable charging ability, (iii) margins of materials, (iv) productivity, (v) lower cost, (vi) safety, and the like.

On the other hand, photoconductors have been small-sized along with image forming apparatuses being small-sized; in addition, higher processing rate as well as maintenance free are have been required for image forming apparatuses; consequently, photoconductors are demanded for higher durability still more nowadays.

However, organic photoconductors are typically less durable since the hardness of the surface layers is relatively low due to their inherent components of charge transport substances of lower molecular mass and inactive polymers; therefore, the surface layers tend to wear significantly due to mechanical stress caused by developing systems and cleaning systems etc. under repeated usages in electrophotographic processes.

Further, rubber hardness of cleaning blades has been raised and pressure onto photoconductors applied from the cleaning blades has been increased so as to improve cleaning ability in order to enhance image quality by using toner particles with smaller particle sizes, which inevitably leading to higher wear rate of photoconductors. The wear of photoconductors certainly degrades sensitivity, electrical properties such as charging ability etc., which resulting in deteriorated images such as lower image density and background smear. Further, flaws due to local wear often bring about streak on images due to insufficient cleaning. Such wear and flaws typically dominate photoconductors in terms of lifetime to be exchanged, currently.

As such, the wear rate should be decreased in order to enhance durability of organic photoconductors, which is one of the most important objects in the art.

Previously, various proposals have been provided in order to enhance wear resistance of photosensitive layers, for example, (1) incorporation of curable binders into the photosensitive layer (e.g. Japanese Patent Application Laid-Open (JP-A) No. 56-48637), (2) employment of polymers for charge transport substances (e.g. JP-A No. 64-1728), (3) dispersing inorganic fillers into surface layers (e.g. JP-A No. 4-281461), and the like.

However, in the (1) incorporation of curable binders described above, residual voltage tends to increase owing to impurities such as polymerization initiators and/or unreacted residual groups due to insufficient compatibility with charge transport substances, thus image density tents to decrease. In the method (2) using a charge transport polymer and the method (3) using an inorganic filler, while the wear resistance of the photoconductor can be improved to some extent, a photoconductor which can fully satisfy the durability required for the organic photoconductor is not yet obtained. Further, in the method (3) using an inorganic filler, the organic photoconductor comprising an inorganic filler has such a tendency that due to a charge trap which is present on the surface of the inorganic filler, the residual electric potential of the surface layer is elevated, so that the image density is easily lowered. As such, based on these proposals (1), (2), and (3), the durability of organic photoconductors is not satisfactory on the whole, including electrical durability and mechanical durability.

Further, photoconductors containing cured product of a multi-functional acrylate monomer are proposed in order to improve the abrasion resistance and scratch resistance such as of (i) (e.g. Japanese Patent No. 3262488). In the patent literature, it is disclosed that cured material of the multi-functional acrylate monomer is included into a protective layer on photosensitive layers. However, there exist no more than simple descriptions that a charge transport substance may be contained in the protective layer and there exist no specific examples. Further, when a charge transport substance having a low molecular mass is simply added to the surface layer, it may cause problems related with the compatibility to the cured body, thereby crystallization of charge transport substance having a lower molecular mass and clouding may occur, resulting in reduction in mechanical properties.

In addition, a photoconductor is produced by way of causing reaction of monomers in a condition that a polymer binder is incorporated; therefore, there will be some problems that the curing cannot sufficiently proceed, and surface nonuniformity is induced due to phase separation at curing caused by insufficient compatibility between the cured material and the binder resin, which resulting in inferior cleaning in image forming apparatuses.

Further, another proposal is disclosed for reducing abrasion wear of photosensitive layers, in which a charge transport layer is provided using a coating liquid that comprises a monomer having a carbon-carbon double bond, a charge transport substance having a carbon-carbon double bond, and a binder resin (e.g. Japanese Patent No. 3194392). The binder resin includes a binder reactive with the charge transport substance having a carbon-carbon double bond and another binder non-reactive with the charge transport substance without having the double bond. The photoconductor allegedly represents higher wear resistance as well as proper electrical properties. However, non-reactive resins as the binder resin tend to yield surface irregularity and thus inferior cleaning, since the non-reactive resins are typically non-compatible with reaction products between the monomer and the charge transport substance, thus phase separation is likely to occur. Further, the patent literature discloses monomers having two functionalities as specific examples, which cannot bring about sufficient crosslinking density and satisfactory wear resistance due to the lower functionalities. Provided that reactive resins are employed as the binder resin, the bonding density and the crosslinking density are possibly not sufficiently high due to the lower functionalities of the monomer and the binder resin, thus electrical properties and wear resistance will not be satisfactory.

Further, another proposal is disclosed, in which photosensitive layers comprise reaction products that are produced by curing hole transport compounds having two or more functional groups capable of undergoing chain polymerization in a molecule (e.g. JP-A No. 2000-66425). However, the photosensitive layer tends to cause higher internal stress and thus to yield higher surface roughness and cracks, since the bulky hole transport compound have two or more chain polymerizable functional groups.

In this situation, the present inventors have made extensive and intensive studies with a view toward solving the above-noted problems accompanying the related art. As a result, it has been found that by producing a photoconductor in which the surface layer is a crosslinked resin layer produced by curing a radical polymerizable monomer having three or more functionalities and no charge transport structure and a radical polymerizable compound having a charge transport structure, the electrical properties and wear resistance of the photoconductor are improved. However, it was also found that such a crosslinked resin layer has not a satisfactory durability during a long-term using and depending on the crosslinking condition, the surface properties of the crosslinked resin layer are largely changed and the surface unevenness of the crosslinked resin layer becomes easily large. Accordingly, the cleaning failure of the photoconductor is easily caused and when the photoconductor is used in a long-term, the cleaning blade is locally broken and the cleaning failure is caused, so that an abnormal image in the form of a stripe is caused.

SUMMARY OF THE INVENTION

The task of the present invention is to provide not only a photoconductor which has high and stable wear resistance, high and stable scratch resistance and advantageous electrical properties, and which can maintain an image having high quality for a long term; and a manufacturing method thereof, but also an image forming method, image forming apparatus and process cartridge using the above-noted photoconductor having long life and high performance.

Specifically, the present invention provides, in the first aspect, a photoconductor comprising a support, and a photosensitive layer disposed on the support, wherein the photosensitive layer comprises a crosslinked layer and the crosslinked layer is produced by curing at least a radical polymerizable monomer having three or more functionalities and no charge transport structure and a radical polymerizable compound having a charge transport structure through irradiating a light energy in an atmosphere having a low oxygen concentration of 0.001 vol % to 2.0 vol %.

The second aspect of the present invention is the photoconductor according to the first aspect, wherein the crosslinked layer is disposed on the surface of the photosensitive layer opposed to the support.

The third aspect of the present invention is the photoconductor according to the first aspect, wherein the radical polymerizable compound having a charge transport structure is a radical polymerizable compounds having one functionality and a charge transport structure.

The fourth aspect of the present invention is the photoconductor according to the first aspect, wherein the radical polymerizable monomer having three or more functionalities and no charge transport structure has at least one of an acryloyloxy group and a methacryloyloxy group.

The fifth aspect of the present invention is the photoconductor according to the first aspect, wherein the radical polymerizable compound having a charge transport structure has at least one of an acryloyloxy group and a methacryloyloxy group.

The sixth aspect of the present invention is the photoconductor according to the first aspect, wherein the radical polymerizable compound having a charge transport structure has a triarylamine structure.

The seventh aspect of the present invention is the photoconductor according to the first aspect, wherein the radical polymerizable compound having a charge transport structure is at least one selected from the group consisting of the radical polymerizable compounds represented by the following Formulae (3) and (4):

Formula (3)

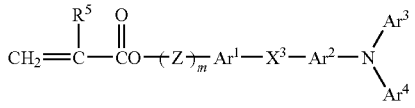

Formula (4)

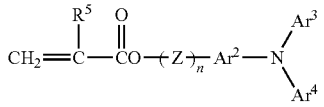

wherein $R^5$ represents any one of a hydrogen atom, a halogen atom, an alkyl group which may have a substituent, an alalkyl group which may have a substituent, an aryl group which may have a substituent, a cyano group, a nitro group, an alkoxy group, a —$COOR^6$ group ($R^6$ represents any one of a hydrogen atom, an alkyl group which may have a substituent, an alalkyl group which may have a substituent and an aryl group which may have a substituent), a halogenated carbonyl group and a —$CONR^7R^8$ group ($R^7$ and $R^8$ represent independently any one of a hydrogen atom, a halogen atom, an alkyl group which may have a substituent, an alalkyl group which may have a substituent, an aryl group which may have a substituent); $Ar^1$ and $Ar^2$ may be the same as or different from each other, and represent an unsubstituted or substituted arylene group; $Ar^3$ and $Ar^4$ may be the same as or different from each other, and represent an unsubstituted or substituted aryl group; X represents any one of a single bond, an unsubstituted or substituted alkylene group, an unsubstituted or substituted cycloalkylene group, an unsubstituted or substituted alkylene ether group, an oxygen atom, a sulfur atom and a vinylene group; Z represents any one of an unsubstituted or substituted alkylene group, an unsubstituted or substituted alkylene ether group and an alkyleneoxycarbonyl group; and m and n are independently an integer of 0 to 3.

The eighth aspect of the present invention is the photoconductor according to the third aspect, wherein the radical polymerizable compound having a charge transport structure is at least one selected from the group consisting of the radical polymerizable compounds represented by the following Formula (8):

Formula (8)

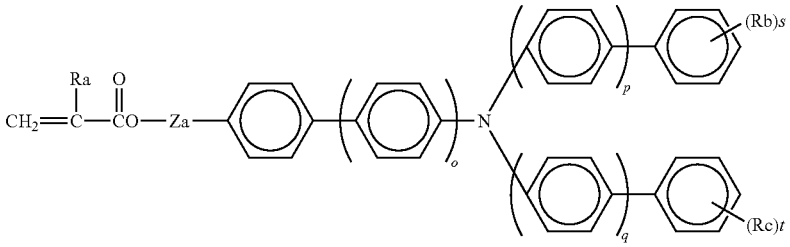

wherein o, p and q are independently an integer of 0 or 1; Ra represents any one of a hydrogen atom and a methyl group; Rb and Rc represent a $C_1$ to $C_6$ alkyl group (a substituent other than a hydrogen atom), plural Rbs may be different from each other and plural Rcs may be different from each other; s and t are independently an integer of 0 to 3; Za represents any one of a single bond, a methylene group, an ethylene group and groups represented by the following formulae:

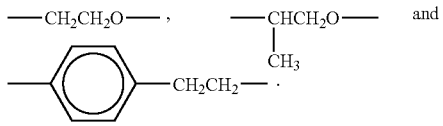

The ninth aspect of the present invention is the photoconductor according to the first aspect, wherein a surface of the crosslinked layer has Rz value (ten-point height of irregularities) of 0.05 μm to 0.50 μm.

The tenth aspect of the present invention is the photoconductor according to the first aspect, wherein the photosensitive layer comprises a charge generating layer, a charge transport layer and the crosslinked layer which are disposed on the support in this order.

The eleventh aspect of the present invention is a manufacturing method of a photoconductor comprising disposing a crosslinked layer in the photoconductor by curing at least a radical polymerizable monomer having three or more functionalities and no charge transport structure and a radical polymerizable compound having a charge transport structure through irradiating a light energy in an atmosphere having a low oxygen concentration of 0.001 vol % to 2.0 vol %, wherein the photoconductor comprises the photosensitive layer disposed on an support and the photosensitive layer comprises the crosslinked layer.

The twelfth aspect of the present invention is the manufacturing method of a photoconductor according to the eleventh aspect, wherein the radical polymerizable compound having a charge transport structure is a radical polymerizable compounds having one functionality and a charge transport structure.

The thirteenth aspect of the present invention is the manufacturing method of a photoconductor according to the eleventh aspect, wherein the radical polymerizable monomer having three or more functionalities and no charge transport structure has at least one of an acryloyloxy group and a methacryloyloxy group.

The fourteenth aspect of the present invention is the manufacturing method of a photoconductor according to the eleventh aspect, wherein the radical polymerizable compound having a charge transport structure has at least one of an acryloyloxy group and a methacryloyloxy group.

The fifteenth aspect of the present invention is the manufacturing method of a photoconductor according to the eleventh aspect, wherein the radical polymerizable compound having a charge transport structure has a triarylamine structure.

The sixteenth aspect of the present invention is the manufacturing method of a photoconductor according to the eleventh aspect, wherein the radical polymerizable compound having a charge transport structure is at least one selected from the group consisting of the radical polymerizable compounds represented by the following Formulae (3) and (4):

Formula (3)

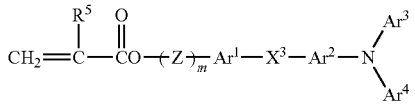

Formula (4)

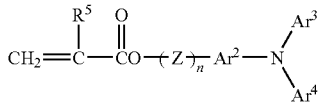

wherein $R^5$ represents any one of a hydrogen atom, a halogen atom, an alkyl group which may have a substituent, an alalkyl group which may have a substituent, an aryl group which may have a substituent, a cyano group, a nitro group, an alkoxy group, a —$COOR^6$ group ($R^6$ represents any one of a hydrogen atom, an alkyl group which may have a substituent, an alalkyl group which may have a substituent and an aryl group which may have a substituent), a halogenated carbonyl group and a —$CONR^7R^8$ group ($R^7$ and $R^8$ represent independently any one of a hydrogen atom, a halogen atom, an alkyl group which may have a substituent, an alalkyl group which may have a substituent, an aryl group which may have a substituent); $Ar^1$ and $Ar^2$ may be the same as or different from each other, and represent an unsubstituted or substituted arylene group; $Ar^3$ and $Ar^4$ may be the same as or different from each other, and represent an unsubstituted or substituted aryl group; X represents any one of a single bond, an unsubstituted or substituted alkylene group, an unsubstituted or substituted cycloalkylene group, an unsubstituted or substituted alkylene ether group, an oxygen atom, a sulfur atom and a vinylene group; Z represents any one of an unsubstituted or substituted alkylene group, an unsubstituted or substituted alkylene ether group and an alkyleneoxycarbonyl group; and m and n are independently an integer of 0 to 3.

The seventeenth aspect of the present invention is the manufacturing method of a photoconductor according to the twelfth aspect, wherein the radical polymerizable compound having a charge transport structure is at least one selected from the group consisting of the radical polymerizable compounds represented by the following Formula (8):

Formula (8)

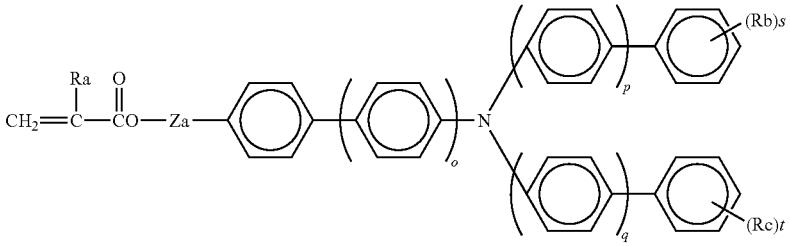

wherein o, p and q are independently an integer of 0 or 1; Ra represents any one of a hydrogen atom and a methyl group; Rb and Rc represent a $C_1$ to $C_6$ alkyl group (a substituent other than a hydrogen atom), plural Rbs may be different from each other and plural Rcs may be different from each other; s and t are independently an integer of 0 to 3; Za represents any one of a single bond, a methylene group, an ethylene group and groups represented by the following formulae:

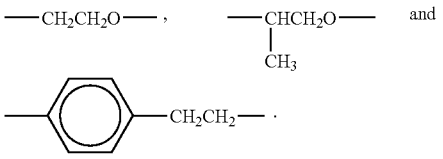

The eighteenth aspect of the present invention is an image forming process comprising charging a photoconductor, exposing the photoconductor charged by the charging for forming an electrostatic latent image, developing the electrostatic latent image using a toner for visualizing the electrostatic latent image and forming a toner image, and transferring the toner image formed by the developing to a transferring medium, wherein the photoconductor is a photoconductor comprising a photosensitive layer disposed on an support, wherein the photosensitive layer comprises at least a crosslinked layer and the crosslinked layer is produced by curing at least a radical polymerizable monomer having three or more functionalities and no charge transport structure and a radical polymerizable compound having a charge transport structure through irradiating a light energy in an atmosphere having a low oxygen concentration of 0.001 vol % to 2.0 vol %.

The nineteenth aspect of the present invention is an image forming apparatus comprising a photoconductor, a charging unit configured to charge the photoconductor, an exposing unit configured to expose the photoconductor charged by the charging unit for forming the electrostatic latent image, a developing unit configured to develop the electrostatic latent image using a toner for visualizing the electrostatic latent image and forming a toner image, and a transferring unit configured to transfer the toner image formed by the developing unit to a transferring medium, wherein the photoconductor is a photoconductor comprising a photosensitive layer disposed on an support, wherein the photosensitive layer comprises at least a crosslinked layer and the crosslinked layer is produced by curing at least a radical polymerizable monomer having three or more functionalities and no charge transport structure and a radical polymerizable compound having a charge transport structure through irradiating a light energy in an atmosphere having a low oxygen concentration of 0.001 vol % to 2.0 vol %.

The twentieth aspect of the present invention is process cartridge comprising a photoconductor, and at least one selected from the group consisting of a charging unit configured to charge the photoconductor, a developing unit configured to develop the electrostatic latent image using a toner for visualizing the electrostatic latent image and forming a toner image, a transferring unit configured to transfer the toner image formed by a developing unit to a transferring medium, a cleaning unit configured to clean the toner remained on the photoconductor after a transferring, and a destaticizing unit configured to remove the electrostatic latent image on the photoconductor after a transferring, wherein the process cartridge is an integrated unit of the photoconductor and at least one selected from the group consisting of a charging unit, a developing unit, a transferring unit, a cleaning unit and a destaticizing unit and is attached to an image forming apparatus in an attachable and detachable manner; and the photoconductor is a photoconductor comprising a photosensitive layer disposed on an support, wherein the photosensitive layer comprises at least a crosslinked layer and the crosslinked layer is produced by curing at least a radical polymerizable monomer having three or more functionalities and no charge transport structure and a radical polymerizable compound having a charge transport structure through irradiating a light energy in an atmosphere having a low oxygen concentration of 0.001 vol % to 2.0 vol %.

DESCRIPTION OF THE PREFERRED EMBODIMENTS

Figure 1A:
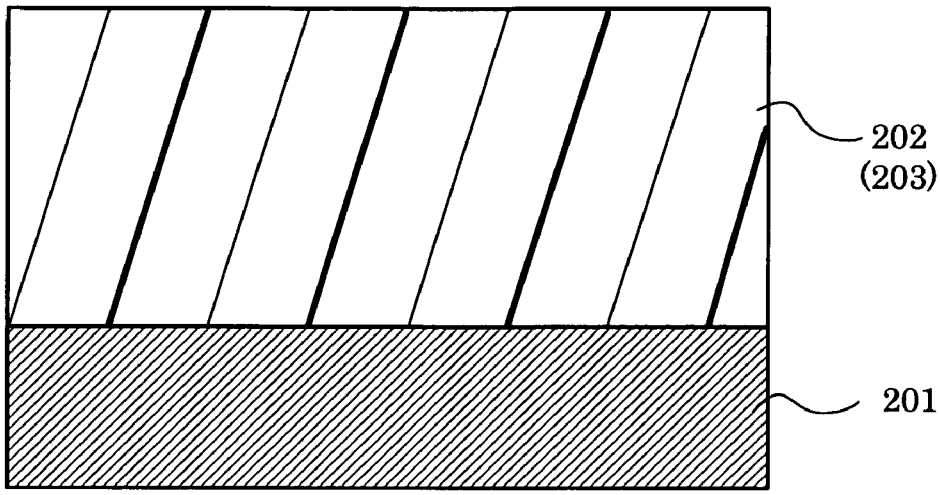
FIG. 1A is a sectional view schematically showing an example of the photoconductor according to the present invention, which comprises the photosensitive layer 202 and the support 201.

Hereinafter, with respect to the present invention, explanations are given in detail.

According to the present invention, by producing a photoconductor comprising a photosensitive layer disposed on a support, wherein the photosensitive layer comprises a crosslinked layer and the crosslinked layer is produced by curing at least a radical polymerizable monomer having three or more functionalities and no charge transport structure and a radical polymerizable compound having a charge transport structure through irradiating a light energy in an atmosphere having a low oxygen concentration of 0.001 vol % to 2.0 vol %, a photoconductor which has high wear resistance, high scratch resistance and excellent cleaning properties and which can maintain an image having high quality for a long term, can be obtained.

This is because by incorporating a radical polymerizable monomer having three functionalities in the crosslinked layer of the photoconductor according to the present invention, a crosslinked layer in which a three-dimensional network is developed and the crosslinkage density is extremely high and which has a high hardness, so that the high wear resistance of the photoconductor can be obtained. On the other hand, when only a radical polymerizable monomar having one functionality or a radical polymerizable monomar having two functionalities is used for disposing the crosslinked layer, the crosslinkage density in the crosslinked layer becomes dilute, so that rapid improvement of the wear resistance cannot be obtained and when the crosslinked layer comprises a polymer material, the development of the three-dimensional network is interrupted and the crosslinkage density is lowered, so that a photoconductor produced using only a radical polymerizable monomar having one functionality or a radical polymerizable monomar having two functionalities cannot obtain satisfactory wear resistance in comparison with the photoconductor according to the present invention. Further, since the compatibility of the polymer material comprised in the crosslinked layer with a cured form of a radical polymerizable composition (e.g., a radical polymerizable monomer or a radical polymerizable compound having a charge transport structure) is poor, a phase separation and a local wear are caused, so that a flaw in the surface of the crosslinked layer is caused.

The crosslinked layer according to the present invention comprises besides the above-noted a radical polymerizable monomer having three or more functionalities, a radical polymerizable compound having a charge transpotable structure and this radical polymerizable compound having a charge transpotable structure is entrapped in the crosslinkage during the curing of the above-noted a radical polymerizable monomer having three or more functionalities. On the other hand, when the crosslinked layer comprises a low molecular weight-charge transport substance having no functional group, due to the poor compatibility thereof, the separation of a charge transport substance having a low molecular weight and cloudiness are caused and the mechanical strength of the crosslinked layer is lowered.

Further, the crosslinked layer according to the present invention is produced by curing a radical polymerizable monomer having three or more functionalities and no charge transport structure and a radical polymerizable compound having a charge transport structure through irradiating a light energy in a low oxygen-concentration atmosphere having an oxygen concentration of 0.001 vol % to 2.0 vol %. These radical polymerizable monomer and radical polymerizable compound are changed to a radical by irradiating a light energy and the resultant radical initiates an addition polymerization. These radical polymerizable monomer and radical polymerizable compound cause a chain transfer reaction and the crosslinking reaction is progressed. Under the normal atmosphere, a radical in the reaction terminal is trapped by oxygen and stabilized, thereby forming a dioxy radical, so that the curing rate is lowered and the crosslinkage density is lowered. Accordingly, a photoconductor produced by curing under the normal atmosphere cannot exhibit satisfactory mechanical properties, so that the wear resistance and scratch resistance of the photoconductor during a long-term using are lowered. Since the curing rate is lowered, the surface unevenness of the photoconductor becomes easily large, so that the cleaning failure of the photoconductor is easily caused. Further, the friction force between this crosslinked resin layer and a cleaning blade is large, so that a blade turning-over and a blade crying are caused sometimes. On the other hand, by performing the curing through the irradiating of the light energy in an atmosphere having an oxygen concentration of 0.001 vol % to 2.0 vol %, the trap of the radical in the reaction terminal by oxygen is hindered and the lowering of the curing rate and crosslinkage density is not caused. Therefore, the mechanical strength of the photoconductor is improved and the surface unevenness of the photoconductor is lessened.

When the photoconductor is cured through irradiating a light energy in an atmosphere having a low oxygen concentration of 0.001 vol % to 2.0 vol %, the surface unevenness of the photoconductor is difficulty caused. The thus obtained surface layer of the photoconductor has Rz value (ten-point height of irregularities) of preferably 0.05 μm to 0.50 μm.

Rz value is the ten-point height of irregularities measured according to JIS B0601-1994 and is measured in the present invention using a surface roughness measuring apparatus (manufactured and sold by Tokyo Seimitsu Co., Ltd.; trade name: Surfcom 1400 D). Rz value may be measured using any apparatus having the same performance as that of the above-noted apparatus.

Next, with respect to the composition of the coating liquid for disposing the crosslinked layer according to the present invention, explanations are given.

The radical polymerizable monomer having three or more functionalities and no charge transport structure according to the present invention means a monomer having neither electron-hole transport structure, such as a triarylamine, a hydrazone, a pyrazoline and a carbazole, nor electron transport structure, such as a condensated multicyclic quinone group, a diphenoquinone group and an electron attractive aromatic ring having a group, such as a cyano group and a nitro group; and having three or more radical polymerizable functional groups. The radical polymerizable functional group is not restricted so long as the functional group has C═C double bond and is radical polymerizable. Examples of the radical polymerizable functional group include the below-noted 1-substituted ethylene functional groups and 1,1-substituted ethylene functional groups.

(1) Preferred examples of the 1-substituted ethylene functional group include a functional group represented by the following Formula (1):

$$CH_2{=}CH{-}X^1{-} \qquad \text{Formula (1)}$$

wherein $X^1$ represents any one of an arylene group, such as a phenylene group and a naphthylene group, which may have a substituent; an alkenylene group which may have a substituent; a —CO— group; a —COO— group; a —CON($R^1$)— group (wherein $R^1$ represents a hydrogen atom; an alkyl group, such as a methyl group and an ethyl group; an alalkyl group, such as a benzyl group, a naphthylmethyl group and a phenetyl group; and an aryl group, such as a phenyl group and a naphthyl group); and a —S— group.

Specific examples of the above-noted 1-substituted ethylene functional group include a vinyl group, a stylyl group, a 2-methyl-1,3-butadienyl group, a vinylcarbonyl group, an acryloyloxy group, an acryloylamide group and a vinylthioether group.

(2) Preferred examples of the 1,1-substituted ethylene functional group include a functional group represented by the following Formula (2):

$$CH_2{=}CH(Y^1){-}X^2{-} \qquad \text{Formula (2)}$$

wherein $Y^1$ represents any one of an alkyl group which may have a substituent; an alalkyl group which may have a substituent; an aryl group, such as a phenyl group and a naphthyl group, which may have a substituent; a halogen atom; a cyano group; a nitro group; an alkoxy group, such as a methoxy group and an ethoxy group; and a —COOR$^2$ group (wherein $R^2$ represents any one of a hydrogen atom; an alkyl group, such as a methyl group and an ethyl group, which may have a substituent; an alalkyl group, such as a benzyl group and a phenetyl group, which may have a substituent; an aryl group, such as a phenyl group and a naphthyl group, which may have substituent; and a —$CONR^3R^4$ group (wherein $R^3$ and $R^4$ may be the same as or different from each other, and represent any one of a hydrogen atom; an alkyl group, such as a methyl group and an ethyl group, which may have a substituent; an alalkyl group, such as a benzyl group, a naphthylmethyl group and a phenetyl group, which may have a substituent; an aryl group, such as a phenyl group and a naphthyl group, which may have a substituent)); and $X^2$ represents any one of the same group as $X^1$ in the above formula (1), a group having a single bond, and an alkylene group: with proviso that at least any one of $Y^1$ and $X^2$ represents any one of an oxycarbonyl group, a cyano group, an alkenylene group and an aromatic cyclic group.

Specific examples of the above-noted 1,1-substituted ethylene functional group include α-chloride acrylolyoxy group, a methacryloyloxy group, a α-cyanoethylene group, a α-cyanoacryloyloxy group, a α-cyanophenylene group and a methacryloylamino group.

Examples of the substituent by which the substituent of $X^1$, $X^2$ or $Y^1$ is substituted include a halogen atom; a nitro group; a cyano group; an alkyl group, such as a methyl group and an ethyl group; an alkoxy group, such as a methoxy group and an ethoxy group; an aryloxy group, such as a phenoxy group; an aryl group, such as a phenyl group and a naphthyl group; and an alalkyl group, such as a benzyl group and a phenetyl group.

Among these radical polymerizable functional groups, particularly an acryloyloxy group and a methacryloyloxy group are preferred and a compound having three or more acryloyloxy groups can be obtained, for example by subjecting a compound having three or more hydroxyl groups in the molecule, an acrylic acid (or a salt thereof), a halide acrylic acid and an acrylate ester to an esterification reaction or an ester exchange reaction. A compound having three or more methacryloyloxy groups can be obtained in the same manner as the above-noted manner for obtaining the compound having three or more acryloyloxy groups. Three or more radical polymerizable functional groups in the monomer before the polymerization may be the same as or different from each other.

Examples of the three or more functional radical polymerizable monomer having no charge transport structure according to the present invention include the following monomers, which should not be construed as limiting the scope of the present invention.

Examples of the above-noted radical polymerizable monomer include a trimethylolpropanetriacrylate (TMPTA), a trimethylolpropanetrimethacrylate, a HPA-modified trimethylolpropanetriacrylate, a EO-modified trimethylolpropanetriacrylate, a PO-modified trimethylolpropanetriacrylate, a caprolactone-modified trimethylolpropanetriacrylate, a HPA-modified trimethylolpropanetriacrylate, a pentaerythritoltriacrylate, a pentaerythritoltetraacrylate (PETTA), a glyceroltriacrylate, a ECH-modified glyceroltriacrylate, a EO-modified glyceroltriacrylate, a PO-modified glyceroltriacrylate, a tris(acryloxyethyl) isocyanulate, a dipentaerythritolhexaacrylate (DPHA), a caprolactone-modified dipentaerythritolhexaacrylate, a dipentaerythritolhydroxypentaacrylate, an alkyl-modified dipentaerythritolpentaacrylate, an alkyl-modified dipentaerythritoltetraacrylate, an alkyl-modified dipentaerythritoltriacrylate, a dimethylolpropanetetraacrylate (DTMPTA), a pentaerythritolethoxytetraacrylate, an EO-modified phosphoric acid triacrylate and 2,2,5,5-tetrahydroxymethylcyclopentanonetetraacrylate.

These monomers may be used individually or in combination.

The amount of the radical polymerizable monomer having three or more functionalities and no charge transport structure which is used for disposing the crosslinked layer of the photoconductor according to the present invention is preferably 20% by mass to 80% by mass, more preferably 30% by mass to 70% by mass, based on the mass of the crosslinked layer. When the amount is less than 20% by mass, the three-dimensional crosslinkage density in the crosslinked layer is low, so that rapid improving of the wear resistance of the photoconductor cannot be obtained sometimes in comparison with the case where a conventional thermoplastic binder resin is used. On the other hand, when the amount is more than 80% by mass, the amount of the charge transport compound is lowered, so that the electrical properties of the photoconductor are impaired. Since the electrical properties and wear resistance required for the photoconductor vary depending on the process in which the photoconductor is used and accordingly, the amount of the above-noted a radical polymerizable monomer having three or more functionalities should be varied, it cannot be sweepingly mentioned that taking into consideration the balance between the above-noted two properties, the above-noted amount is most preferably 30% by mass to 70% by mass.

The radical polymerizable compound having a charge transport structure which is used for disposing the crosslinked layer according to the present invention means a compound not only comprising an electron-hole transport structure, such as a triarylamine, a hydrazone, a pyrazoline and a carbazol; and an electron transport structure, such as a condensated polycyclic quinone group, a diphenoquinone group and an electron attractive aromatic ring having a group, such as a cyano group and a nitro group, but also having a radical polymerizable functional group. Examples of the radical polymerizable functional group include the radical polymerizable functional groups exemplified in the above section of 1-substituted ethylene functional groups and 1,1-substituted ethylene functional groups. Among them, particularly an acryloyloxy group and a methacryloyloxy group are preferred.

As the radical polymerizable compound having a charge transport structure, a compound having two ore more functionalities can be used, however, from the viewpoint of the film quality and static properties of the crosslinked layer, a compound having one functionality is preferred. This is because, when a charge transport compound having two or more functionalities is used, the compound is fixed in the crosslinkage structure through plural bonds, a strain is caused in the cured resin and the internal stress of the crosslinked layer becomes large due to an extremely bulky charge transport structure, so that a crack or flaw is easily caused in the crosslinked layer due to the attaching of the carrier. When the crosslinked layer has a film thickness of 5 μm or less, there is no problem particularly. On the other hand, when the crosslinked layer has a film thickness of more than 5 μm, the internal stress of the crosslinked layer becomes extremely large, so that a crack is easily caused just after the crosslinking.

Also, with respect to the electrostatic properties of the photoconductor, when a charge transport compound having two or more functionalities is used, the compound is fixed in the crosslinkage structure through plural bonds, so that an intermediate structure (cation radical) during the charge transporting cannot be stably maintained and due to the charge trap, the lowering of the sensitivity and elevation of the residual potential of the photoconductor are easily caused.

Further, these deteriorations of the electrostatic properties lead to the lowering of the image density and an image having a thinned letter. Therefore, by using a radical polymerizable compounds having one functionality and a charge transport structure as the radical polymerizable compound having a charge transport structure and by fixing the compound in the crosslinkage structure in the form of a pendant, the causing of the crack and flaw of the crosslinked layer are prevented and the electrostatic properties of the crosslinked layer can be easily stabilized.

Further, as the charge transport structure, a triarylamine structure is highly effective and when a compound represented by the following Formula (3) or (4) is used, the electrical properties of the photoconductor, such as sensitivity and residual potential can be advantageously maintained.

Formula (3)

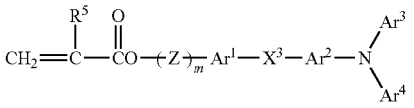

Formula (4)

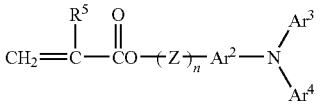

In the above Formulae (3) and (4), $R^5$ represents any one of a hydrogen atom, a halogen atom, an alkyl group which may have a substituent, an alalkyl group which may have a substituent, an aryl group which may have a substituent, a cyano group, a nitro group, an alkoxy group, a —$COOR^6$ group ($R^6$ represents any one of a hydrogen atom, an alkyl group which may have a substituent, an alalkyl group which may have a substituent and an aryl group which may have a substituent), a halogenated carbonyl group and a —$CONR^7R^8$ group ($R^7$ and $R^8$ represent independently any one of a hydrogen atom, a halogen atom, an alkyl group which may have a substituent, an alalkyl group which may have a substituent, an aryl group which may have a substituent); $Ar^1$ and $Ar^2$ may be the same as or different from each other, and represent an unsubstituted or substituted arylene group; $Ar^3$ and $Ar^4$ may be the same as or different from each other, and represent an unsubstituted or substituted aryl group; X represents any one of a single bond, an unsubstituted or substituted alkylene group, an unsubstituted or substituted cycloalkylene group, an unsubstituted or substituted alkylene ether group, an oxygen atom, a sulfur atom and a vinylene group; Z represents any one of an unsubstituted or substituted alkylene group, an unsubstituted or substituted alkylene ether group and an alkyleneoxycarbonyl group; and m and n are independently an integer of 0 to 3.

In the above Formulae (3) and (4), examples of the alkyl group as $R^5$ which may have a substituent include a methyl group, an ethyl group, a propyl group and a butyl group; examples of the aryl group as $R^5$ which may have a substituent include a phenyl group and a naphthyl group; examples of the alalkyl group as $R^5$ which may have a substituent include a benzyl group, a phenetyl group and a naphthylmethyl group; examples of the alkoxy group as $R^5$ which may have a substituent include a methoxy group, an ethoxy group and a propoxy group. These substituents as $R^5$ may be also substituted by a substituent, such as a halogen atom; a nitro group; a cyano group; an alkyl group, such as a methyl group and an ethyl group; an alkoxy group, such as a methoxy group and an ethoxy group; an aryloxy group, such as a phenoxy group; an aryl group, such as a phenyl group and a naphthyl group; and an alalkyl group, such as a benzyl group and a phenetyl group.

Among these substituents as $R^5$, particularly preferred are a hydrogen atom and a methyl group.

Examples of the unsubstituted or substituted aryl group as $Ar^3$ or $Ar^4$ include a condensated multicyclic hydrocarbon group, a none-condensated cyclic hydrocarbon group and a heterocyclic group.

Preferred examples of the multicyclic hydrocarbon group include a ring having the number of carbon atoms of 18 or less, such as a pentanyl group, an indenyl group, a naphthyl group, an azulenyl group, a heptanyl group, a biphenylenyl group, an as indacenyl group, a s-indacenyl group, a fluorenyl group, an acenaphthylenyl group, a pleiadenyl group, an acenaphthenyl group, a phenalenyl group, a phenanthryl group, an anthryl group, a fluoranthenyl group, an acephenanthrylenyl group, an aceanthrylenyl group, a triphenylenyl group, a pyrenyl group, a chrysenyl group and a naphthacenyl group.

Examples of the none-condensated cyclic hydrocarbon group include a monovalent group of a monocyclic hydrocarbon compound, such as a benzene group, a diphenyl ether group, a polyethylene diphenyl ether group, a diphenylthio ether group and a diphenyl sulfon group; a monovalent group of a none-condensated multicyclic hydrocarbon compound, such as a biphenyl group, a polyphenyl group, a diphenylalkane group, adiphenylalkene group, a diphenylalkine group, a triphenylmethane group, a distyrylbenzene group, a 1,1-diphenylcycloalkane group, a polyphenylalkane group and a polyphenylalkene group; and a monovalent group of a collected-cyclic hydrocarbon compound, such as a 9,9-diphenylfluorane group.

Examples of the heterocyclic group include a monovalent group, such as a carbazol group, a dibenzofuran group, a dibenzothiophene group, an oxyadiazole group and a thiadiazole group.

Further, the aryl group represented by $Ar^3$ or $Ar^4$ may have the following substituents (1) to (8):

(1) a halogen atom, a cyano group and a nitro group, (2) an alkyl group (, preferably a $C_1$ to $C_{12}$ linear or branched alkyl group, more preferably a $C_1$ to $C_8$ linear or branched alkyl group, still more preferably a $C_1$ to $C_4$ linear or branched alkyl group) which may have any one of a fluorine atom, a hydroxyl group, a cyano group, a $C_1$ to $C_4$ alkoxy group, a phenyl group and a phenyl group substituted by a halogen atom, a $C_1$ to $C_4$ alkyl group or a $C_1$ to $C_4$ alkoxy group and specific examples thereof include a methyl group, an ethyl group, a n-butyl group, an isopropyl group, a t-butyl group, a s-butyl group, a n-propyl group, a trifluoromethyl group, a 2-hydroxyethyl group, a 2-ethoxyethyl group, a 2-cyanoethyl group, a 2-methoxyethyl group, a benzyl group, a 4-chlorobenzyl group, a 4-methylbenzyl group and a 4-phenylbenzyl group, (3) an alkoxy group (represented by —$OR^6$, wherein $R^6$ represents an alkyl group defined in the above section (2)), wherein specific examples of the alkoxy group include a methoxy group, an ethoxy group, a n-propoxy group, an isopropoxy group, a t-butoxy group, a n-butoxy group, a s-butoxy group, an isobutoxy group, a 2-hydroxyethoxy group, a benzyloxy group and a trifluoromethoxy group, (4) an aryloxy group (in which the aryl group is any one of a phenyl group and a naphthyl group), wherein the aryloxy group may have any one of a $C_1$ to $C_4$ alkoxy group, $C_1$ to $C_4$ alkyl group and a halogen atom as a substituent and specific examples thereof include a phenoxy group, a 1-naphthyloxy group, a 2-naphthyloxy group, a 4-methoxyphenoxy group and a 4-methylphenoxy group, (5) any one of an alkylmercapto group and an arylmercapto group, wherein specific examples thereof include a methylthio group, a ethylthio group, a phenylthio group and a p-methylphenylthio group, (6) a group represented by the following Formula (5):

Formula (5)

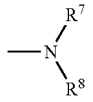

wherein $R^7$ and $R^8$ represent independently any one of a hydrogen atom, an alkyl group defined in (2) and an aryl group (examples of the aryl group include a phenyl group, a biphenyl group and a naphthyl group and the aryl group may have any one of a $C_1$ to $C_4$ alkoxy group, $C_1$ to $C_4$ alkyl group and a halogen atom as a substituent) and $R^7$ and $R^8$ may form a ring together with each other;

wherein specific examples of the group represented by Formula (5) include an amino group, a diethylamino group, a N-methyl-N-phenyl amino group, a N,N-diphenylamino group, a N,N-ditolylamino group, a dibenzylamino group, a piperidino group, a morpholino group and a pyrrolidino group, (7) any one of an alkylenedioxy group and an alkylenedithio group, such as a methylenedioxy group and a methylenedithio group, and (8) any one of an unsubstituted or substituted styryl group, an unsubstituted or substituted β-phenylstyryl group, a diphenylaminophenyl group and a ditolylaminophenyl group.

The arylene group represented by $Ar^1$ or $Ar^2$ is a divalent group derived from the aryl group represented by $Ar^3$ or $Ar^4$.

The above-noted $X^3$ in Formula (3) represents any one of a single bond, an unsubstituted or substituted alkylene group, an unsubstituted or substituted cycloalkylene group, an unsubstituted or substituted alkylene ether group, an oxygen atom, a sulfur atom and a vinylene group.

The unsubstituted or substituted alkylene group as $X^3$ is preferably a $C_1$ to $C_{12}$ linear or branched alkylene group, more preferably a $C_1$ to $C_8$ linear or branched alkylene group, still more preferably a $C_1$ to $C_4$ linear or branched alkylene group, wherein the alkylene group may have any one of a fluorine atom, a hydroxyl group, a cyano group, a $C_1$ to $C_4$ alkoxy group, a phenyl group and a phenyl group substituted by a halogen atom, a $C_1$ to $C_4$ alkyl group or a $C_1$ to $C_4$ alkoxy group; and specific examples of the alkylene group as $X^3$ include a methylene group, an ethylene group, a n-butylene group, an isopropylene group, a t-butylene group, a s-butylene group, a n-propylene group, a trifluoromethylene group, a 2-hydroxyethylene group, a 2-ethoxyethylene group, a 2-cyanoethylene group, a 2-methoxyethylene group, a benzylidene group, a phenylethylene group, a 4-chlorophenylethylene group, a 4-methylphenylethylene group and a 4-biphenylethylene group.

The unsubstituted or substituted cycloalkylene group as $X^3$ is a $C_5$ to $C_7$ cycloalkylene group which may have any one of a fluorine atom, a hydroxyl group, a $C_1$ to $C_4$ alkyl group and a $C_1$ to $C_4$ alkoxy group as a substituent, wherein specific examples of the unsubstituted or substituted cycloalkylene group as $X^3$ include a cyclohexylidene group, a cyclohexylene group and a 3,3-dimethylcyclohexylidene group.

Examples of the unsubstituted or substituted alkylene ether group as $X^3$ include an ethyleneoxy group, a propyleneoxy group, an ethyleneglycol group, a propyleneglycol group, a diethyleneglycol group, a tetraethyleneglycol group and a tripropyleneglycol group and the alkylene ether group may have a substituent, such as a hydroxyl group, a methyl group and an ethyl group.

The vinylene group as $X^3$ is a group represented by the following formulae (6) or (7):

Formula (6)

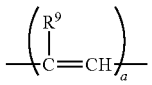

or

Formula (7)

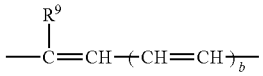

wherein $R^9$ represents any one of a hydrogen atom, an alkyl group (the same group as the alkyl group defined in the above (2)) and an aryl group (the same group as the aryl group represented by the above $Ar^3$ or $Ar^4$); and a is an integer of 1 or 2 and b is an integer of 1 to 3.

The above-noted Z represents any one of an unsubstituted or substituted alkylene group, an unsubstituted or substituted alkylene ether group and an alkyleneoxycarbonyl group, wherein examples of the unsubstituted or substituted alkylene group and the unsubstituted or substituted alkylene ether group include respectively the same alkylene group as the alkylene group as the above $X^3$ and the same alkylene ether group as the alkylene ether group as the above $X^3$ and examples of the alkyleneoxycarbonyl group include a caprolactone-modified group.

More preferred examples of the radical polymerizable compounds having one functionality and a charge transport structure according to the present invention include a compound represented by the following Formula (8):

Formula (8)

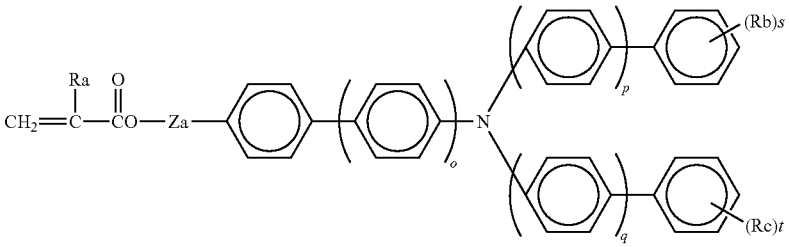

wherein o, p and q are independently an integer of 0 or 1; Ra represents any one of a hydrogen atom and a methyl group; Rb and Rc represent a $C_1$ to $C_6$ alkyl group (a substituent other than a hydrogen atom), plural Rbs may be different from each other and plural Rcs may be different from each other; s and t are independently an integer of 0 to 3; Za represents any one of a single bond, a methylene group, an ethylene group and groups represented by the following formulae:

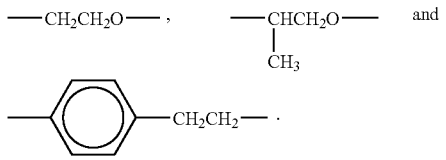

As the compound represented by Formula (8), the compound in which the substituents Rb and Rc are independently any one of a methyl group and an ethyl group is particularly preferred.

When a radical polymerizable compounds having one functionality and a charge transport structure, which is represented by the above-noted formula (3), (4) or (8) is polymerized, the double bond of C═C is opened for the both side, so that the above-noted compound does not become a terminal structure and become incorporated in a chain polymer. When the above-noted compound is copolymerized with a radical polymerizable monomer having three or more functionalities, in the polymer formed by the crosslinking, the above-noted compound is present either in a backbone chain of the formed macromolecule or in a crosslinking chain between a backbone chain and another backbone chain (this crosslinking chain has two types, such as the intermolecular crosslinking chain between a macromolecule and another macromolecule; and the intramolecular crosslinking chain which crosslinks a portion of a bended backbone chain with another portion thereof in one macromolecule). Whether the above-noted compound is present in the above-noted backbone chain or in the above-noted crosslinking chain, the triarylamine structure pending from the chain has at least three aryl groups arranged in the radiation direction from the nitrogen atom and is bulky; however since the triarylamine structure is bonded to the chain not directly but through the carbonyl group and is accordingly fixed in a three-dimensionally flexible state, the triarylamine structure can be arranged in the macromolecule in such a manner that the triarylamine structure adjoins properly to another structure and accordingly in the macromolecule containing the triarylamine structure, the structural strain is small. Therefore, it is assumed that when the triarylamine structure is incorporated in the surface layer of the photoconductor, the triarylamine structure can take an intramolecular structure which is relative free from the extinction of the charge transporting path.

Specific examples of the radical polymerizable compounds having one functionality and a charge transport structure according to the present invention include the compounds represented by the following formulae No. 1 to 160, which should not be construed as limiting the scope of the present invention.

No. 1

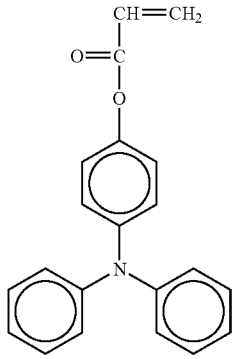

No. 2

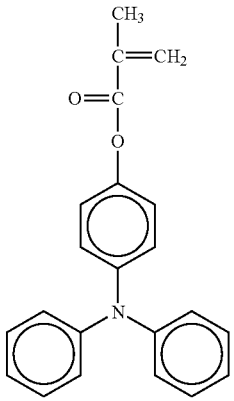

No. 3

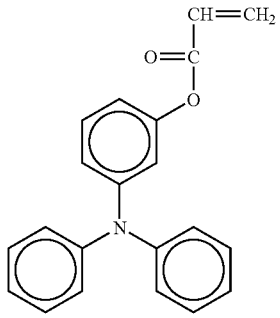

No. 4

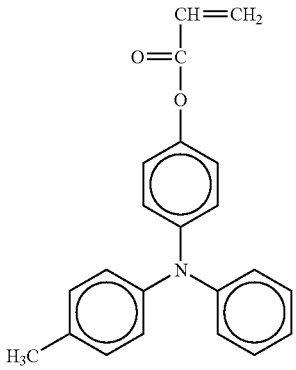

-continued
No. 5
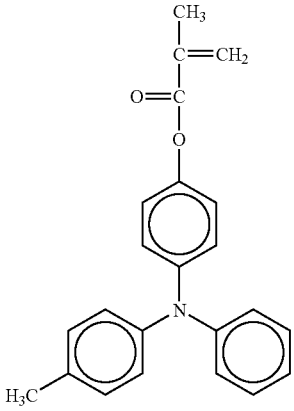
No. 6
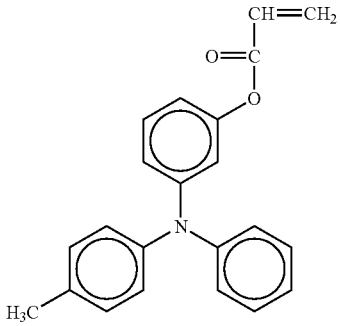
No. 7
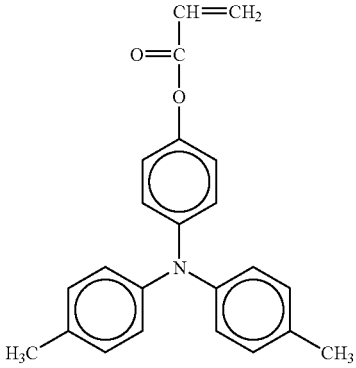
No. 8
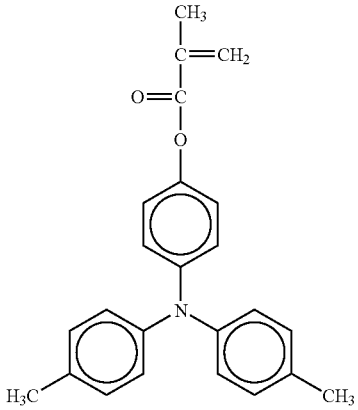
No. 9
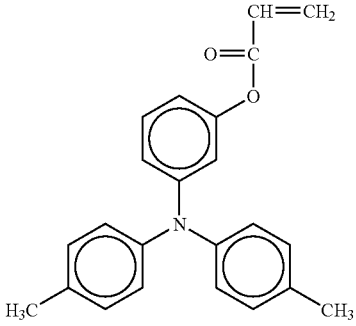
No. 10
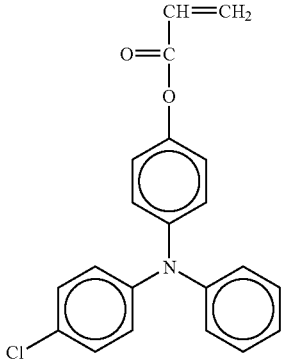
No. 11
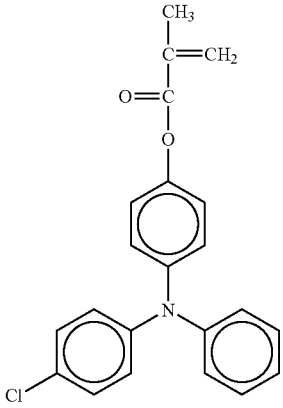
No. 12
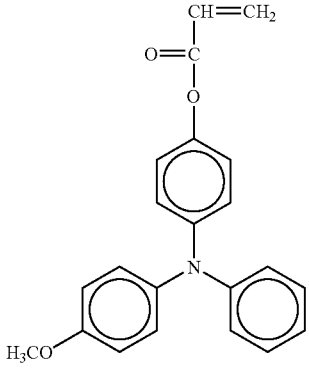

-continued
No. 13
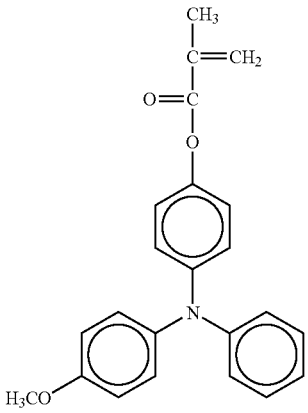
No. 14
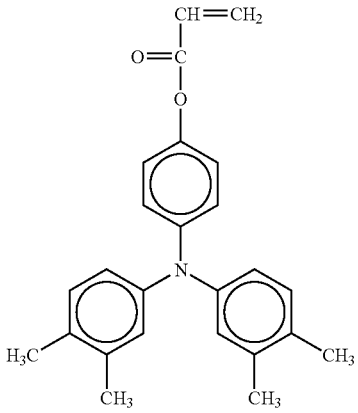
No. 15
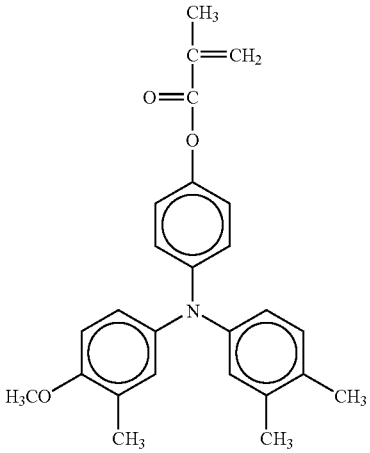
No. 16
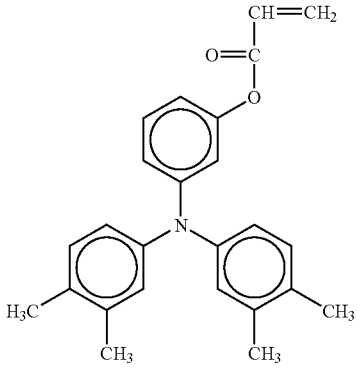
No. 17
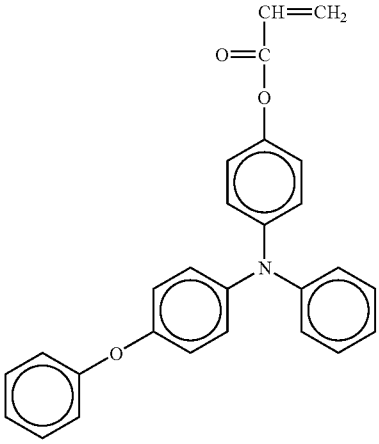
No. 18
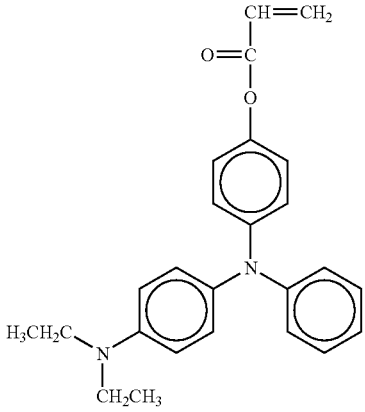

-continued
No. 19
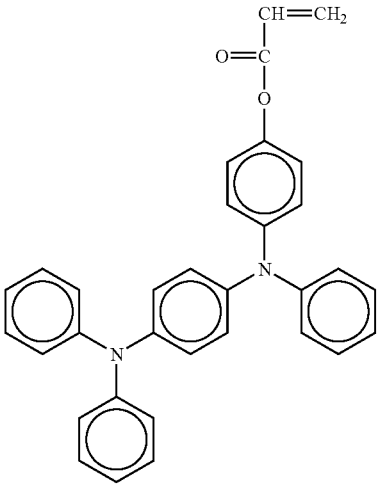
No. 20
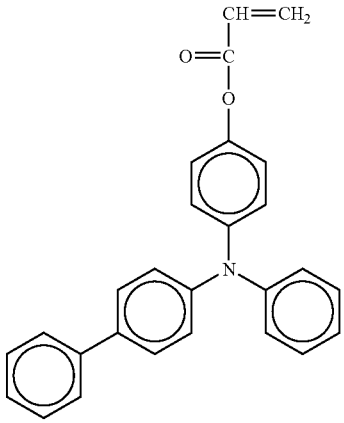
No. 21
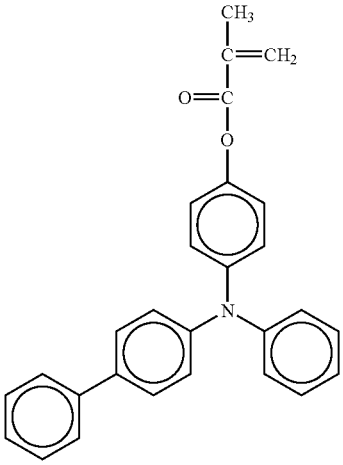
No. 22
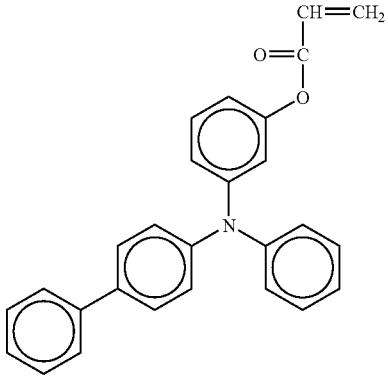
No. 23
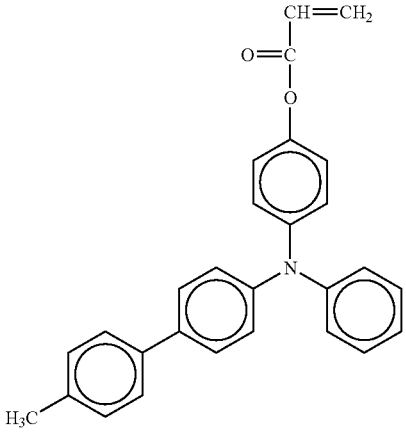
No. 24
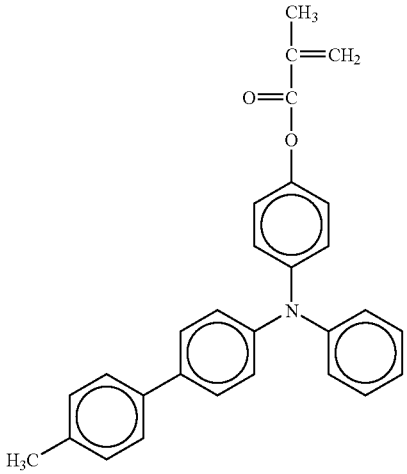

-continued
No. 25
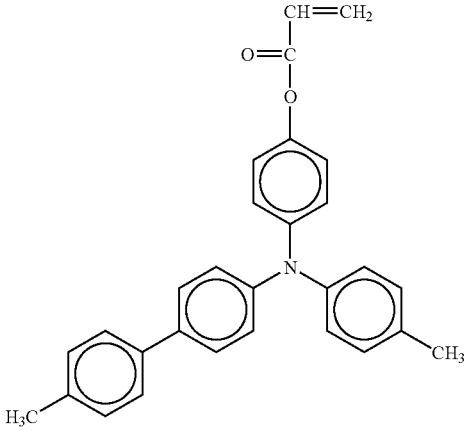
No. 26
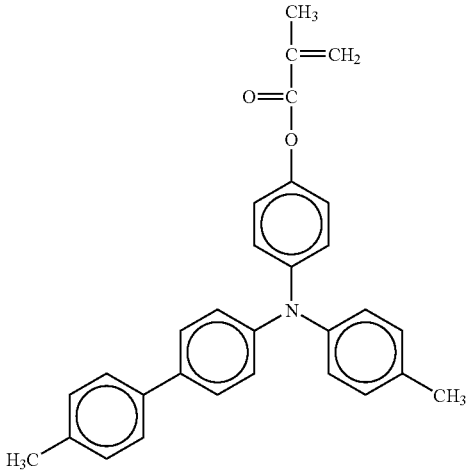
No. 27
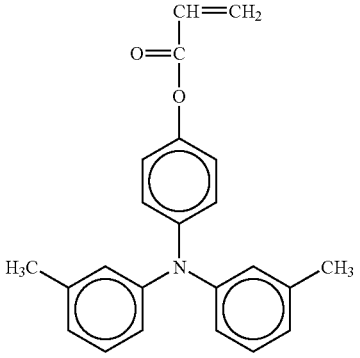
No. 28
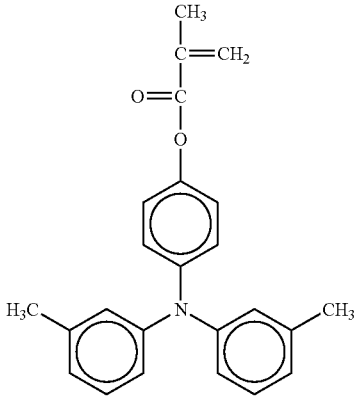
No. 29
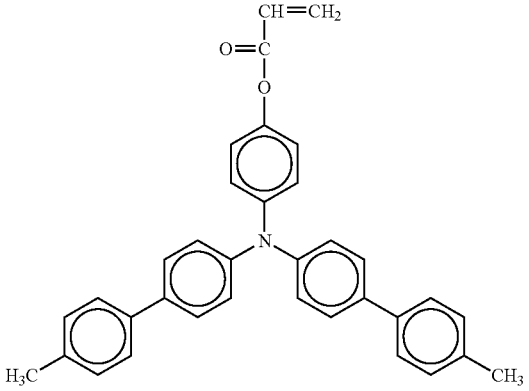
No. 30
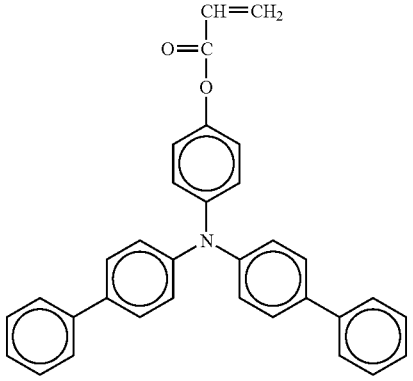

-continued
No. 31
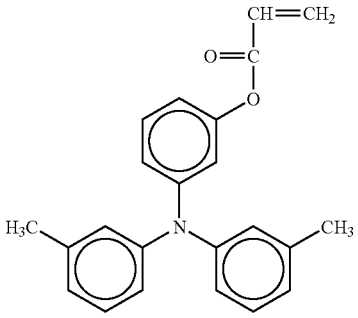
No. 32
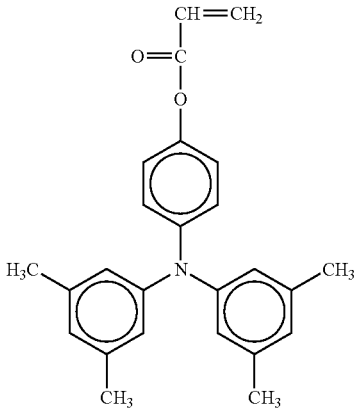
No. 33
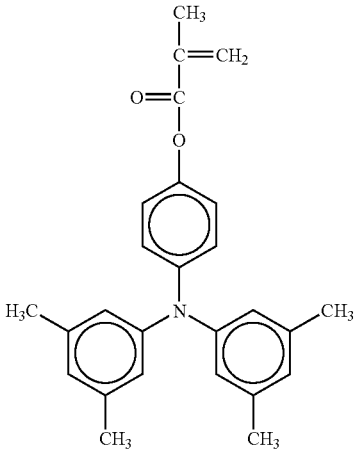
No. 34
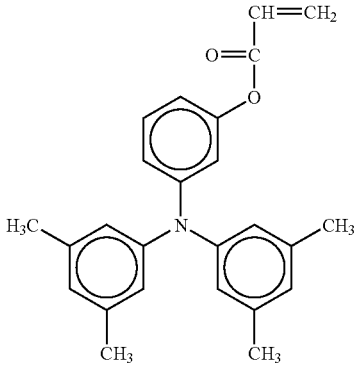
No. 35
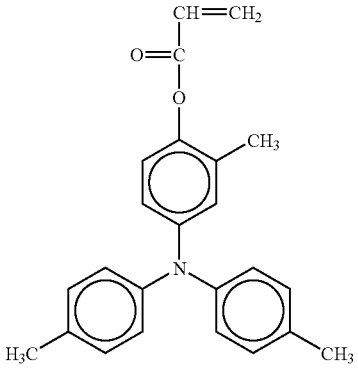
No. 36
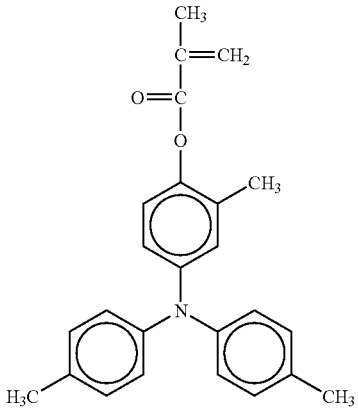

-continued
No. 37
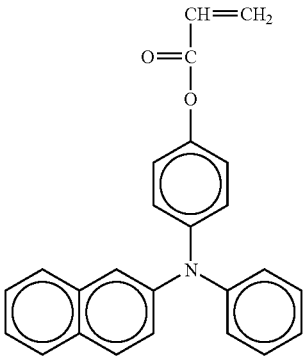
No. 38
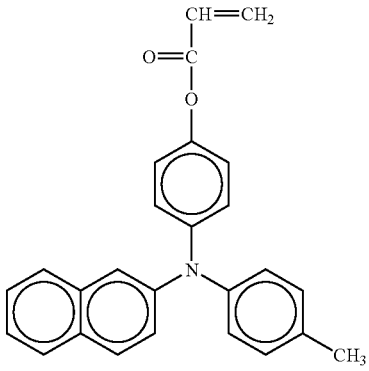
No. 39
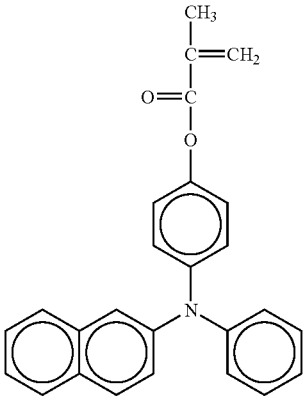
No. 40
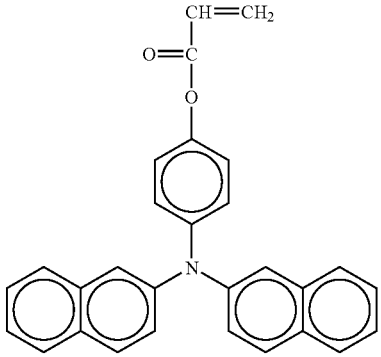
No. 41
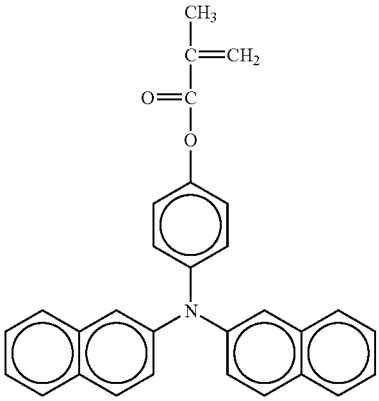
No. 42
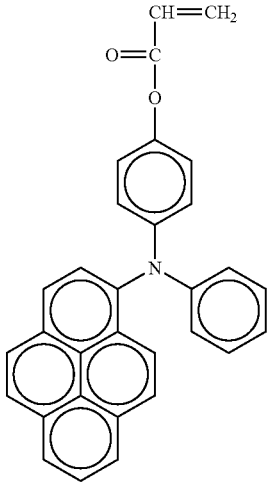

-continued
No. 43
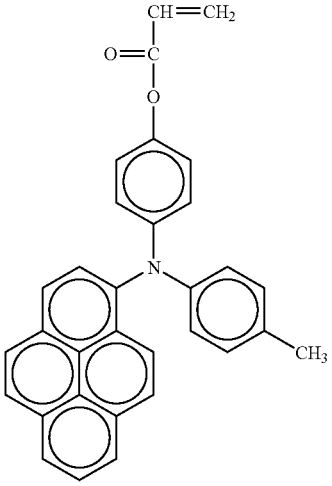
No. 44
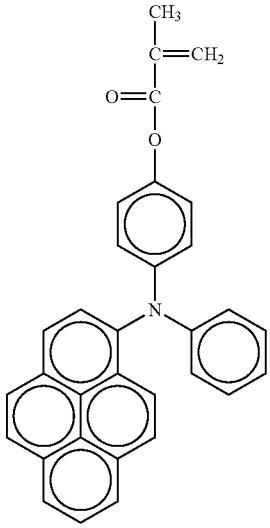
No. 45
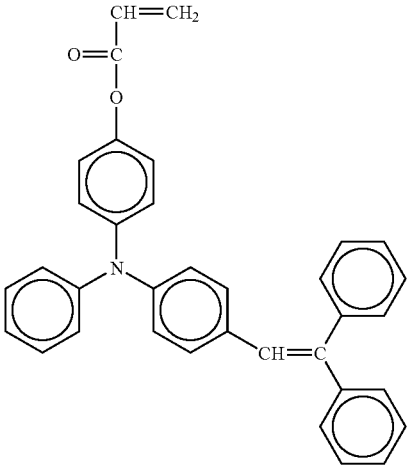
No. 46
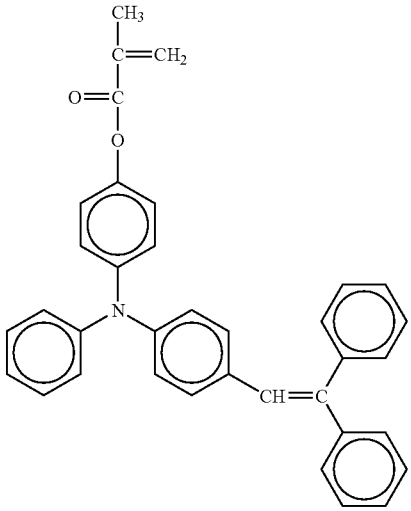
No. 47
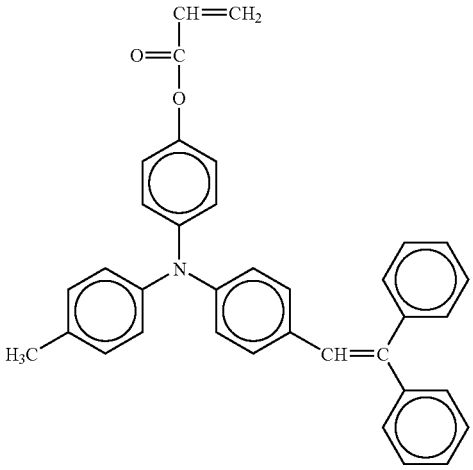
No. 48
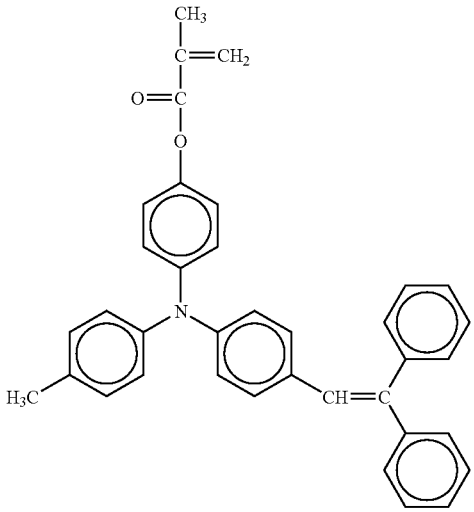

-continued
No. 49
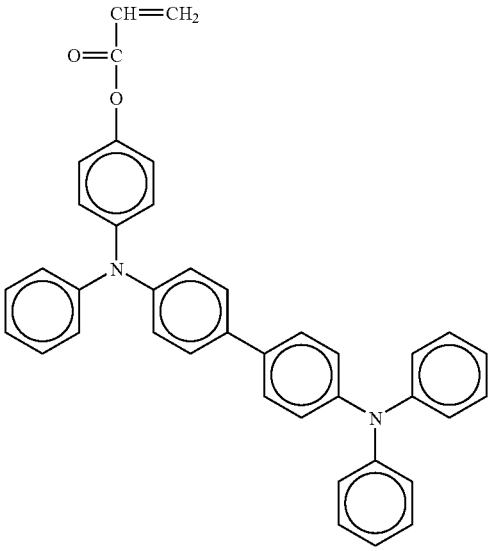
No. 50
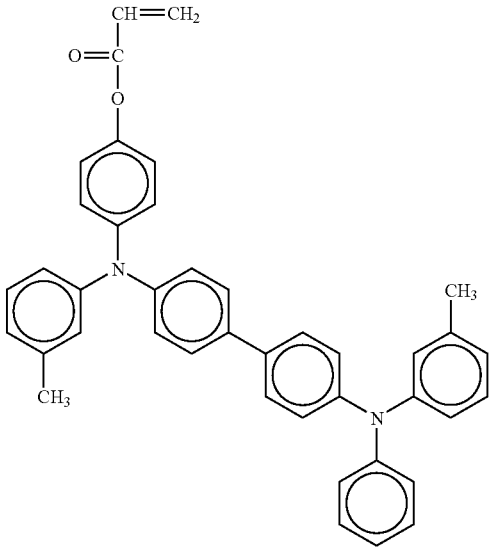
No. 51
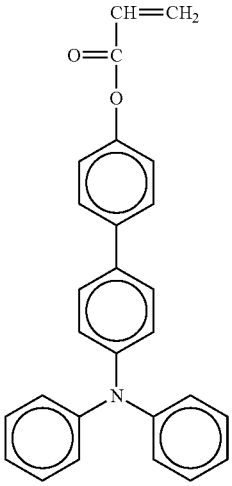
No. 52
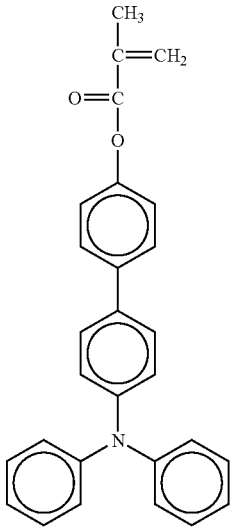
No. 53
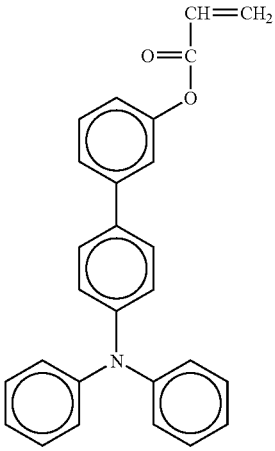
No. 54
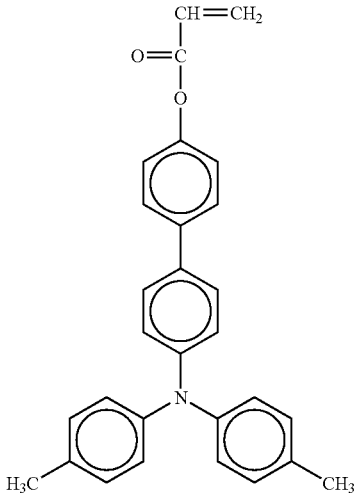

-continued
No. 55
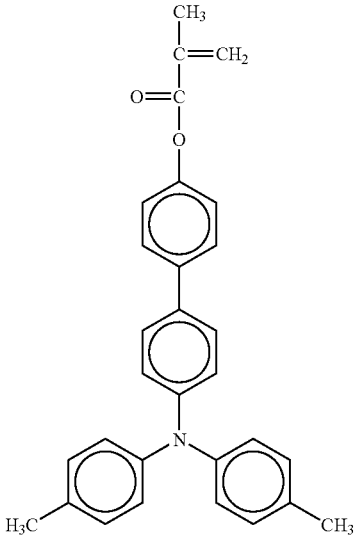
No. 56
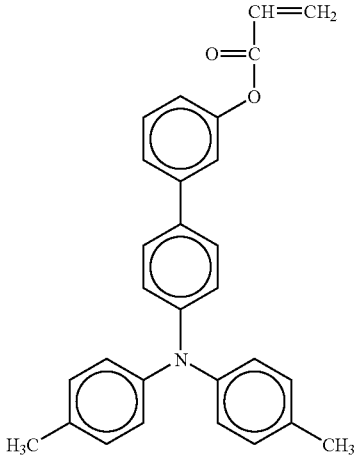
No. 57
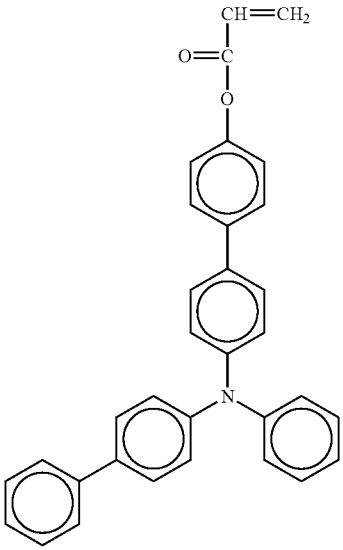
No. 58
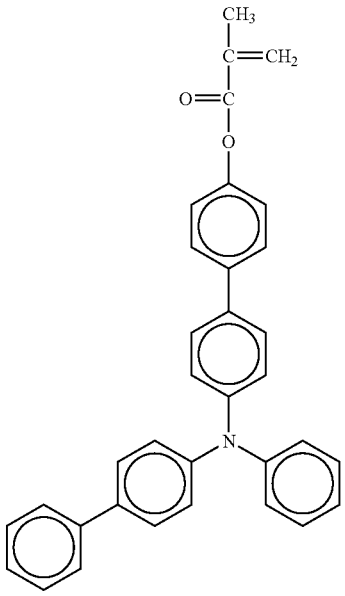

-continued
No. 59
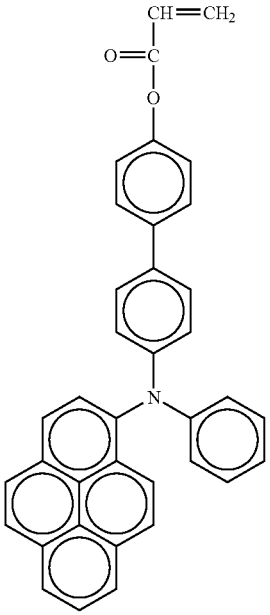
No. 60
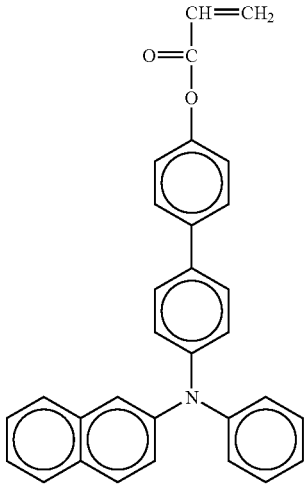
No. 61
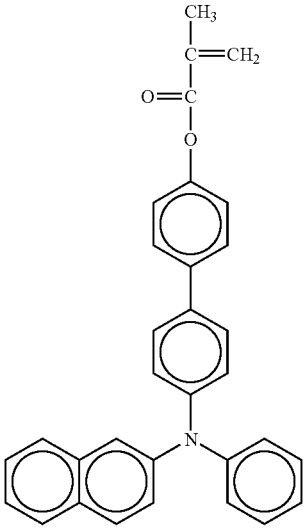
No. 62
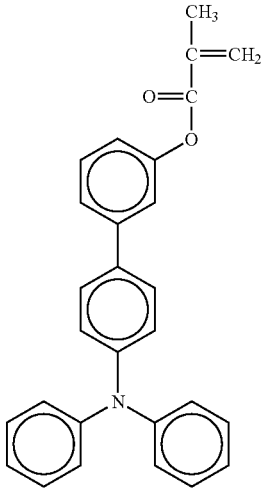

-continued
No. 63
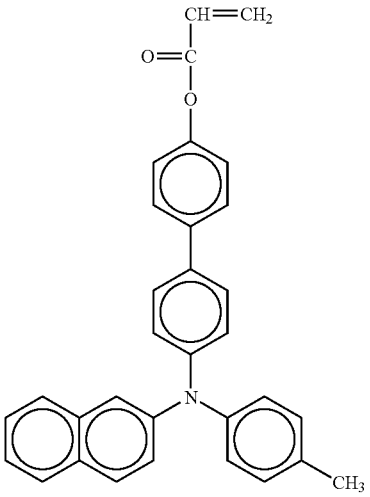
No. 64
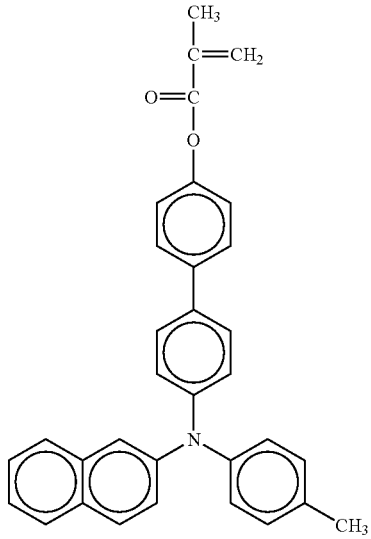
No. 65
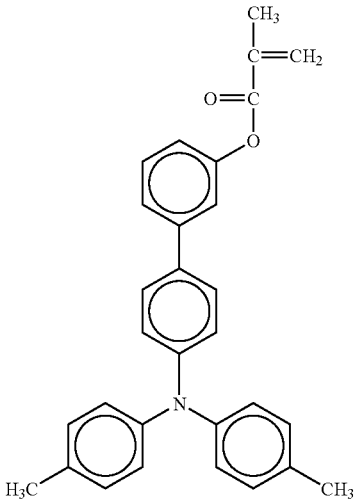
No. 66
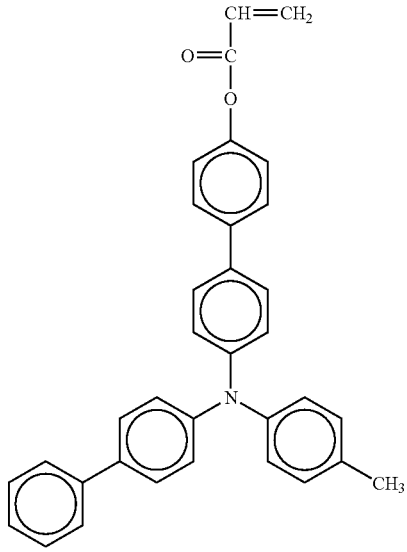

-continued
No. 67
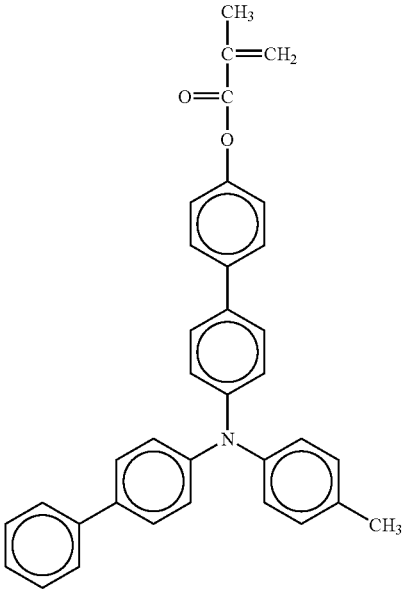
No. 68
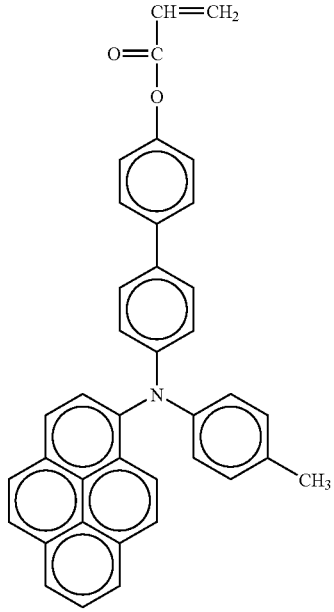
No. 69
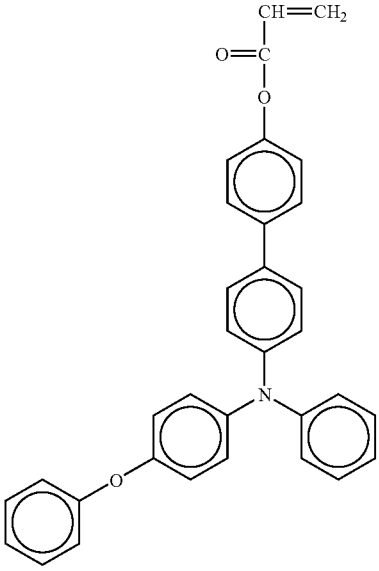
No. 70
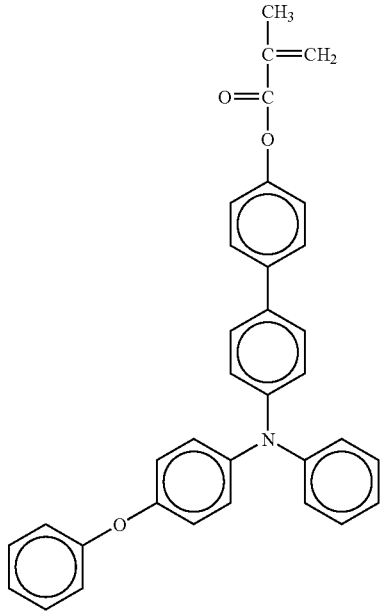

-continued
No. 71
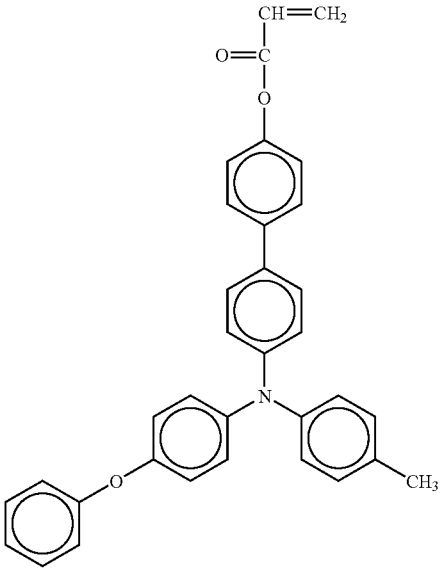
No. 72
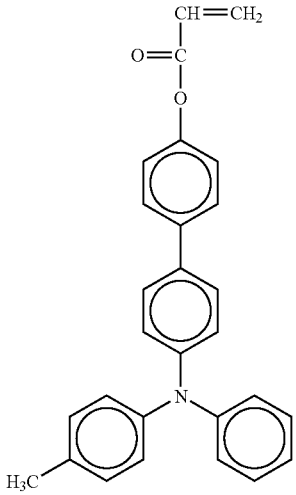
No. 73
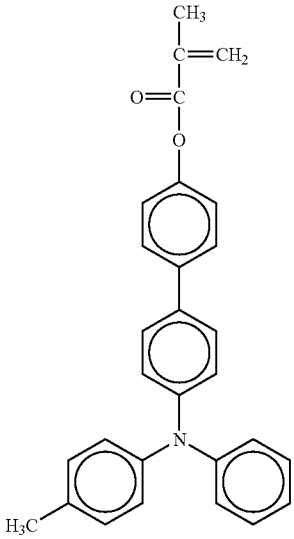
No. 74
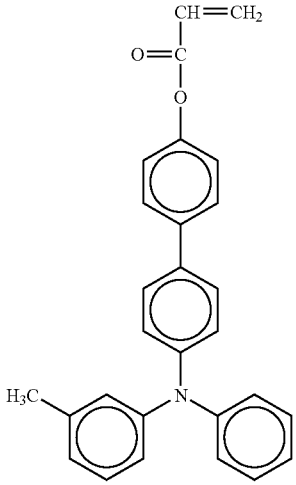
No. 75
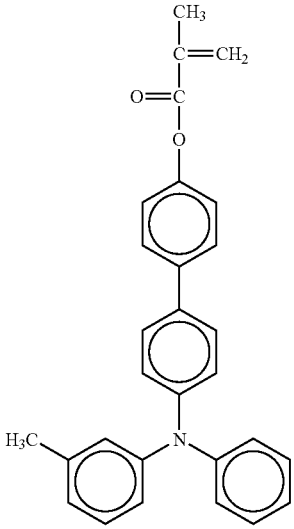
No. 76
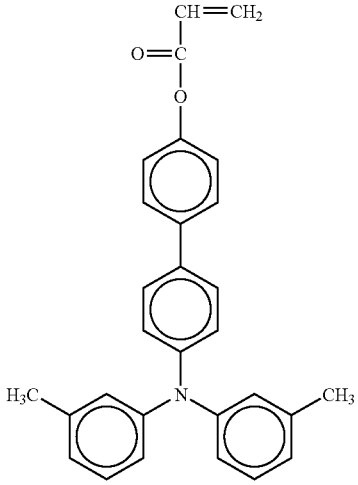

-continued
No. 77
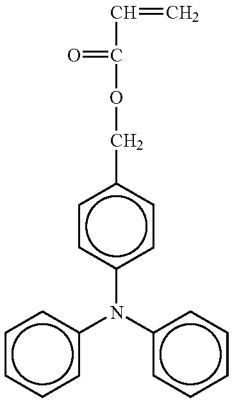
No. 78
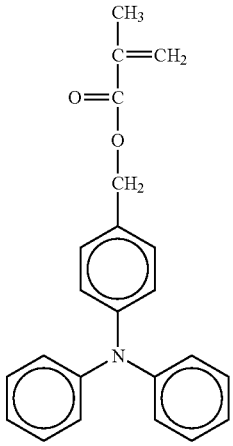
No. 79
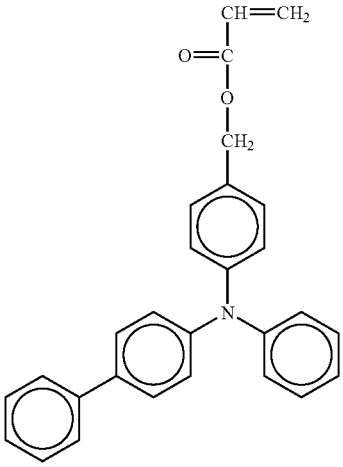
No. 80
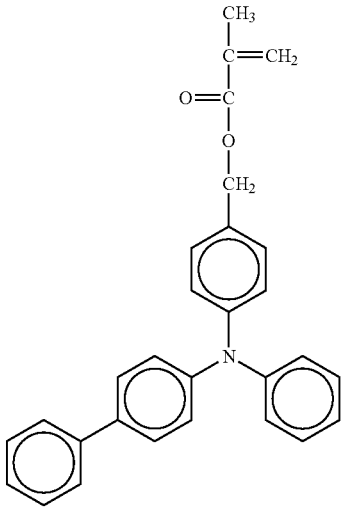
No. 81
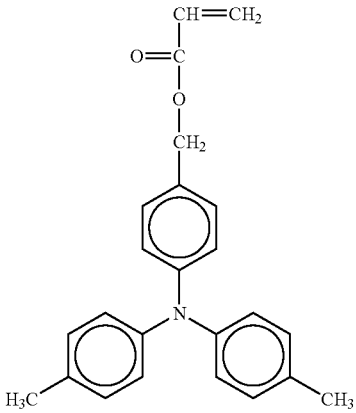
No. 82
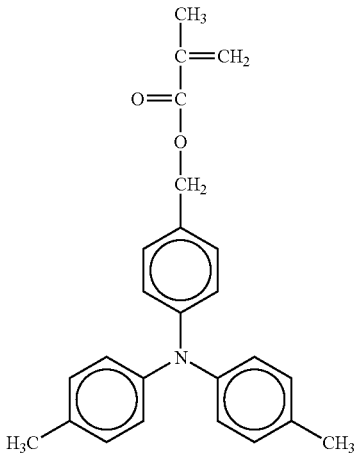

-continued
No. 83
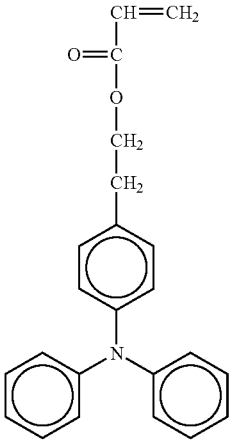
No. 84
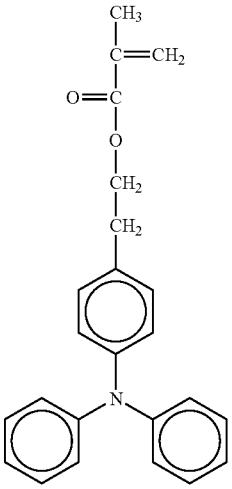
No. 85
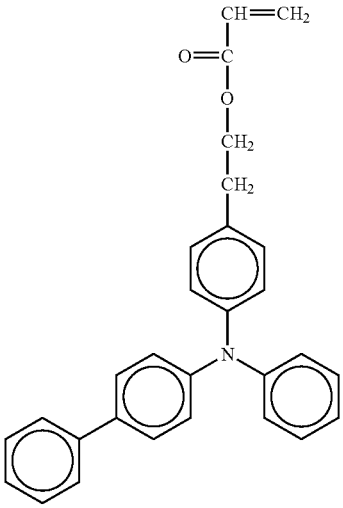
No. 86
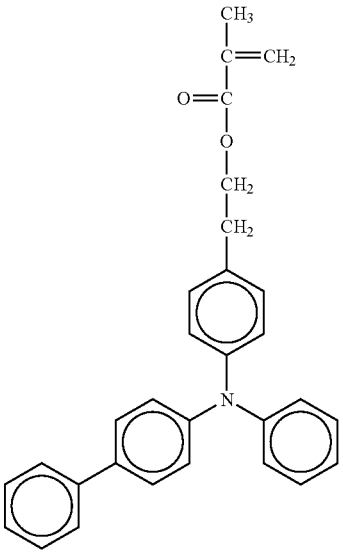
No. 87
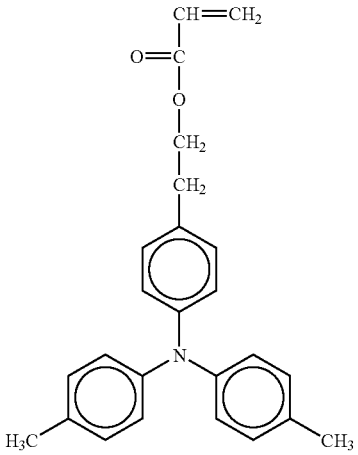
No. 88
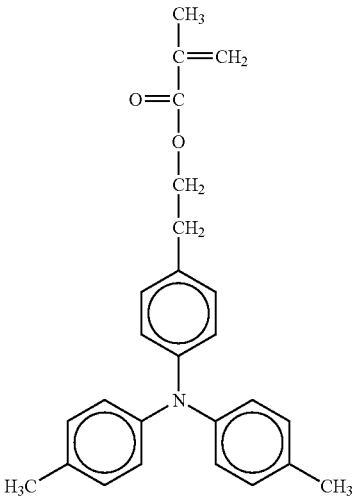

-continued
No. 89
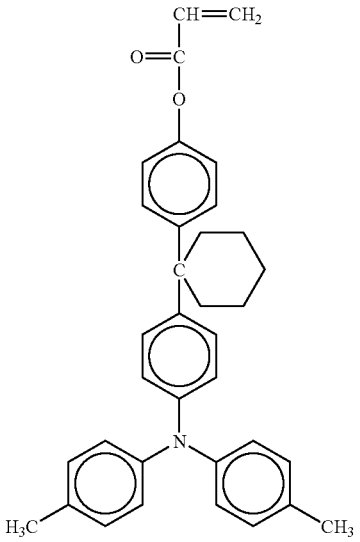
No. 90
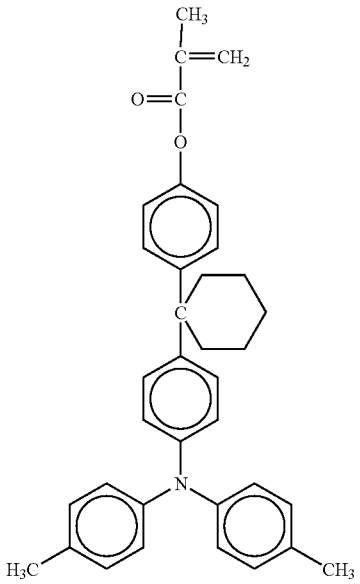
No. 91
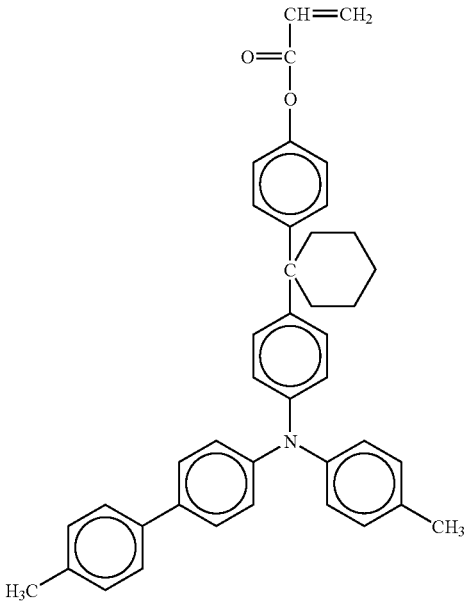
No. 92
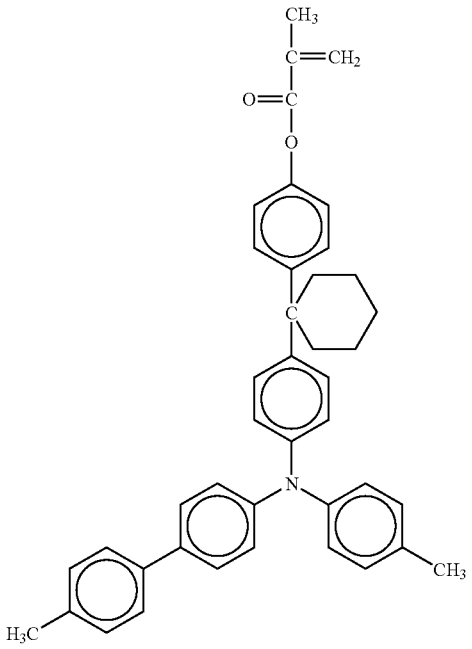

-continued
No. 93
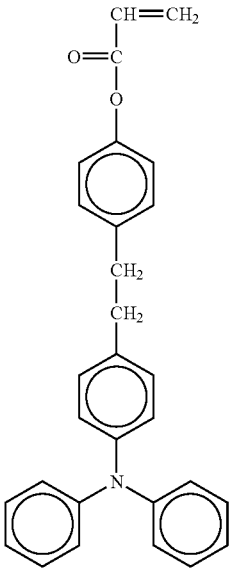
No. 94
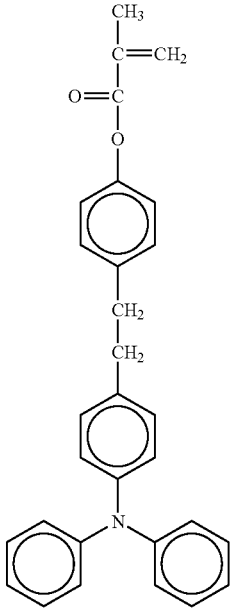
No. 95
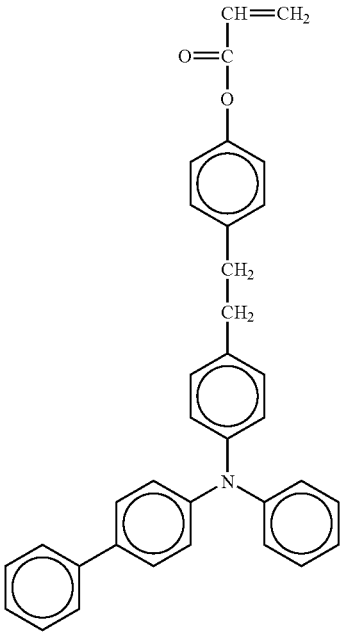
No. 96
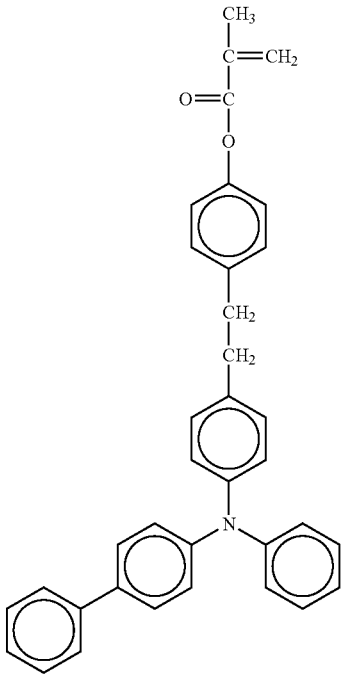

-continued
No. 97
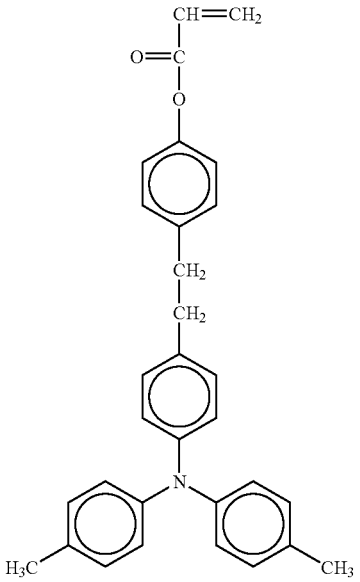
No. 98
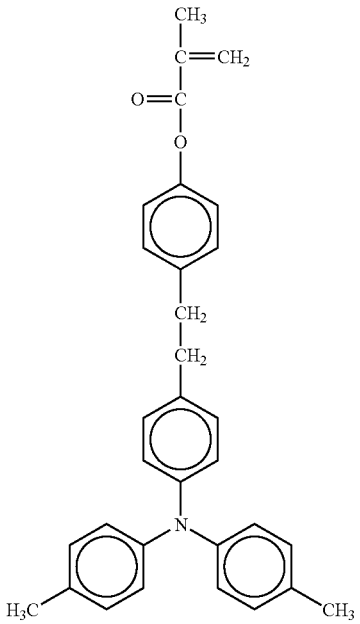
No. 99
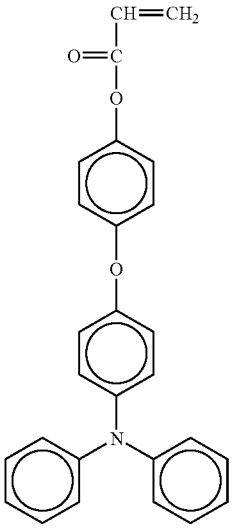
No. 100
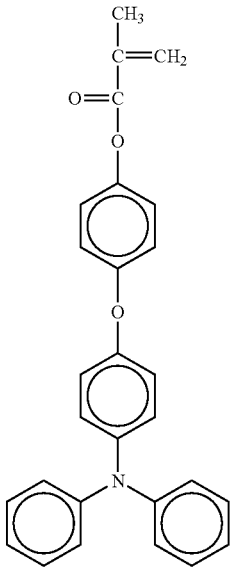

-continued
No. 101
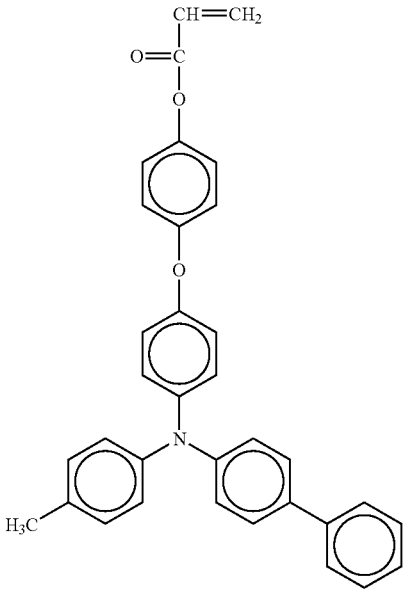
No. 102
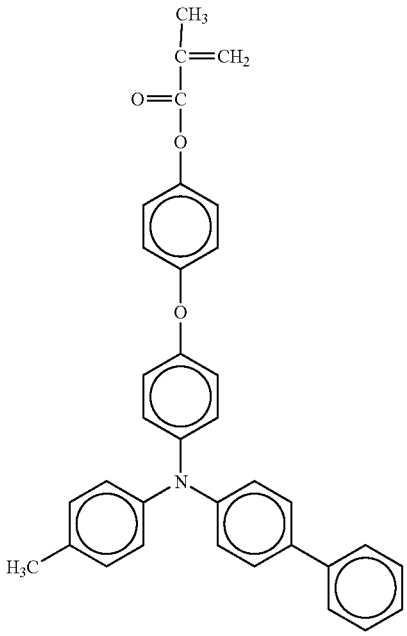
No. 103
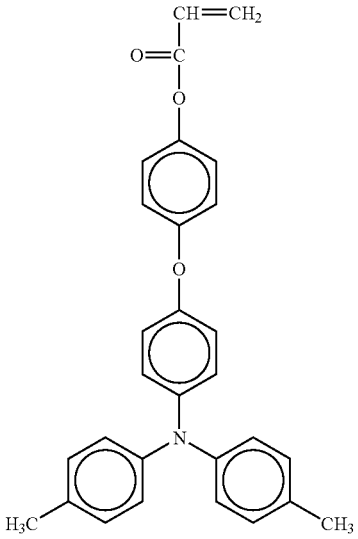
No. 104
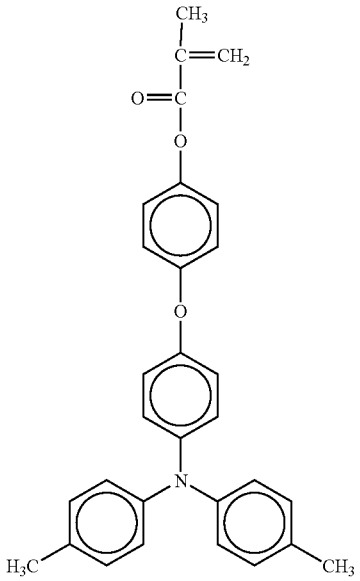

-continued
No. 105
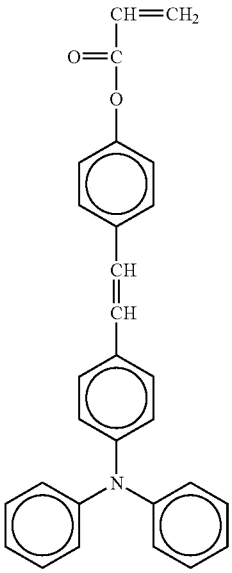
No. 106
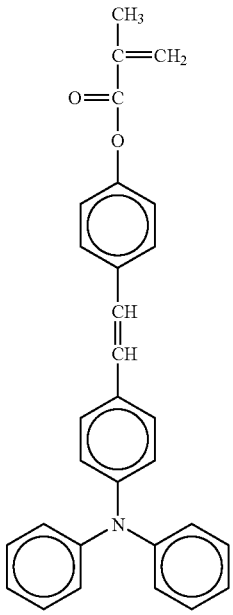
No. 107
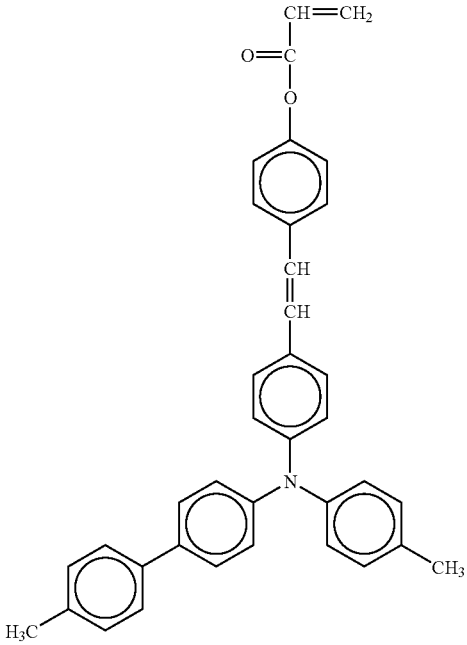
No. 108
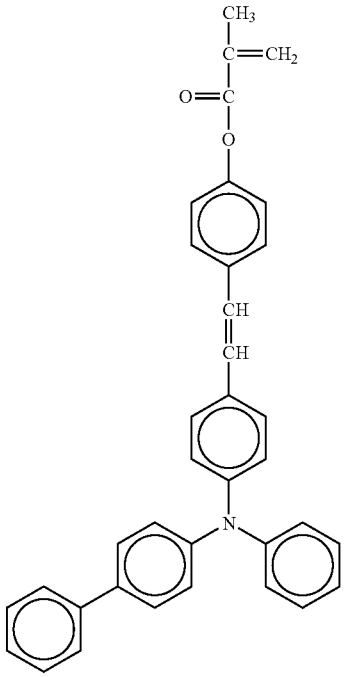

-continued
No. 109
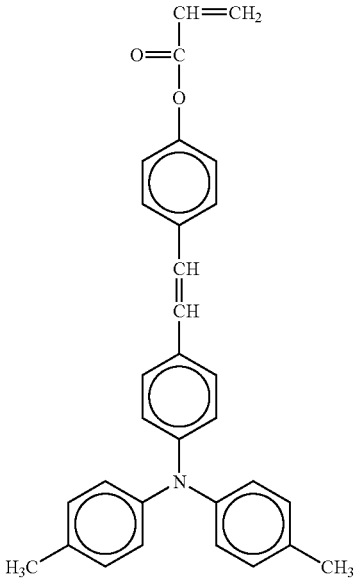
No. 110
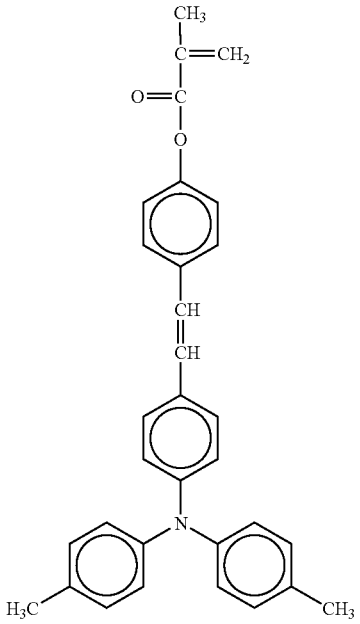
No. 111
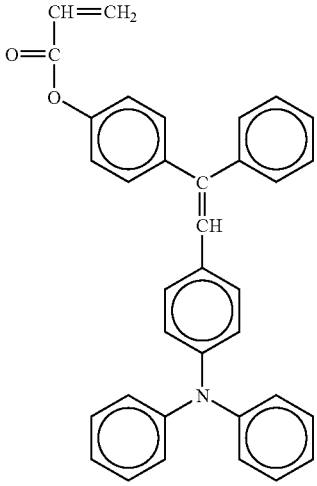
No. 112
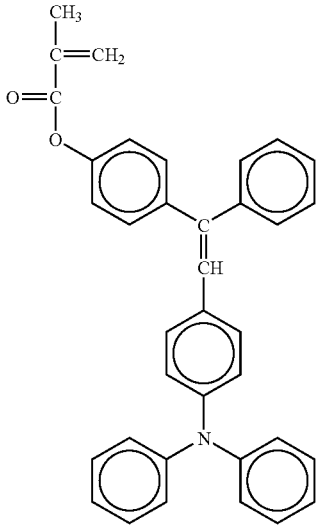

-continued
No. 113
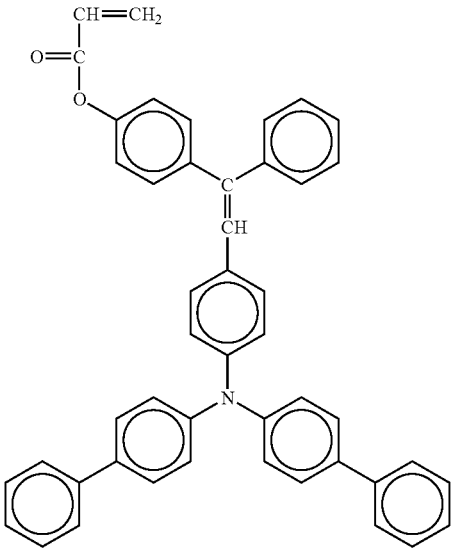
No. 114
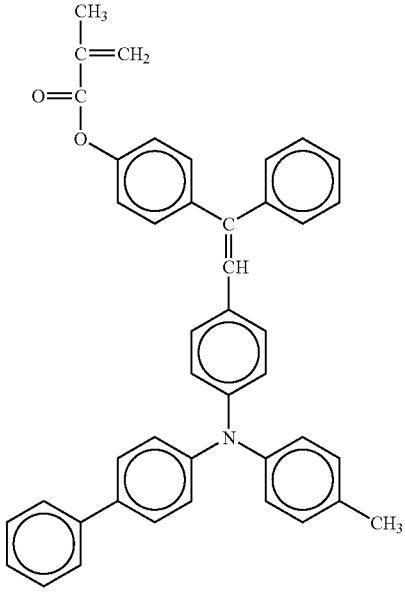
No. 115
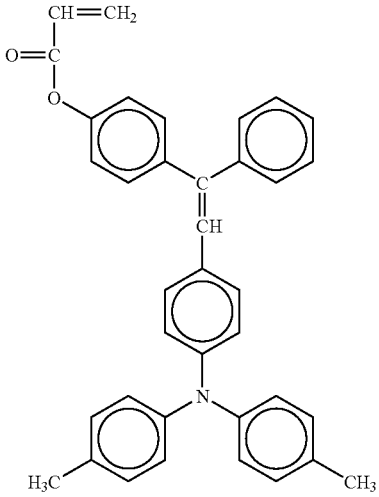
No. 116
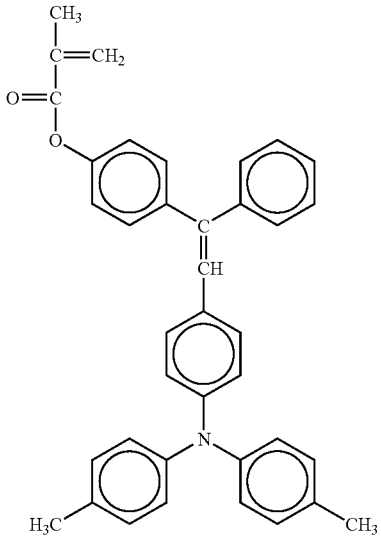

-continued
No. 117
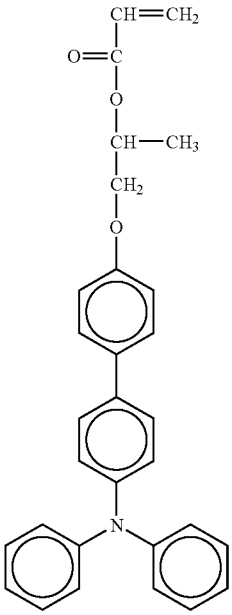
No. 118
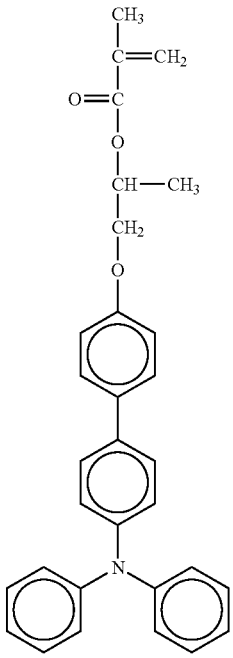
No. 119
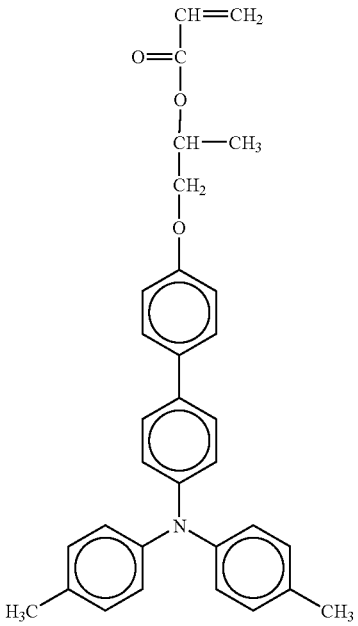
No. 120
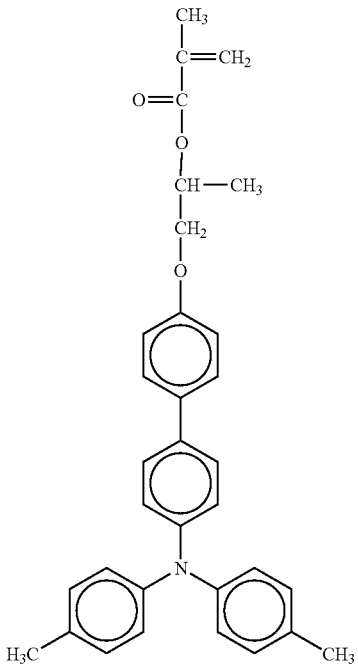

-continued
No. 121
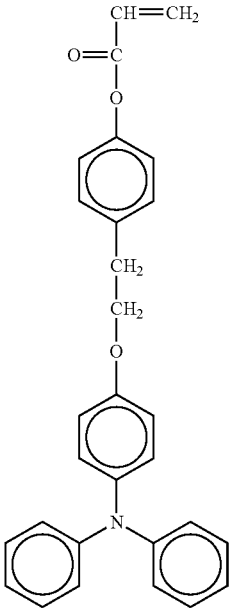
No. 122
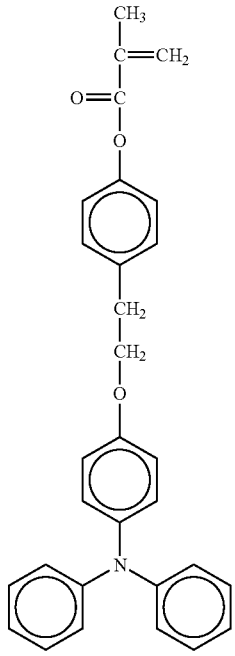
No. 123
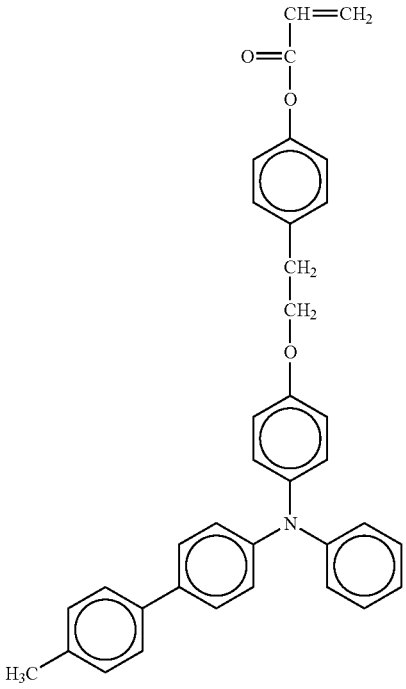
No. 124
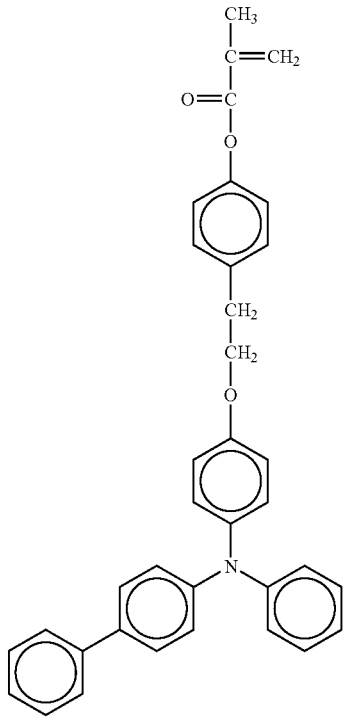

-continued
No. 125
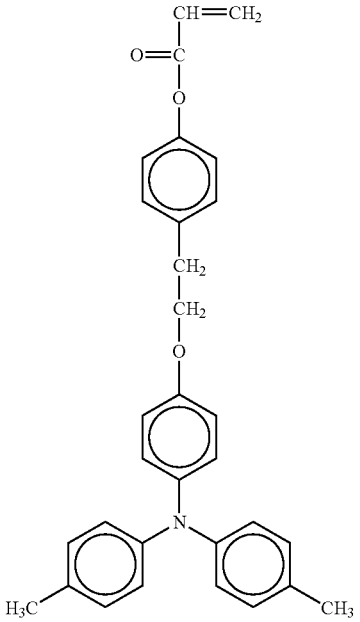
No. 126
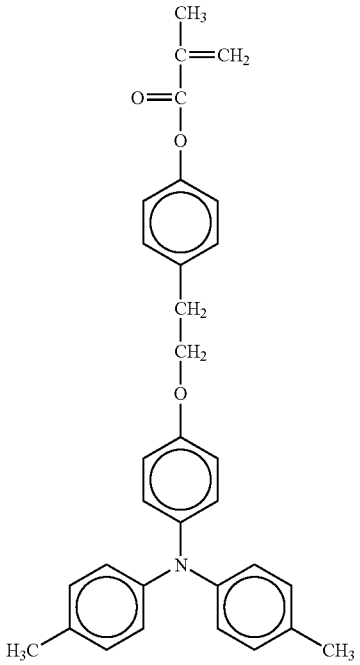
No. 127
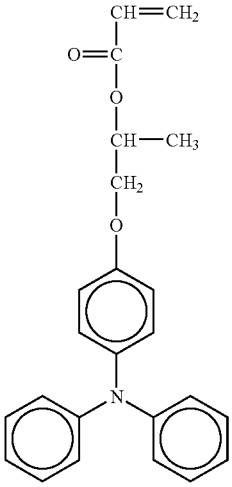
No. 128
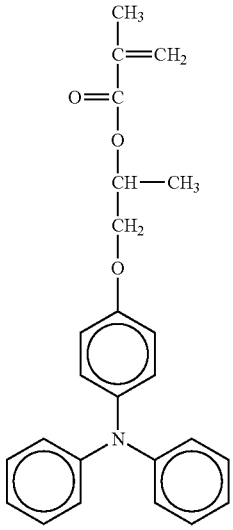

-continued
No. 129
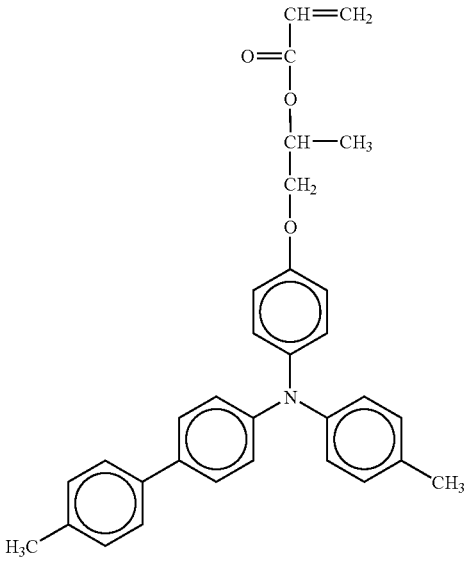
No. 130
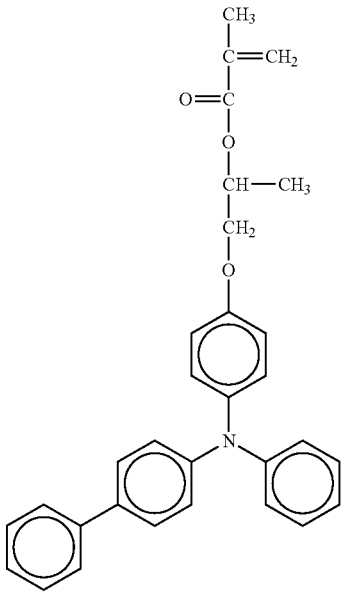
No. 131
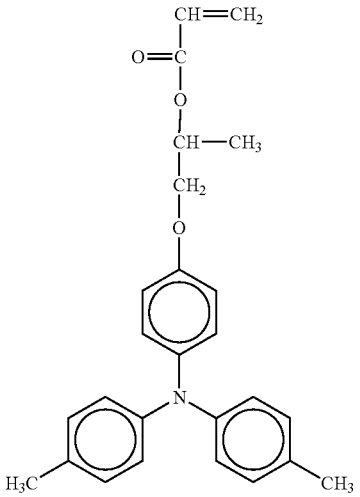
No. 132
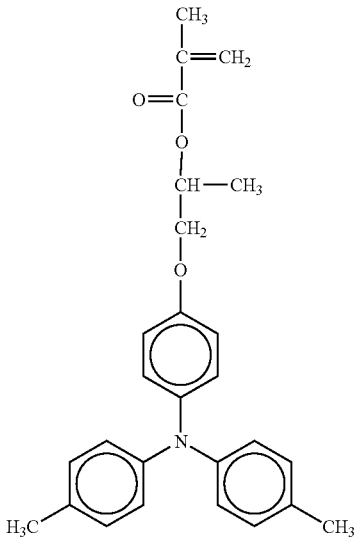
No. 133
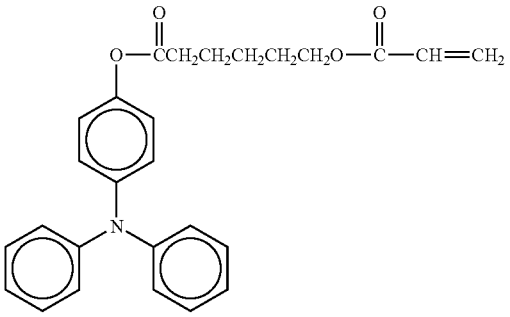
No. 134
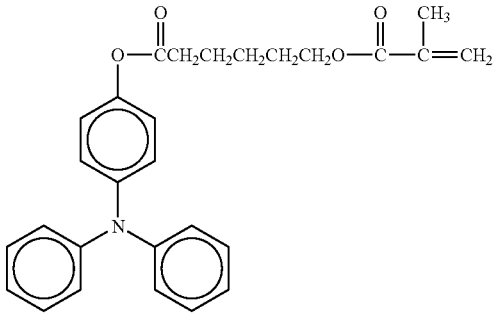

-continued
No. 135
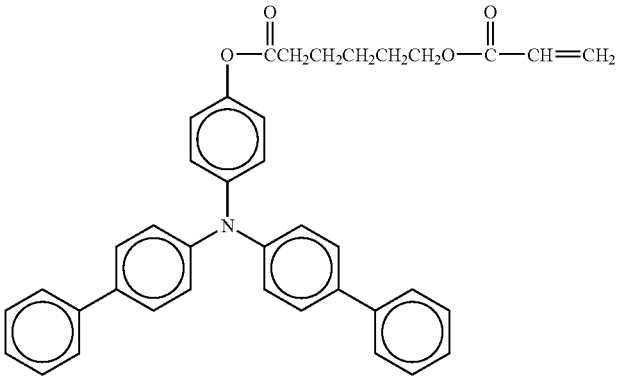
No. 136
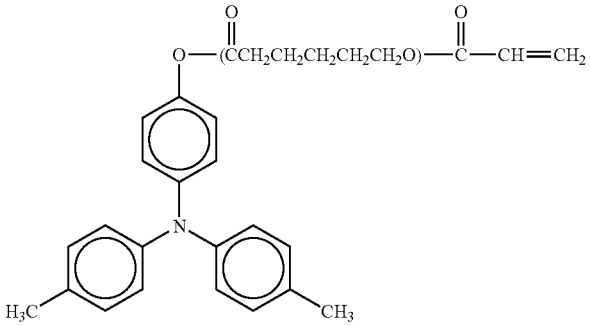
No. 137
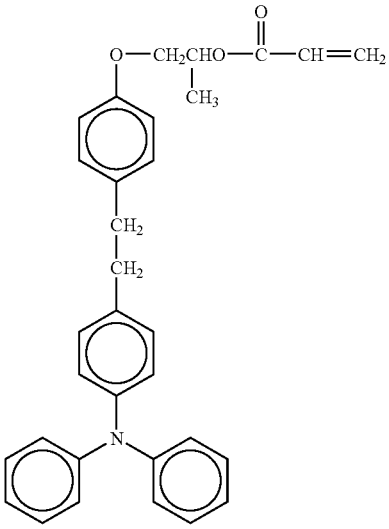
No. 138
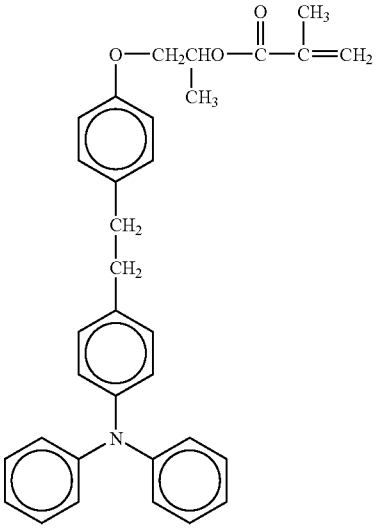

-continued
No. 139
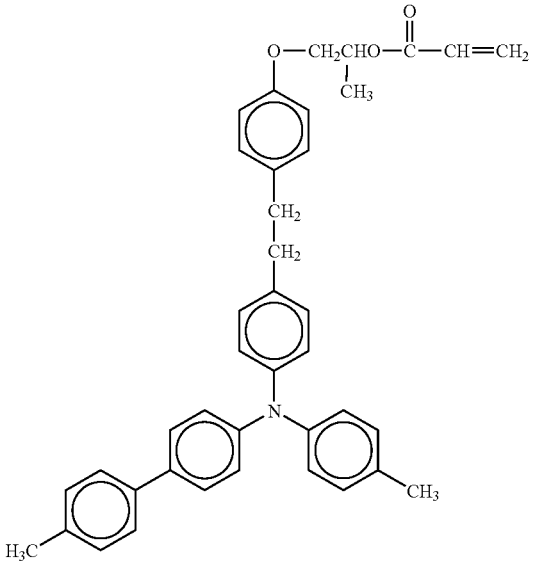
No. 140
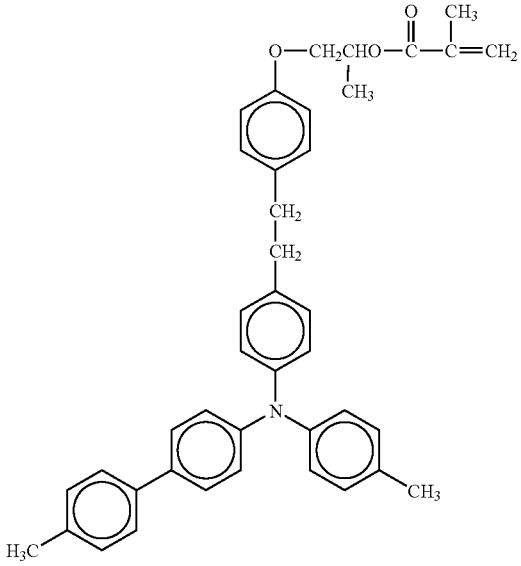
No. 141
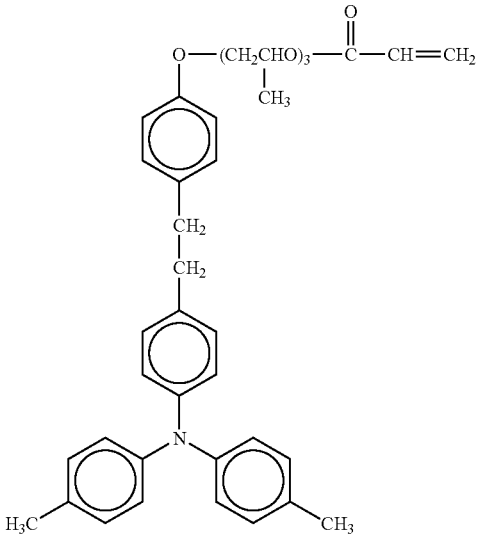
No. 142
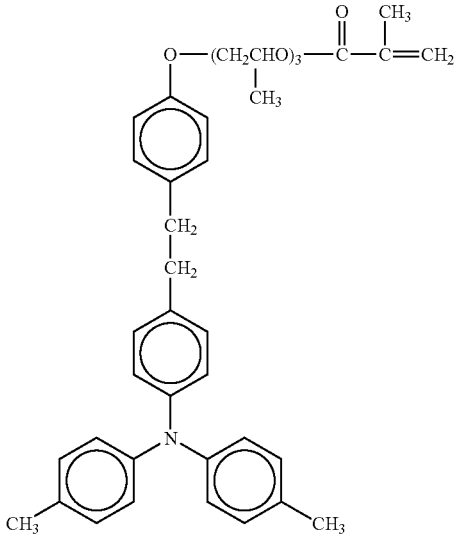
No. 143
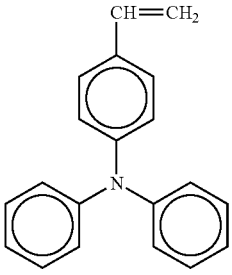
No. 144
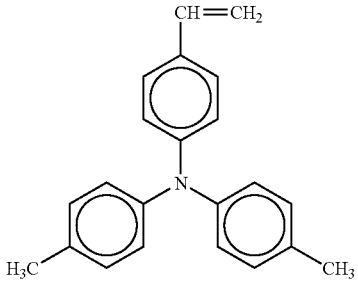

-continued
No. 145
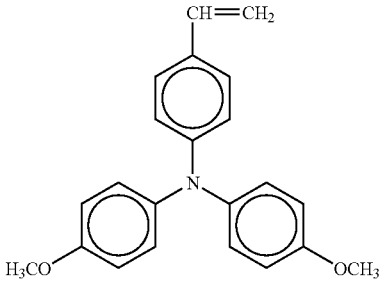
No. 146
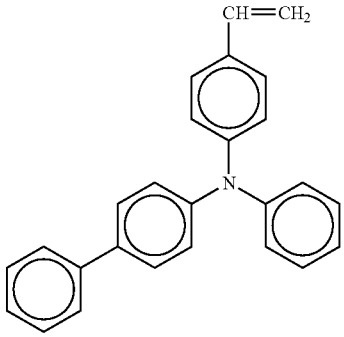
No. 147
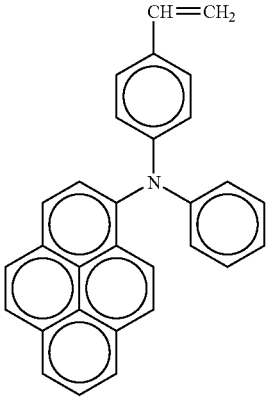
No. 148
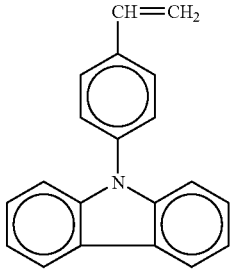
No. 149
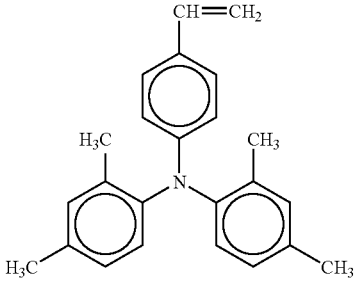
No. 150
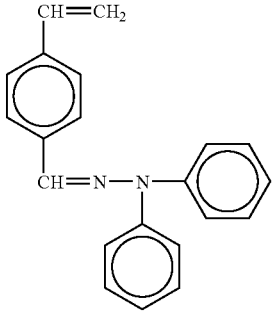
No. 151
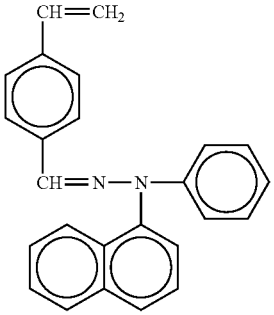
No. 152
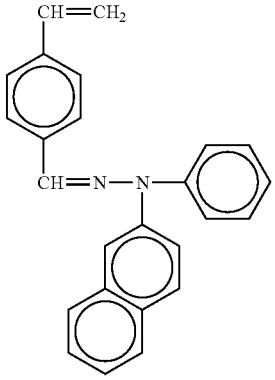

-continued
No. 153
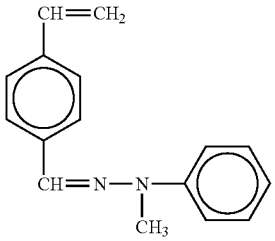
No. 154
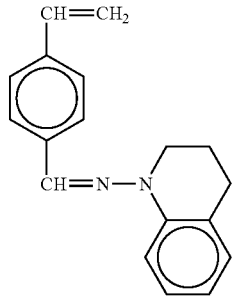
No. 155
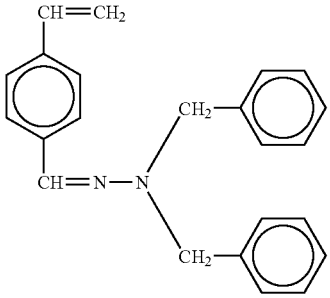
No. 156
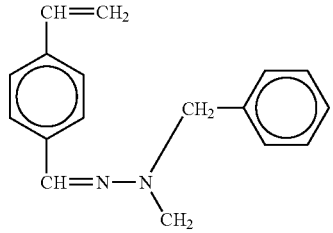
No. 157
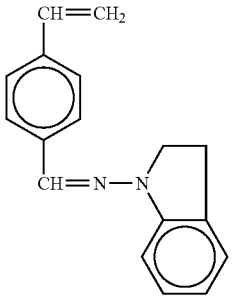
No. 158
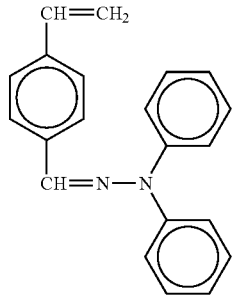
No. 159
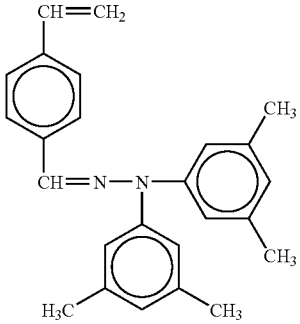
No. 160
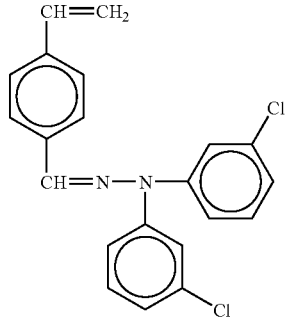
Specific examples of the radical polymerizable compounds having two functionalities and a charge transport structure according to the present invention include the compounds represented by the following formulae No. 161 to No. 363, which should not be construed as limiting the scope of the present invention.

NO. 161
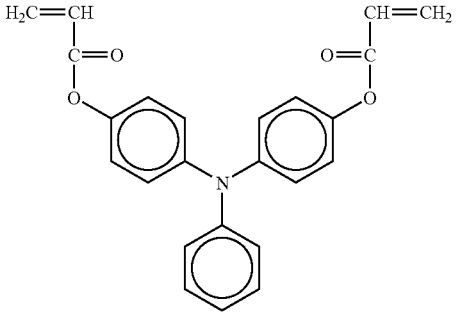
NO. 162
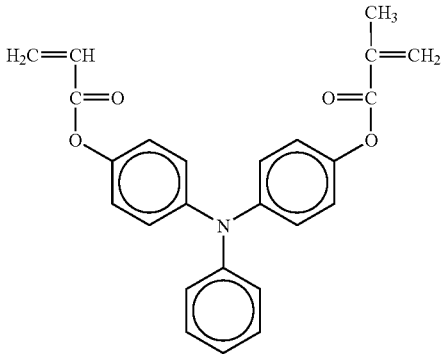
NO. 163
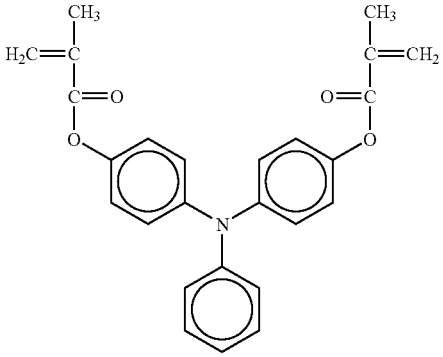
NO. 164
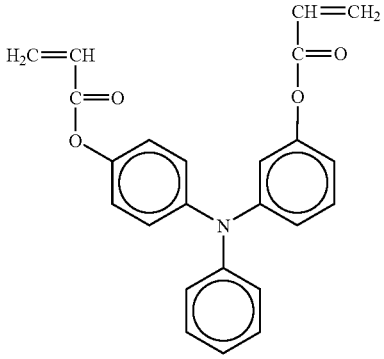
NO. 165
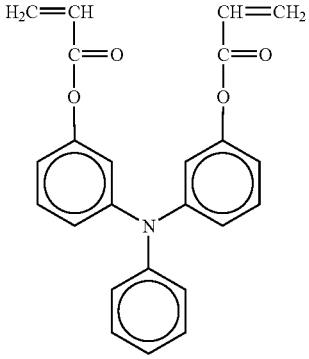
NO. 166
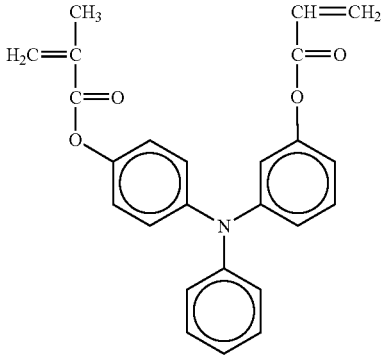
NO. 167
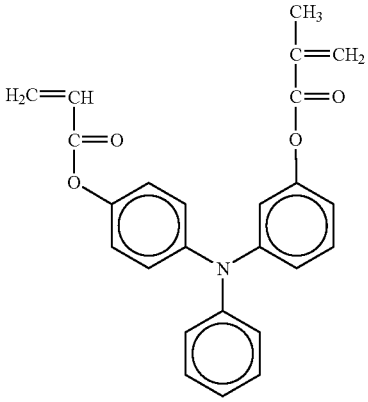
NO. 168
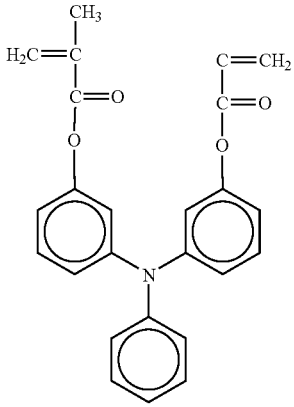

-continued
NO. 169
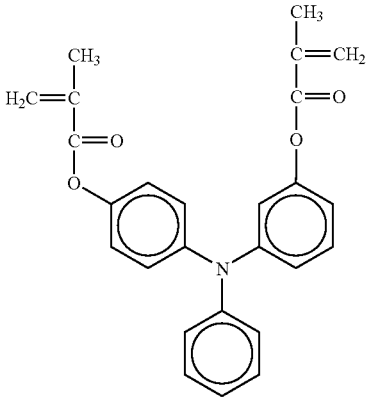
NO. 170
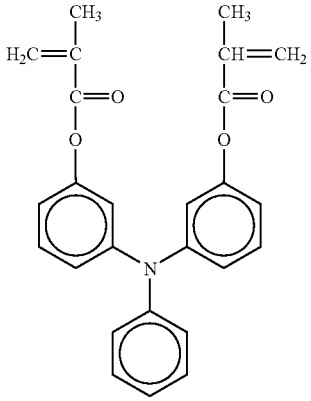
NO. 171
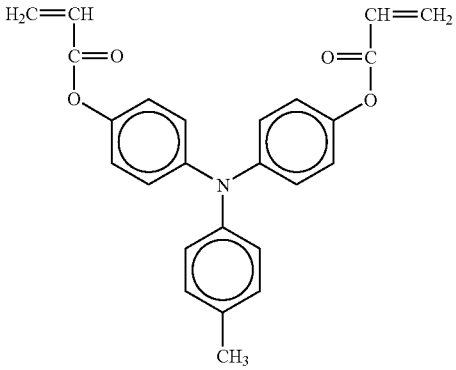
NO. 172
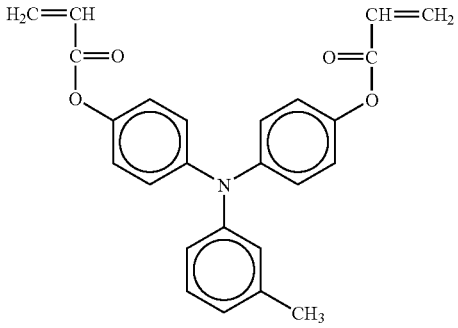
No. 173
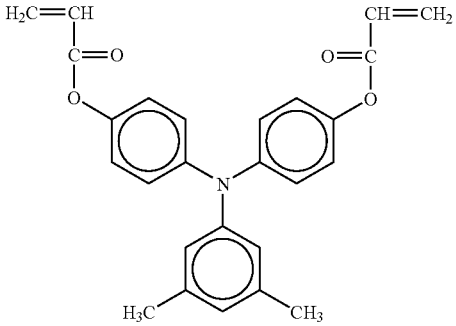
No. 174
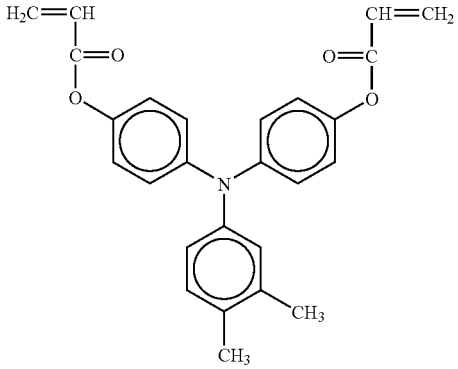
No. 175
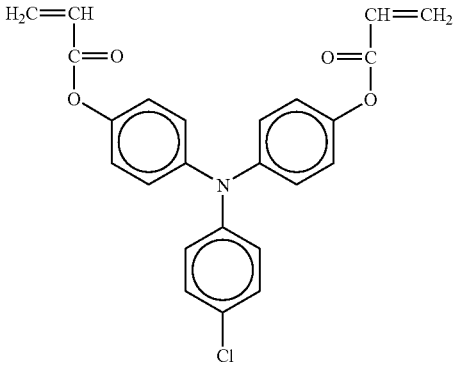
No. 176
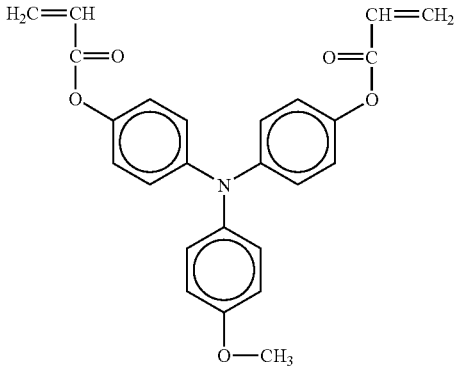

-continued
NO. 177
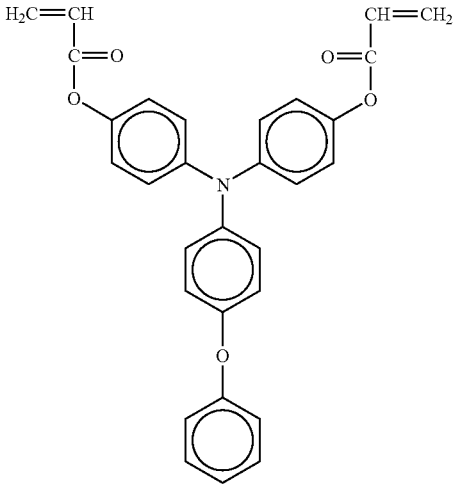
NO. 178
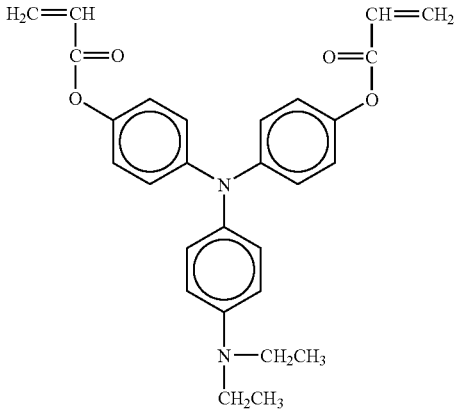
No. 179
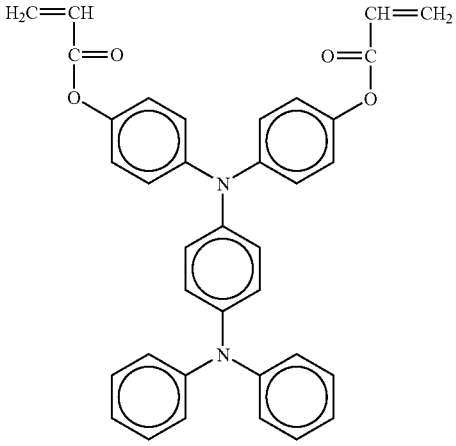
No. 180
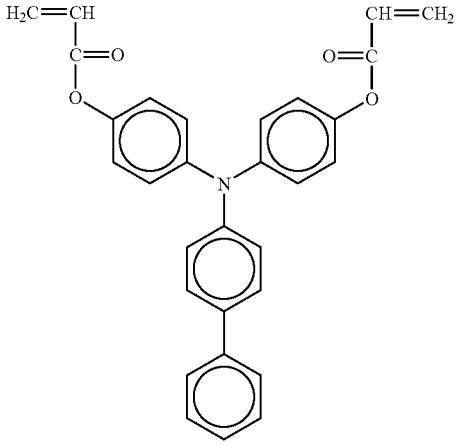
No. 181
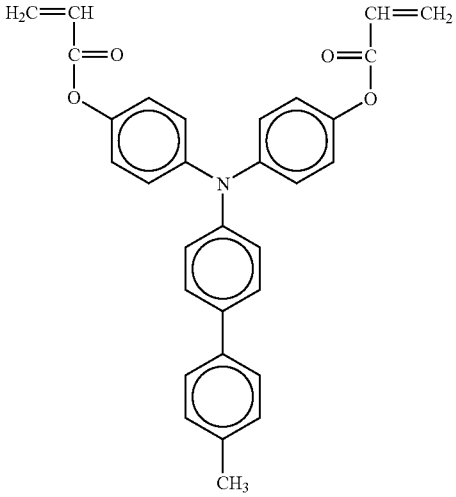
No. 182
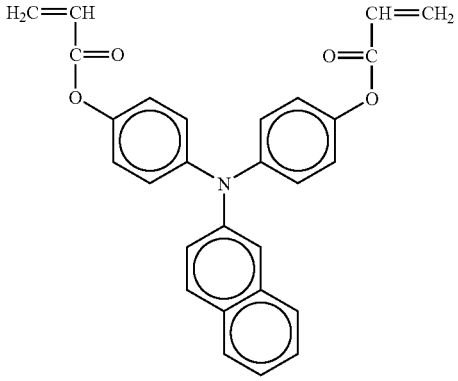

-continued
NO. 183
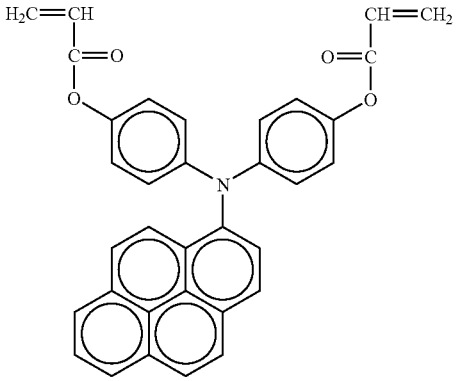
NO. 184
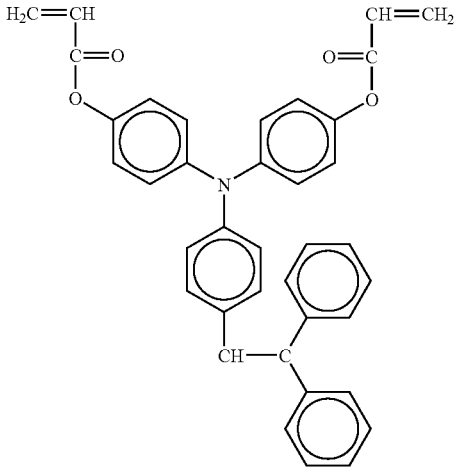
No. 185
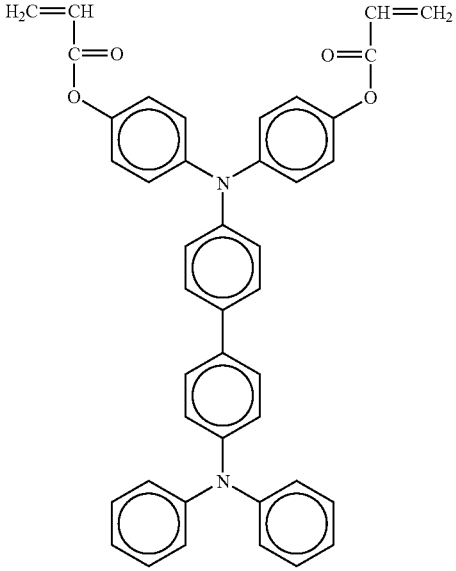
No. 186
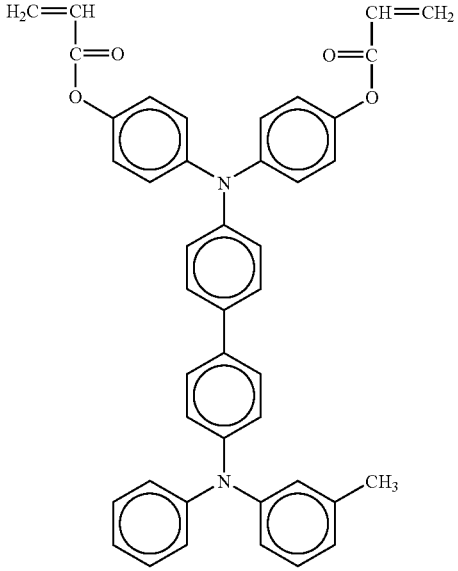
NO. 187
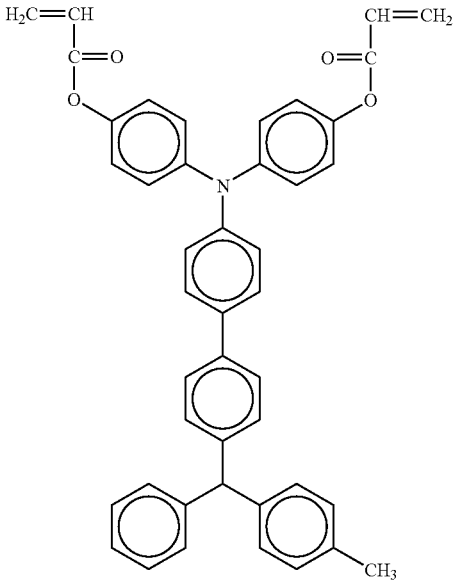
NO. 188
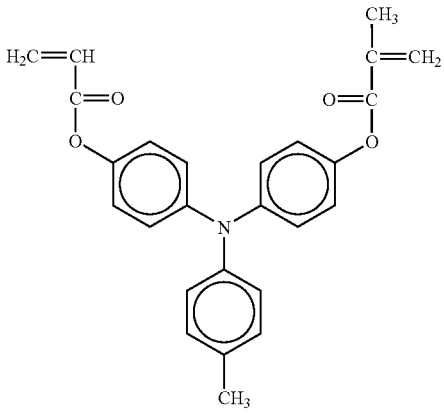

-continued
NO. 189
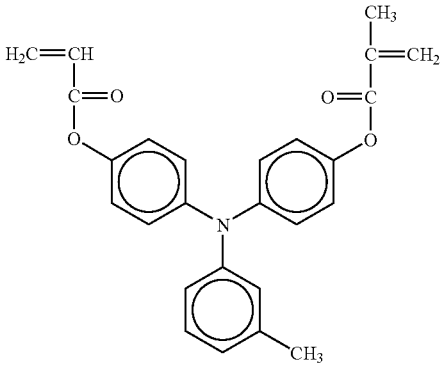
NO. 190
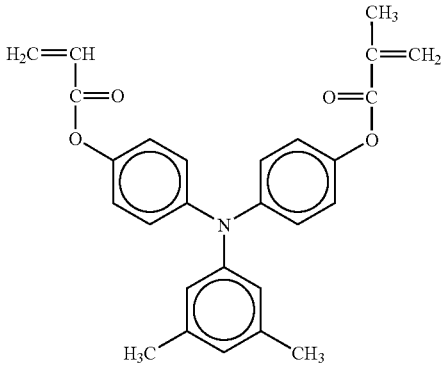
NO. 191
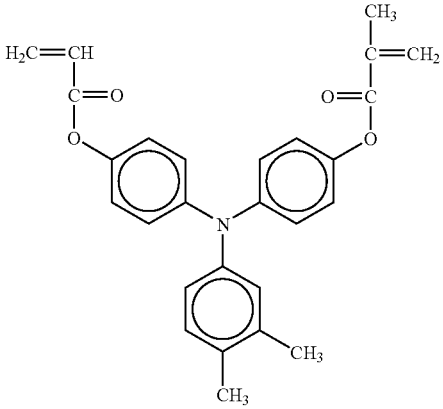
NO. 192
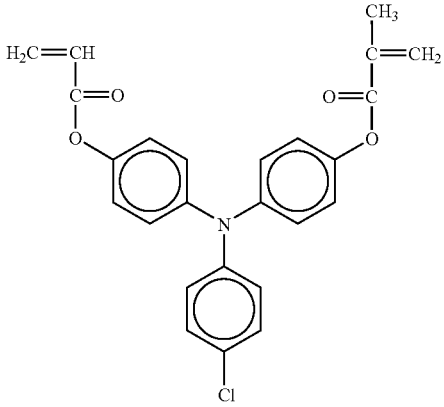
NO. 193
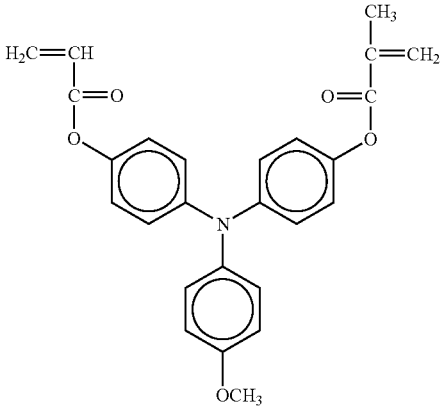
NO. 194
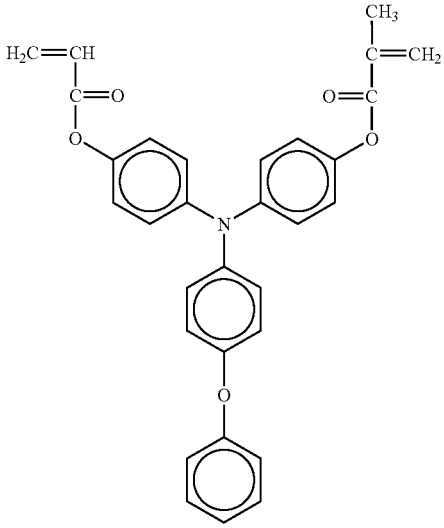

-continued
NO. 195
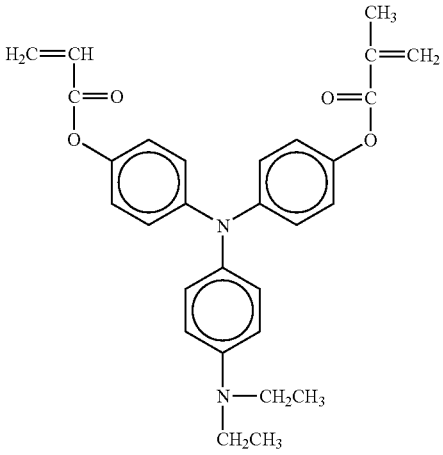
NO. 196
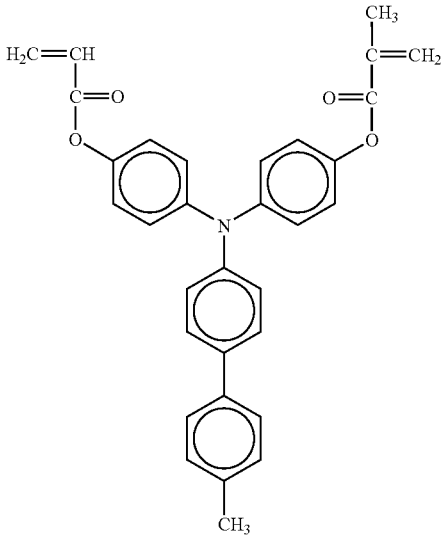
NO. 197
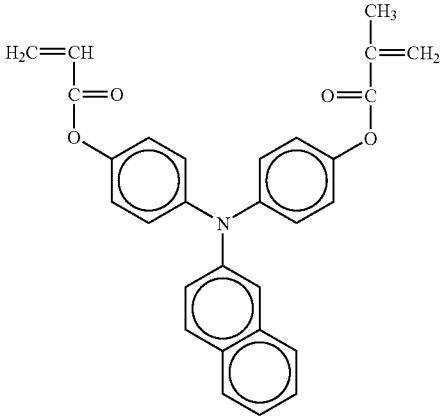
NO. 198
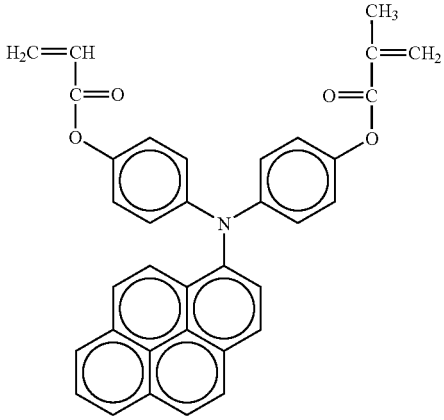
NO. 199
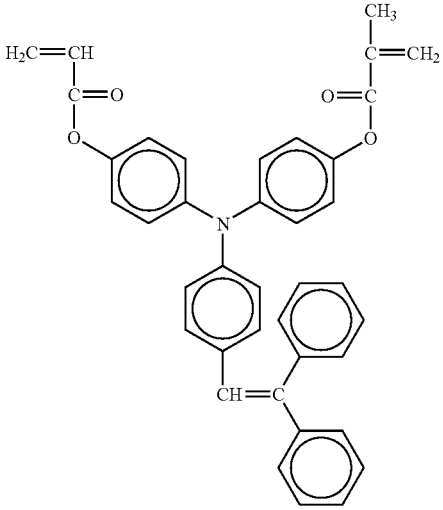
NO. 200
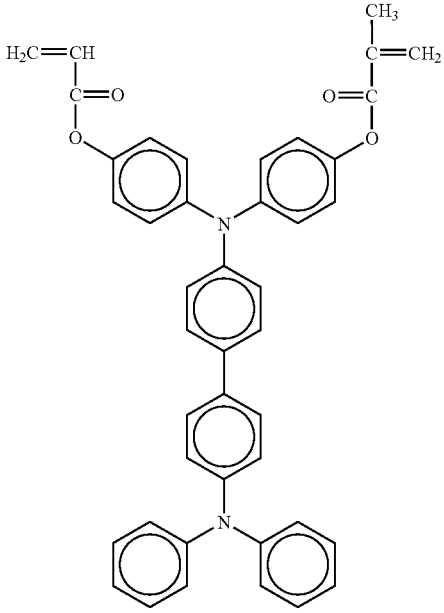

-continued
NO. 201
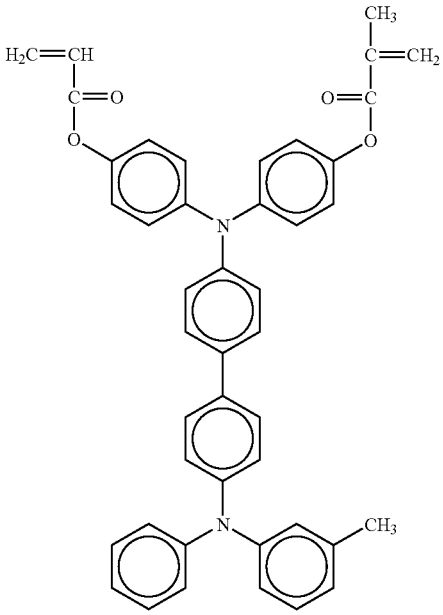
NO. 202
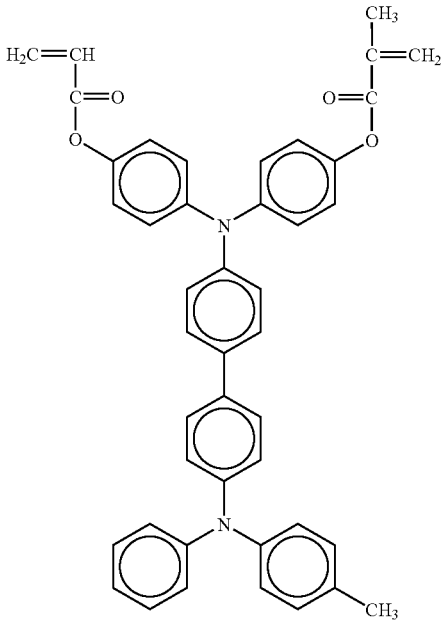
NO. 203
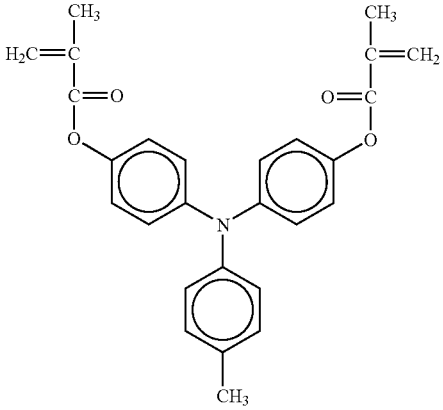
NO. 204
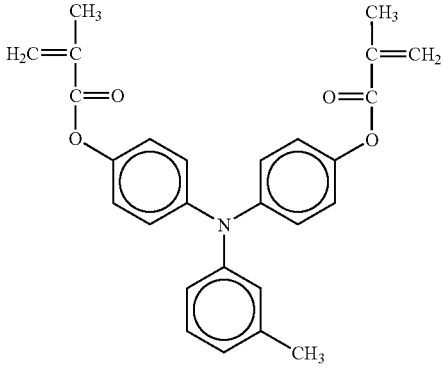
NO. 205
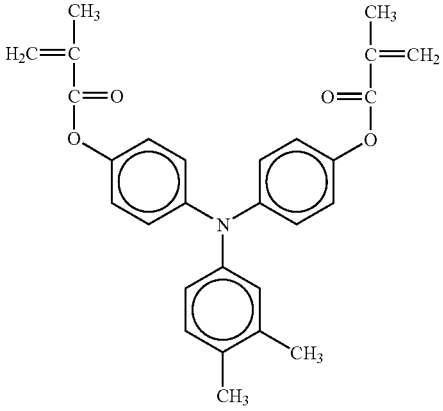
NO. 206
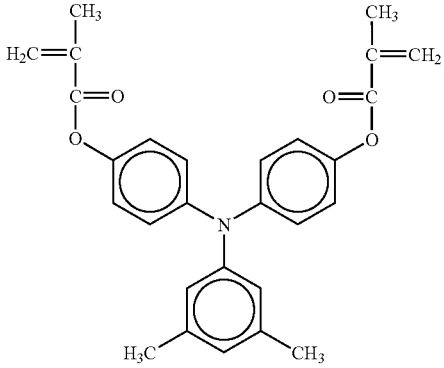

-continued
NO. 207
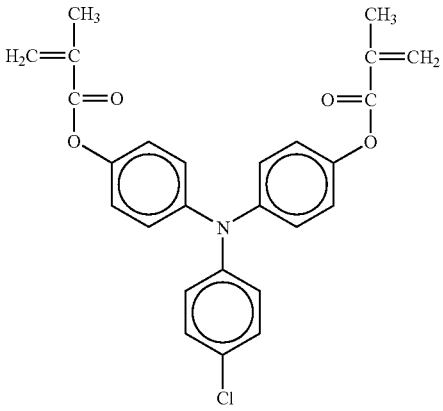
NO. 208
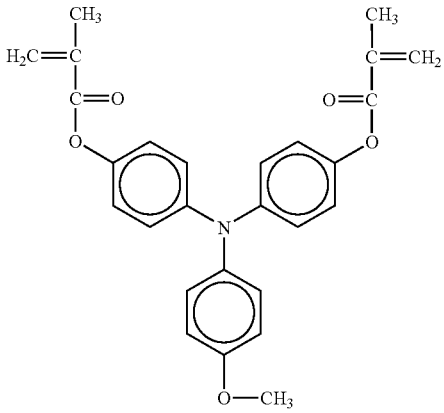
NO. 209
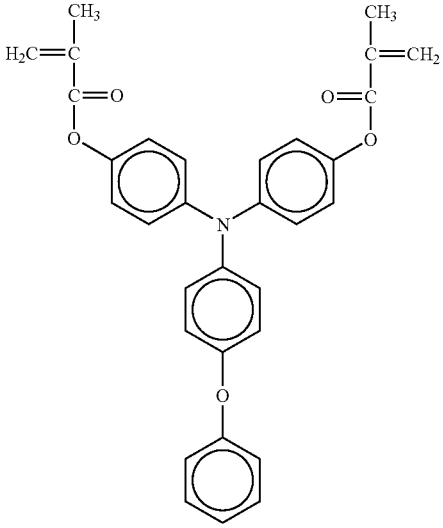
NO. 210
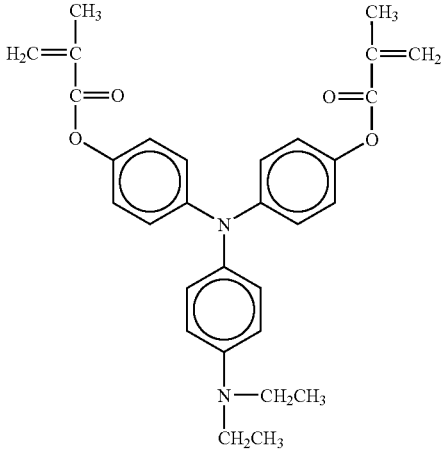
NO. 211
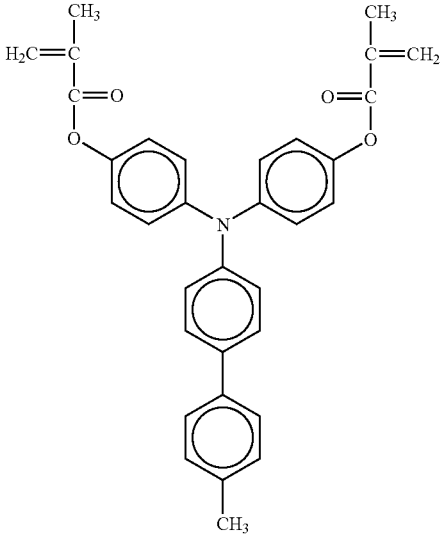
NO. 212
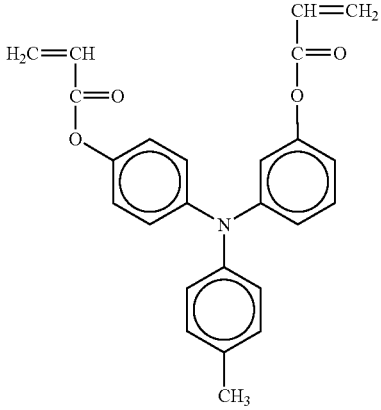

-continued
NO. 213
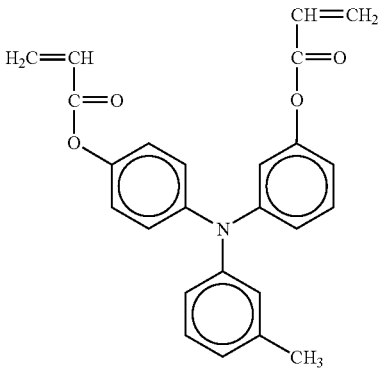
NO. 214
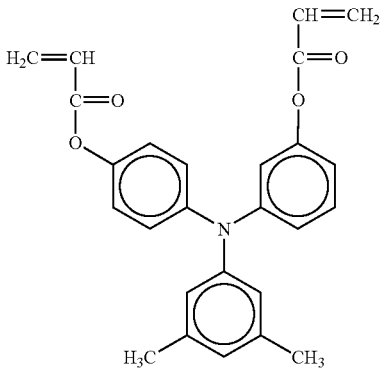
NO. 215
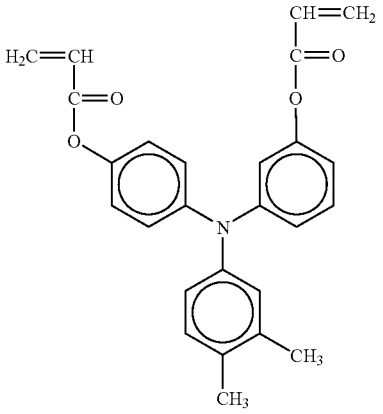
NO. 216
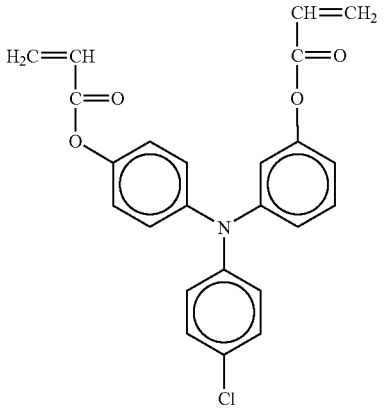
NO. 217
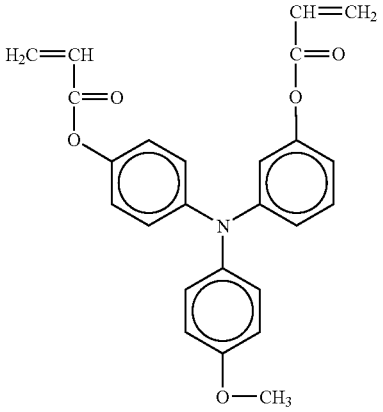
NO. 218
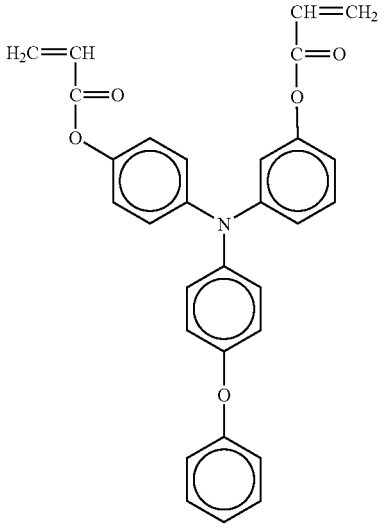

-continued
NO. 219
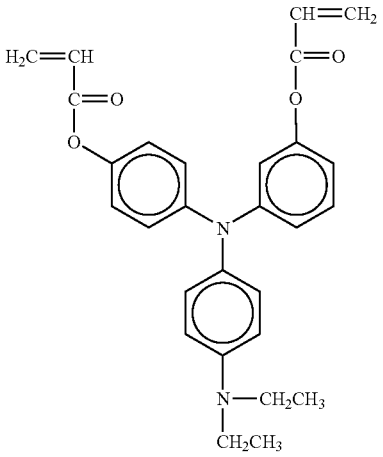
NO. 220
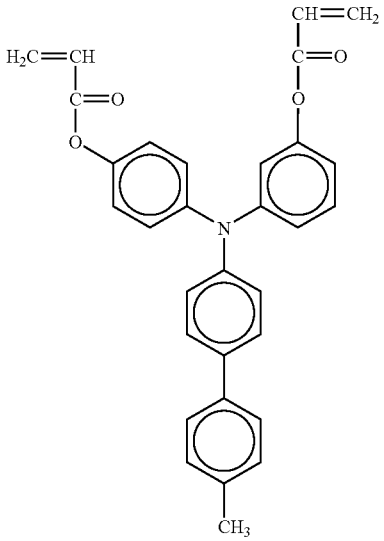
NO. 221
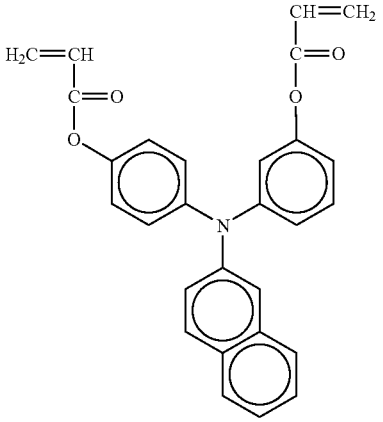
NO. 222
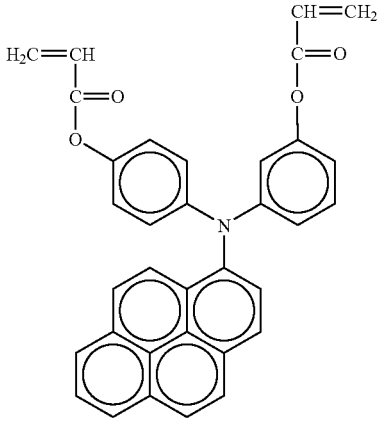
NO. 223
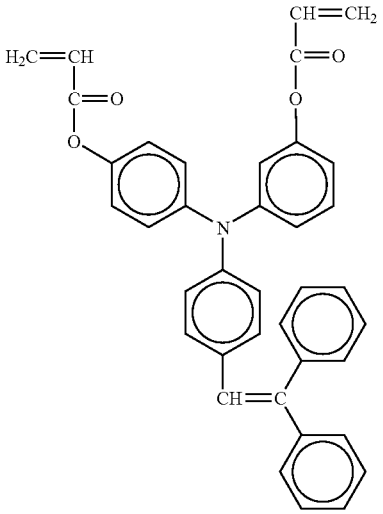
NO. 224
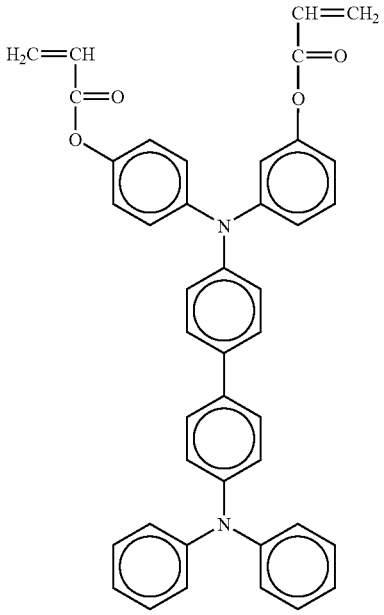

-continued
NO. 225
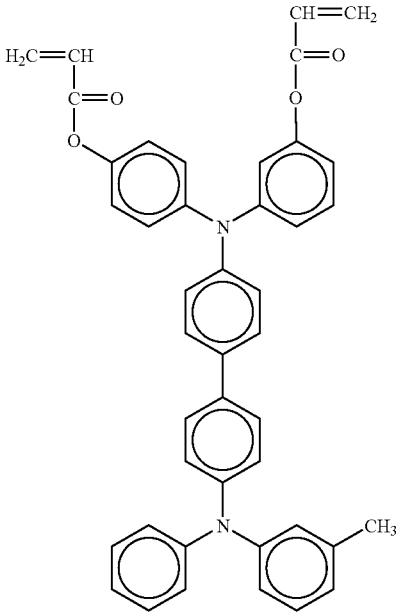
NO. 226
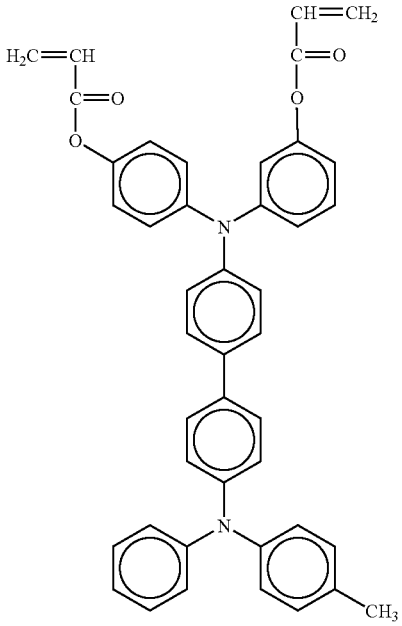
NO. 227
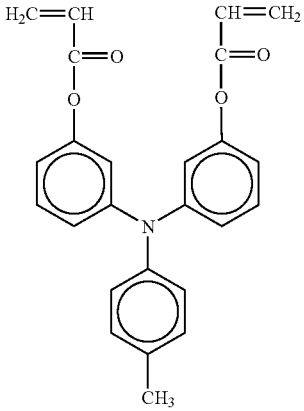
NO. 228
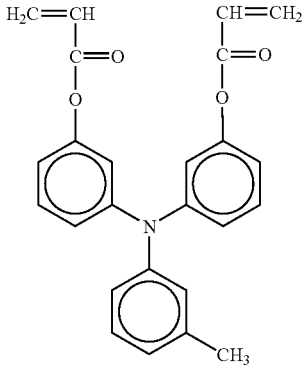
NO. 229
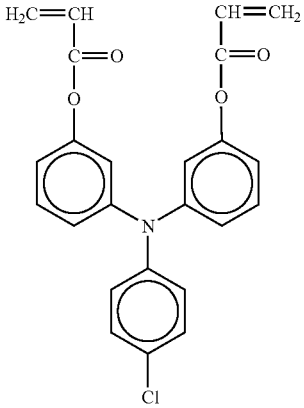
NO. 230
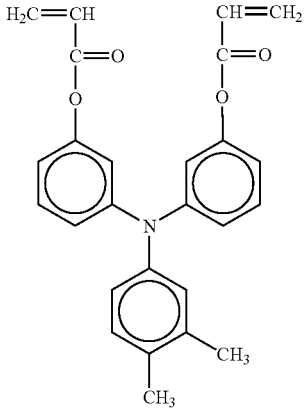

-continued
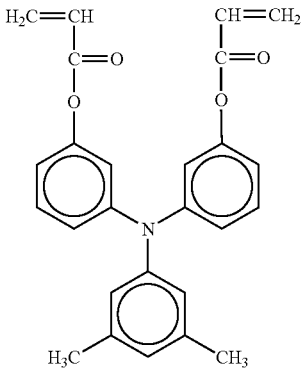
NO. 231
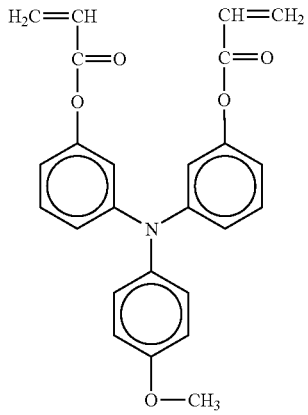
NO. 232
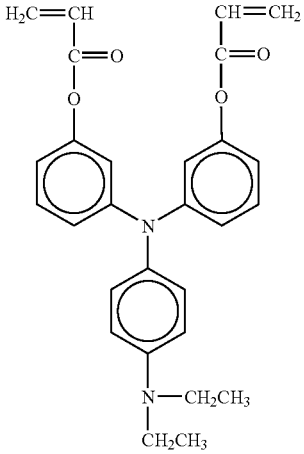
NO. 233
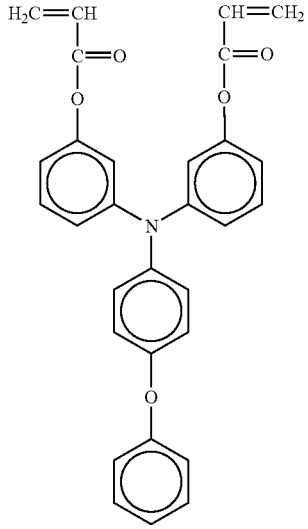
NO. 234
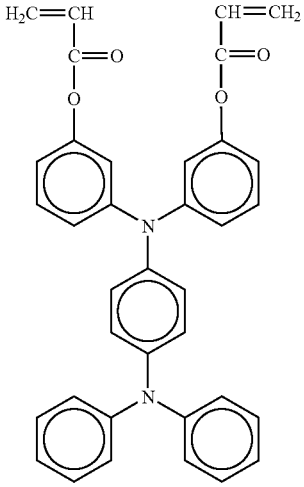
NO. 235
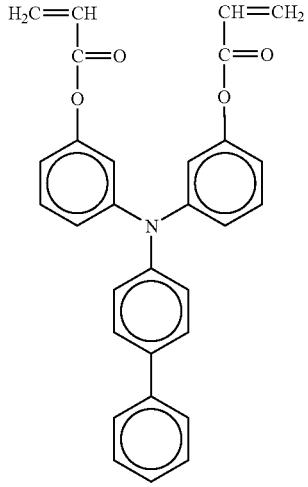
NO. 236

-continued
NO. 237
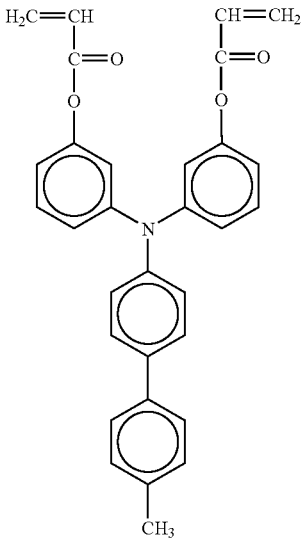
NO. 238
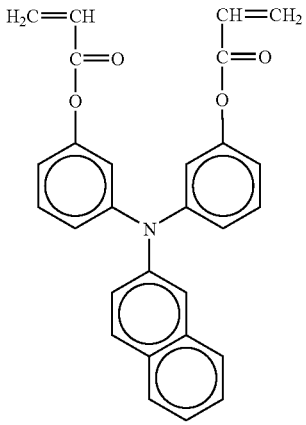
NO. 239
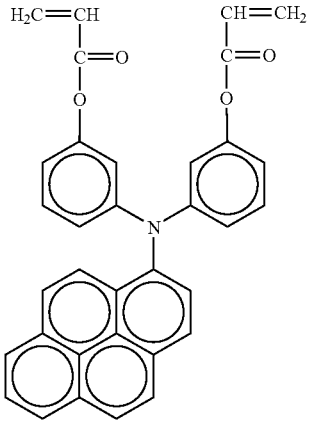
NO. 240
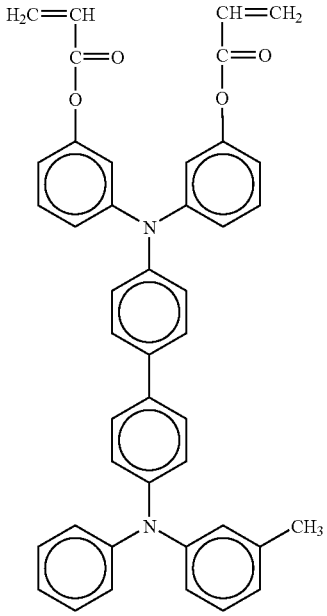

-continued
NO. 241
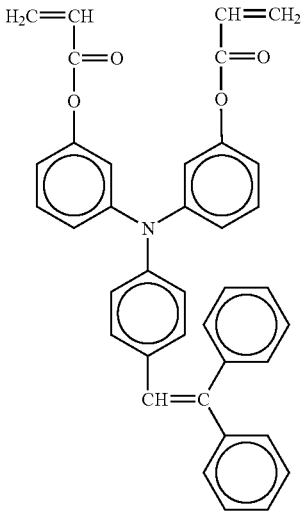
NO. 242
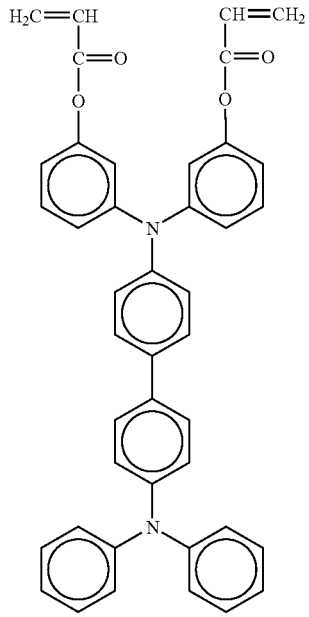
NO. 243
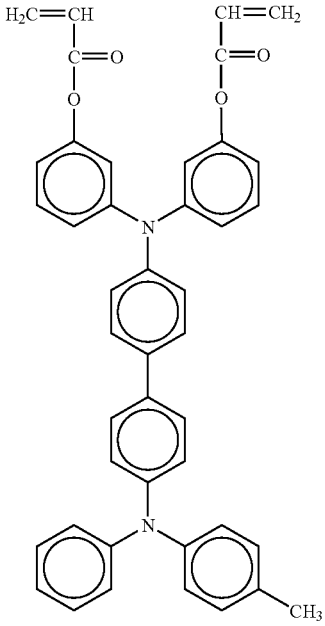
NO. 244
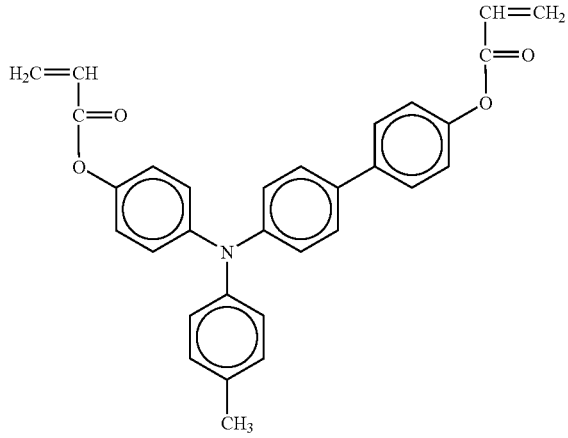

-continued
NO. 245
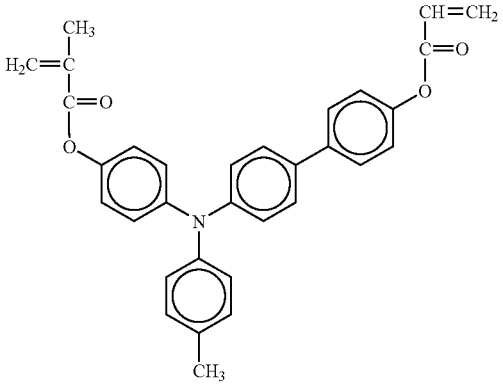
NO. 246
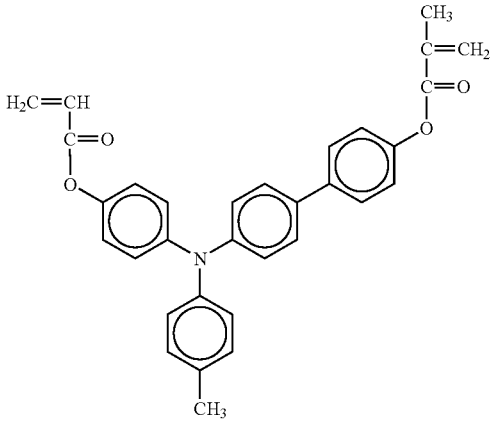
NO. 247
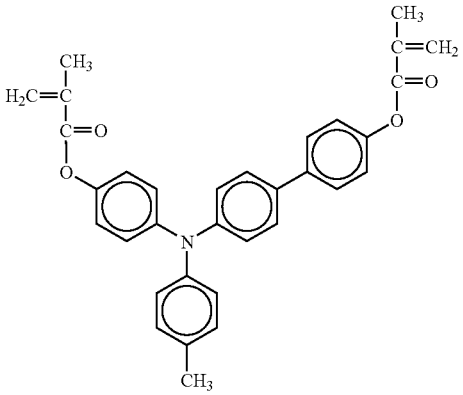
NO. 248
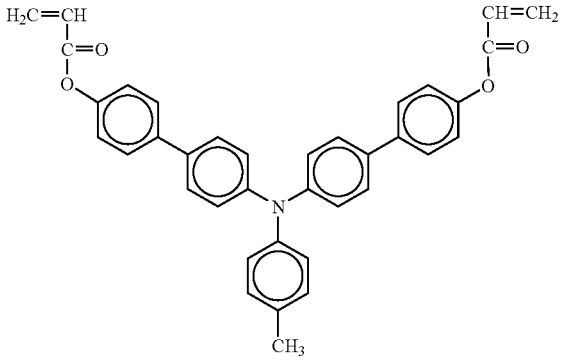
NO. 249
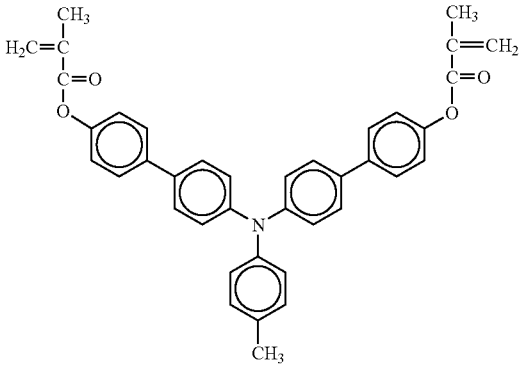
NO. 250
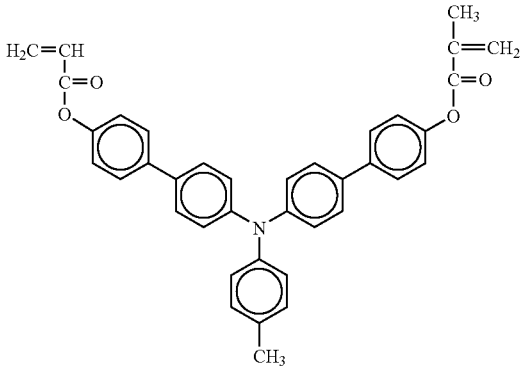

-continued
NO. 251
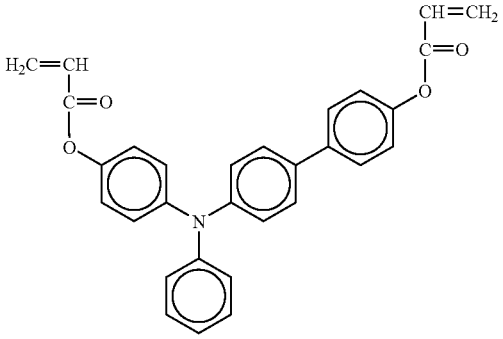
NO. 252
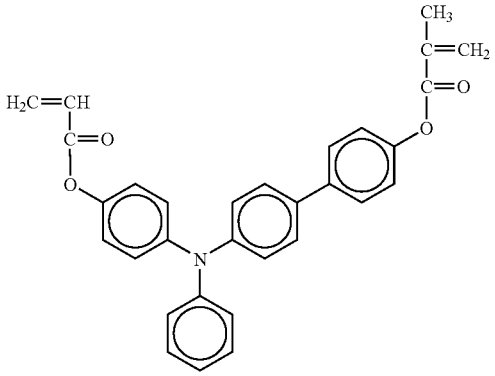
NO. 253
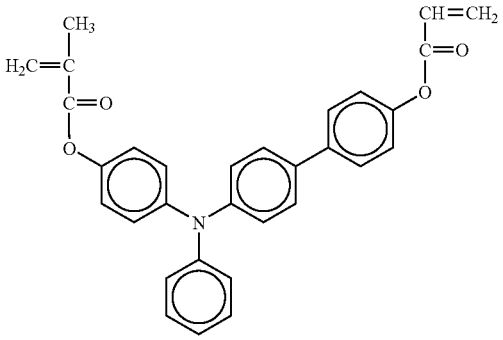
NO. 254
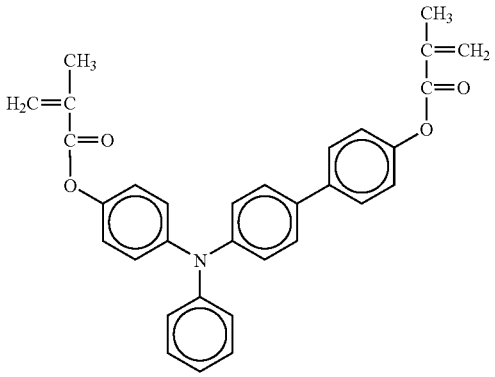
NO. 255
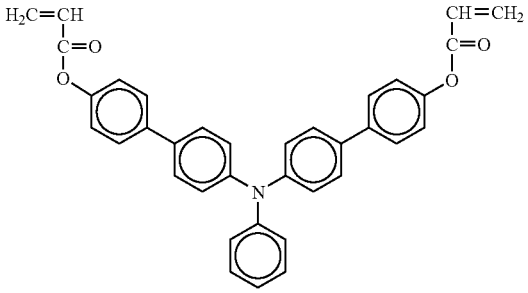
NO. 256
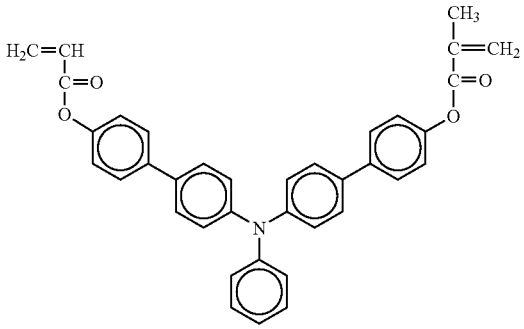
NO. 257
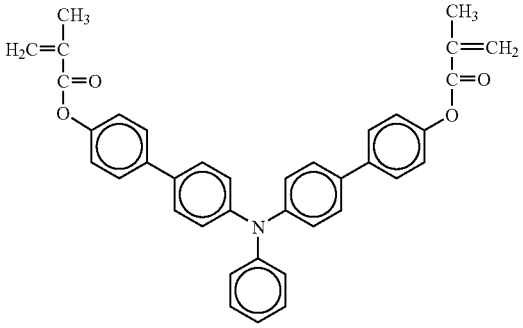
NO. 258
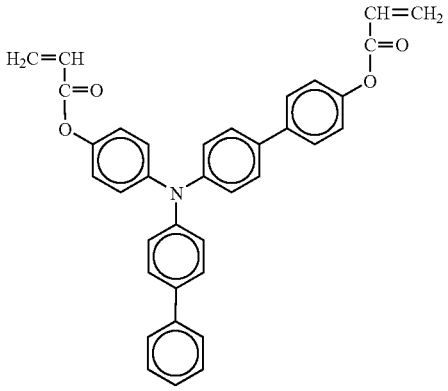

-continued
NO. 259
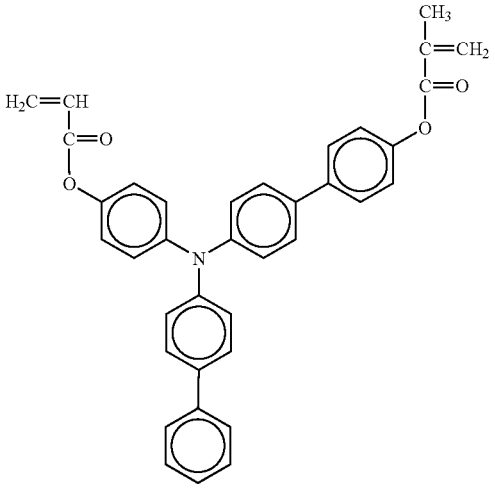
NO. 260
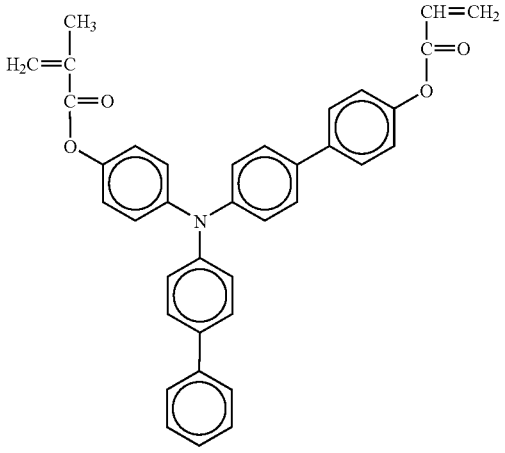
NO. 261
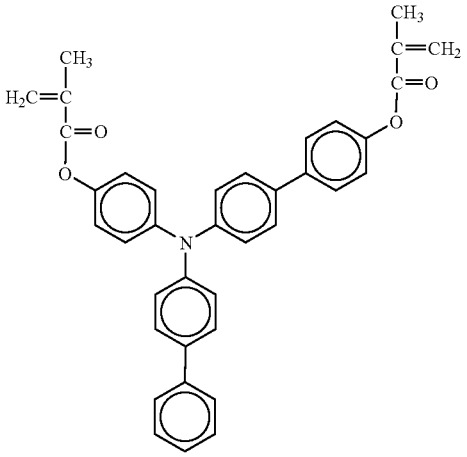
NO. 262
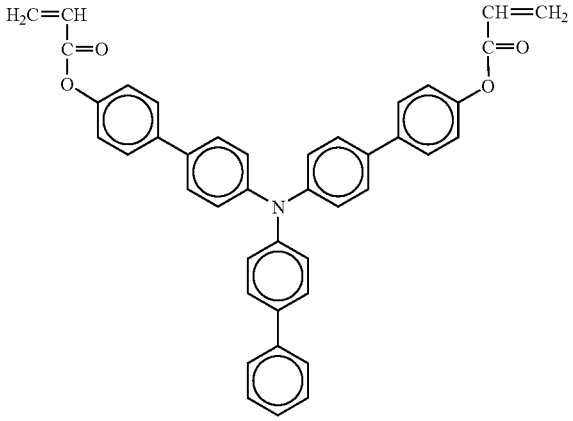
NO. 263
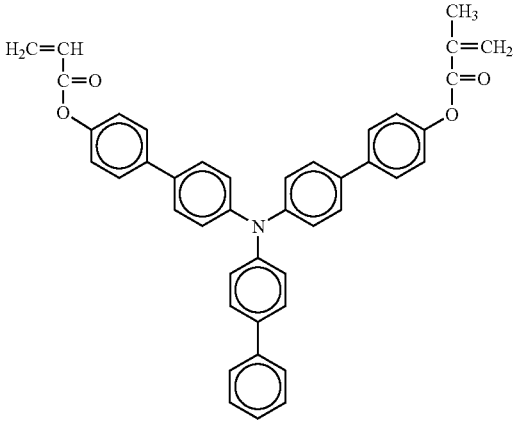
NO. 265
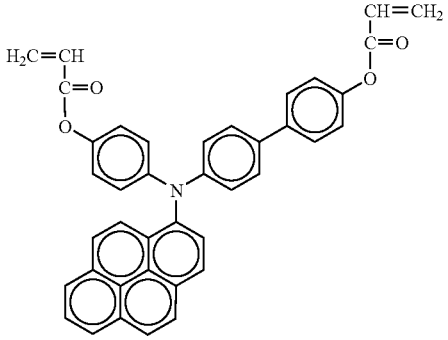

-continued
NO. 266
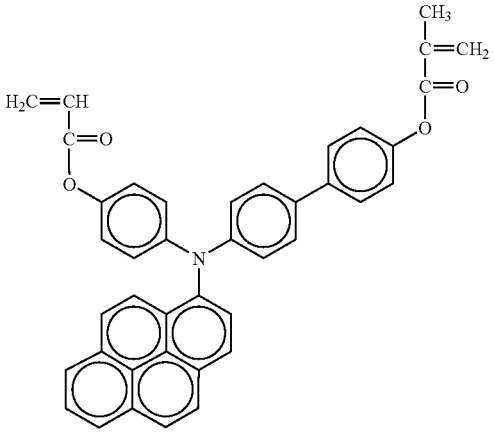
NO. 267
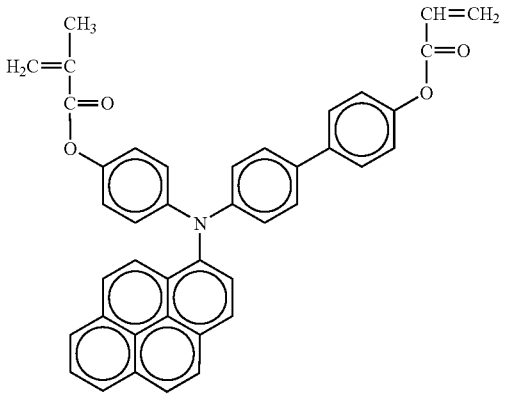
NO. 268
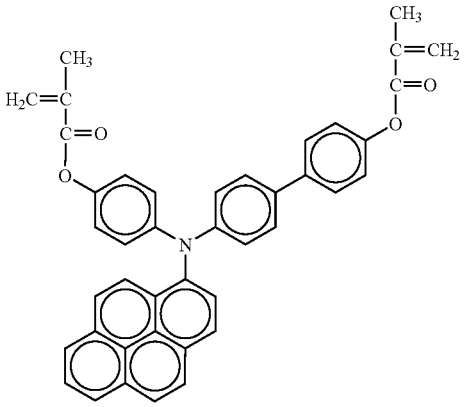
NO. 269
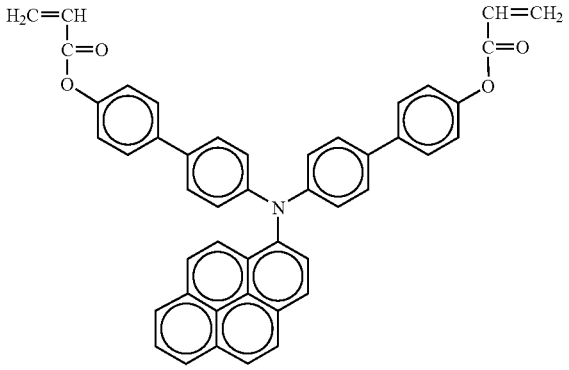
NO. 270
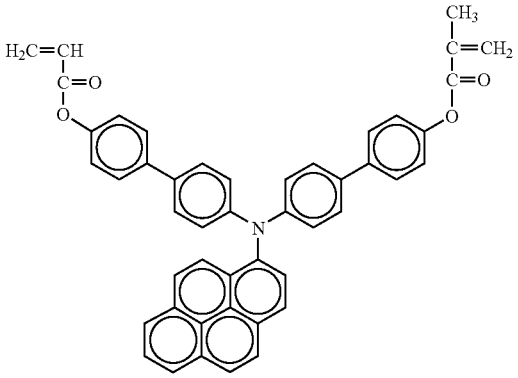
NO. 271
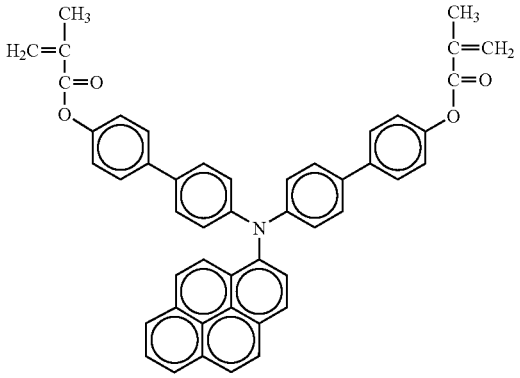

-continued
NO. 272
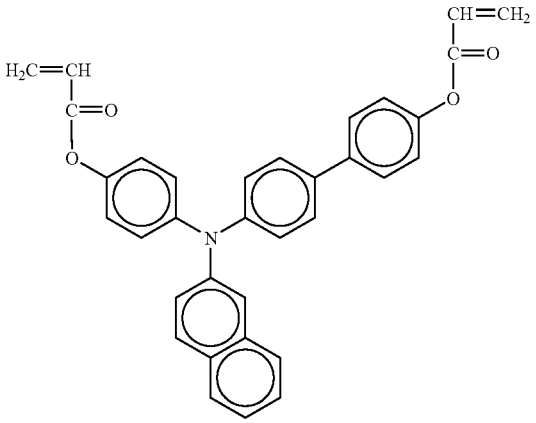
NO. 273
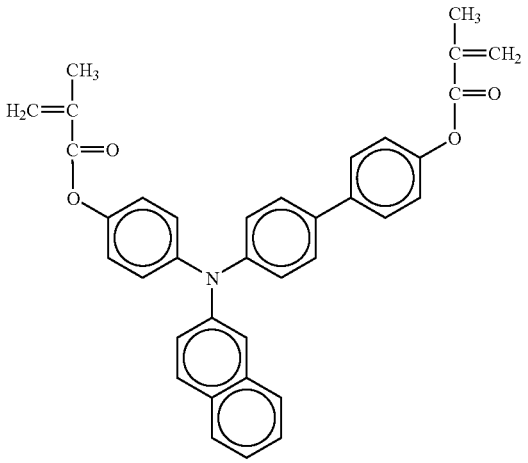
NO. 274
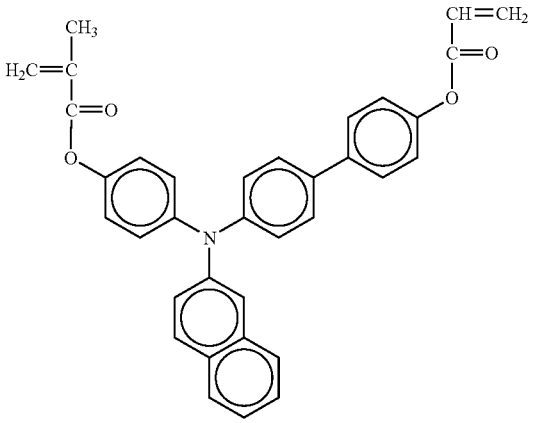
NO. 275
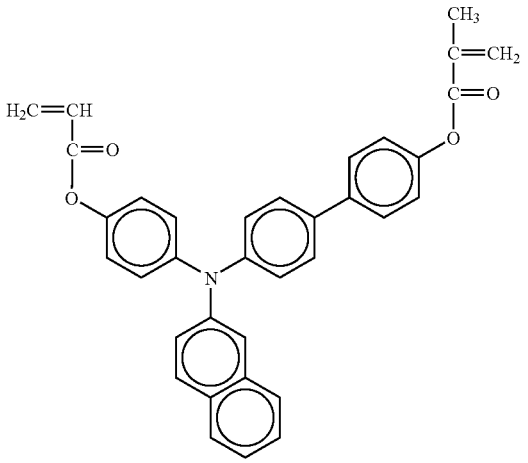
NO. 276
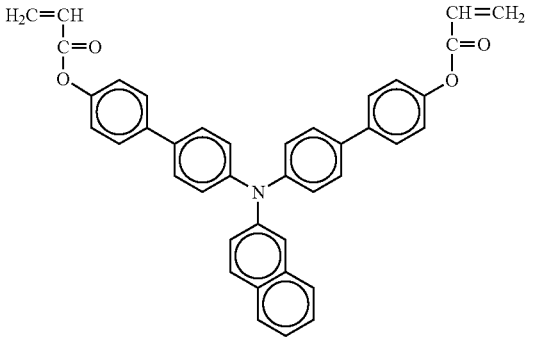
NO. 277
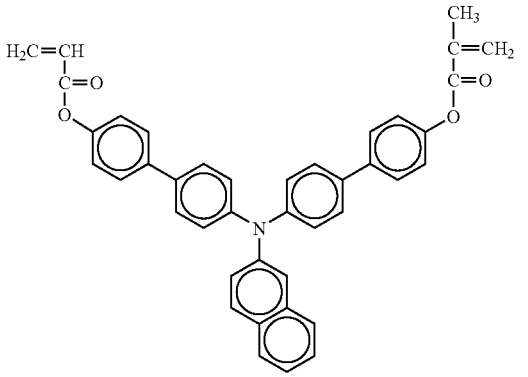

-continued
NO. 278
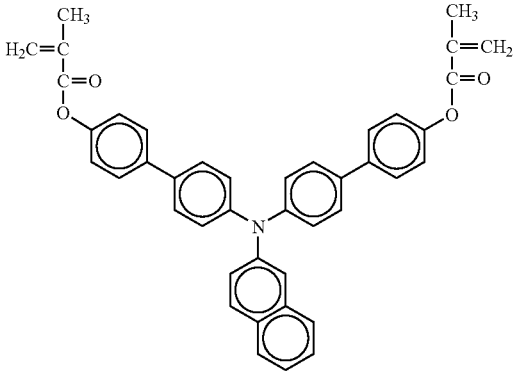
NO. 279
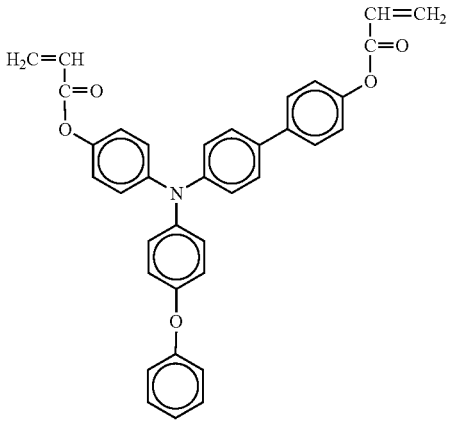
NO. 280
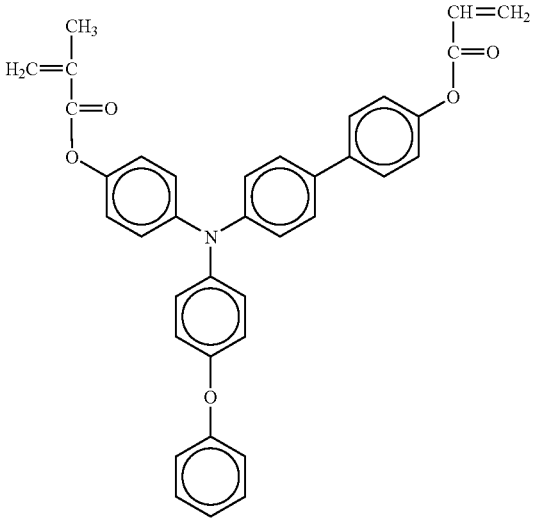
NO. 281
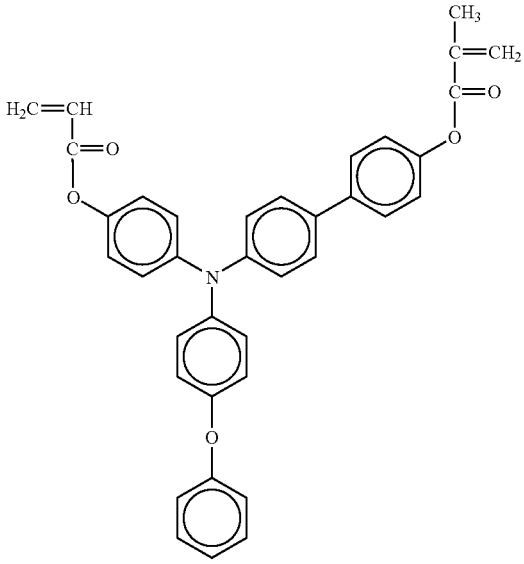
NO. 282
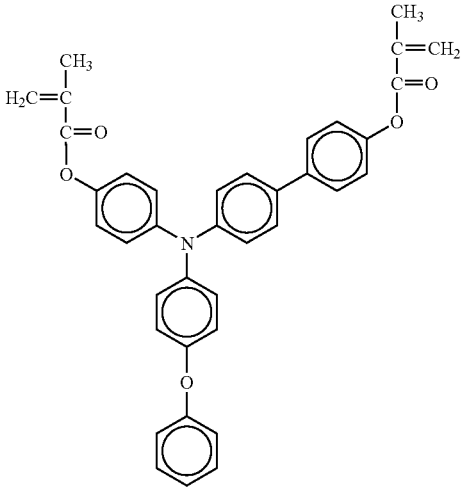
NO. 283
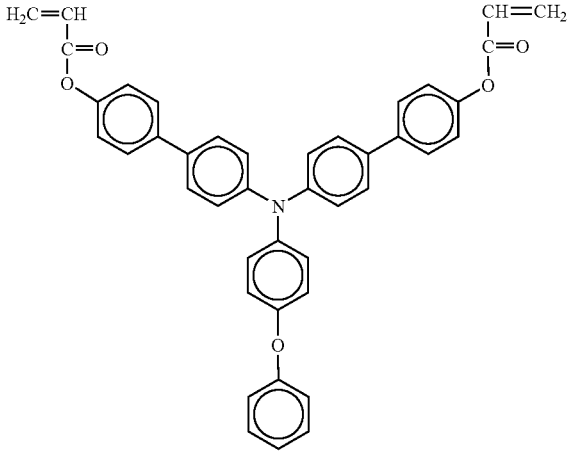

-continued
NO. 284
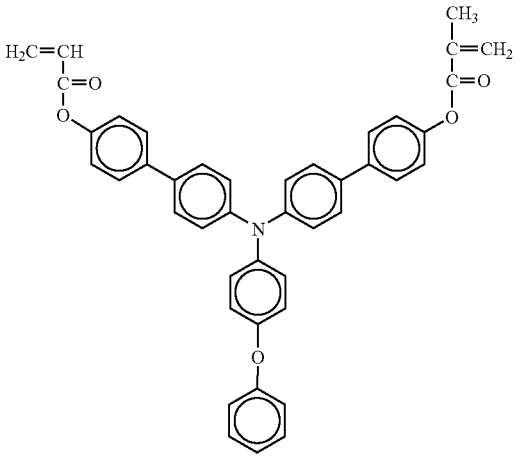
NO. 285
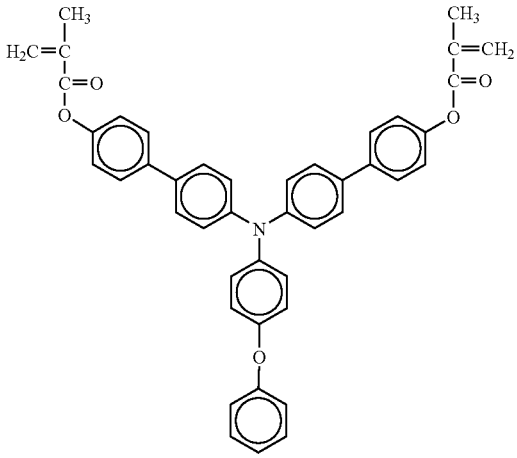
NO. 286
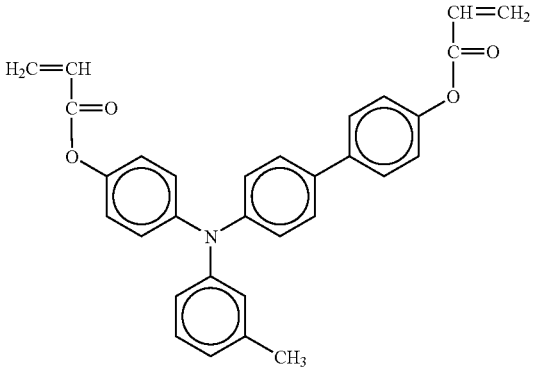
NO. 287
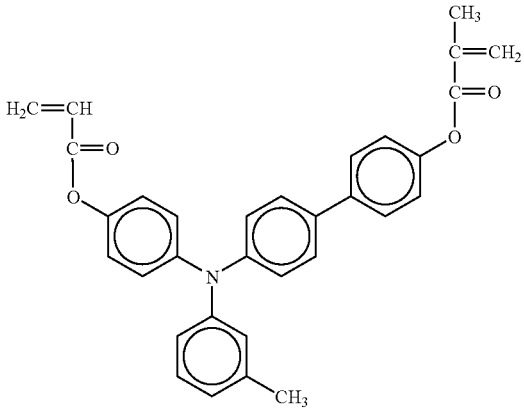
NO. 288
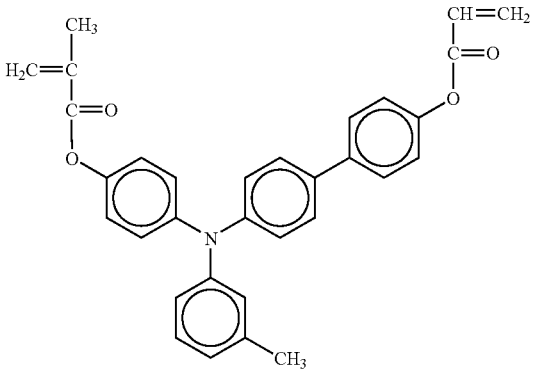
NO. 289
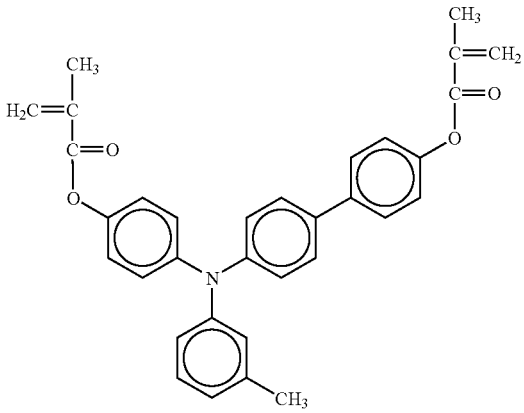

-continued
NO. 290
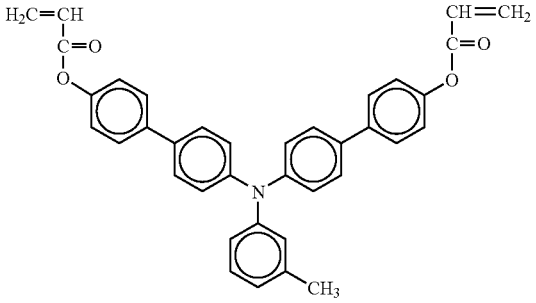
NO. 291
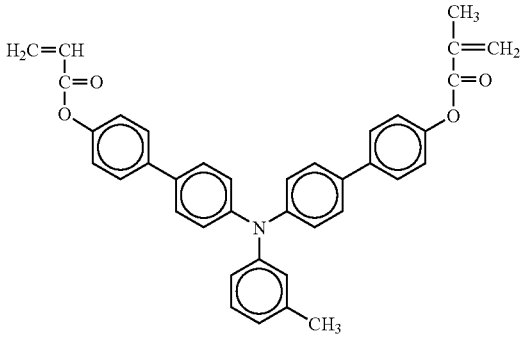
NO. 292
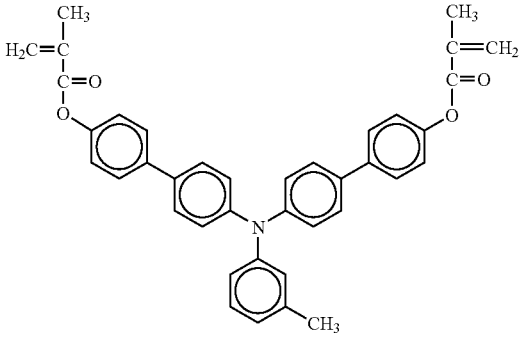
NO. 293
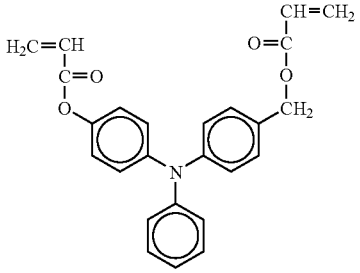
NO. 294
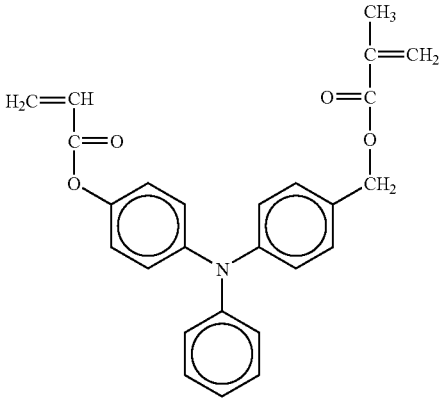
NO. 295
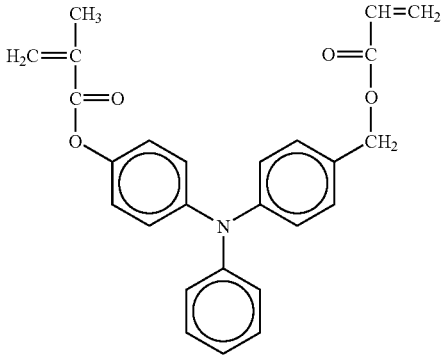
NO. 296
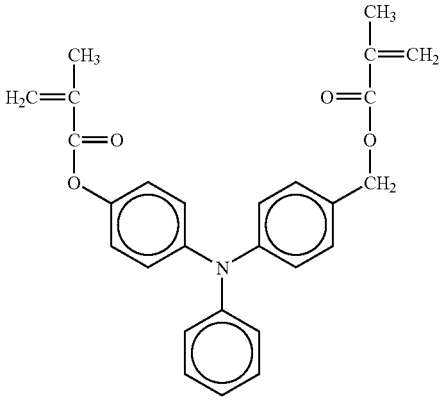
NO. 297
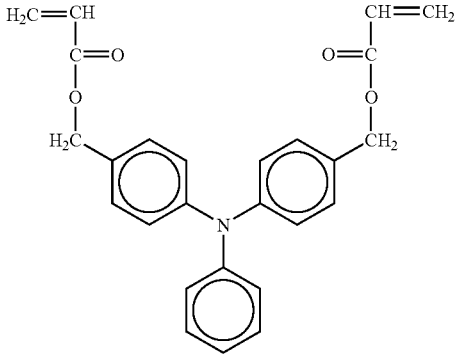

-continued
NO. 298
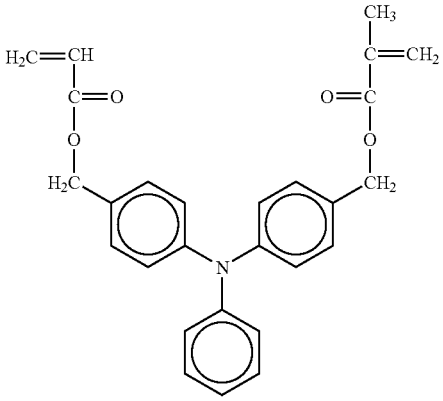
NO. 299
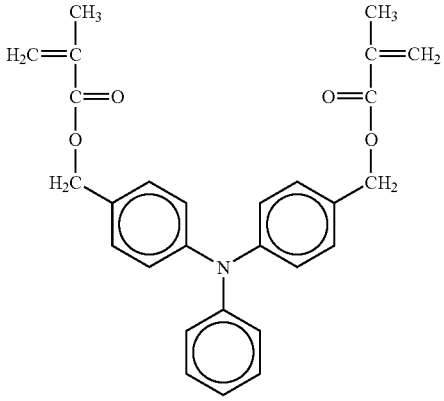
NO. 300
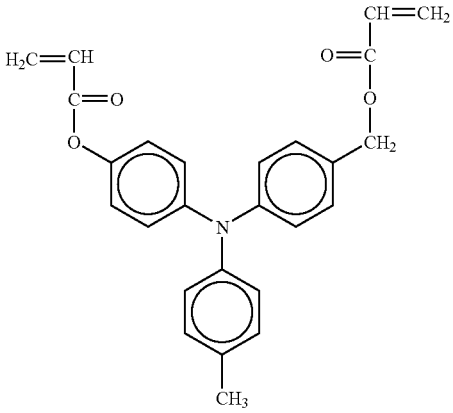
NO. 301
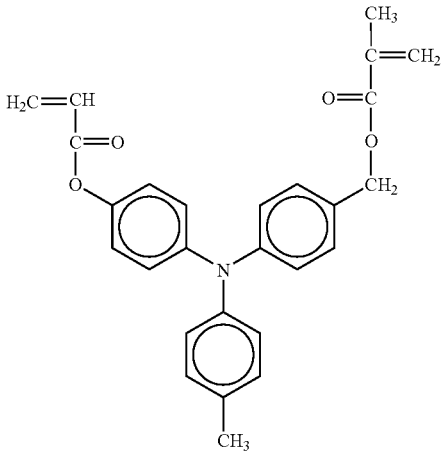
NO. 302
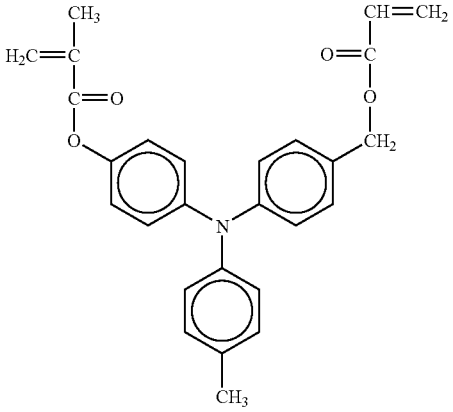
NO. 303
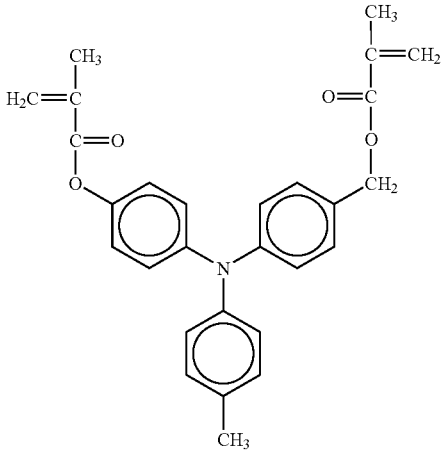

-continued
NO. 304
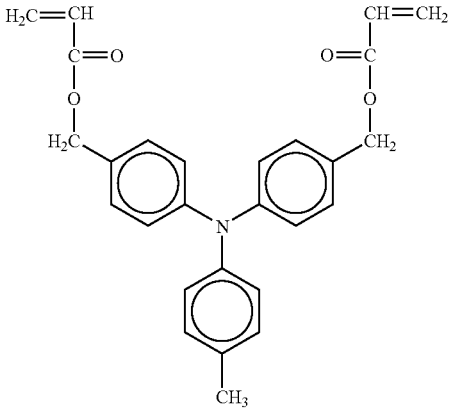
NO. 305
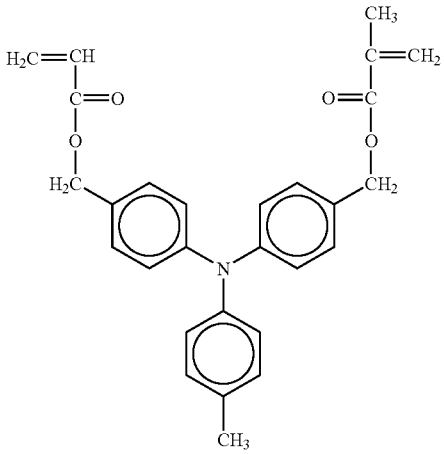
NO. 306
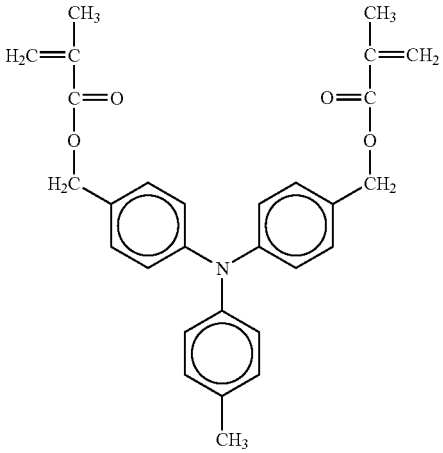
NO. 307
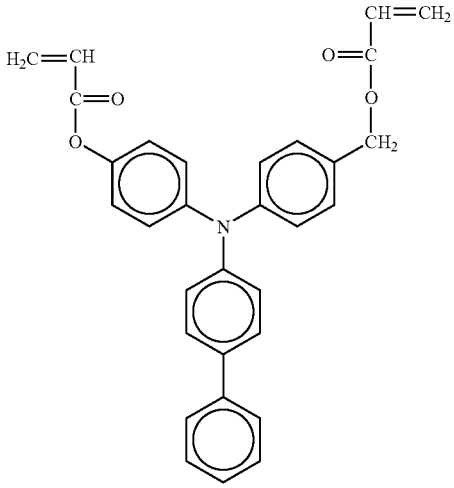
NO. 308
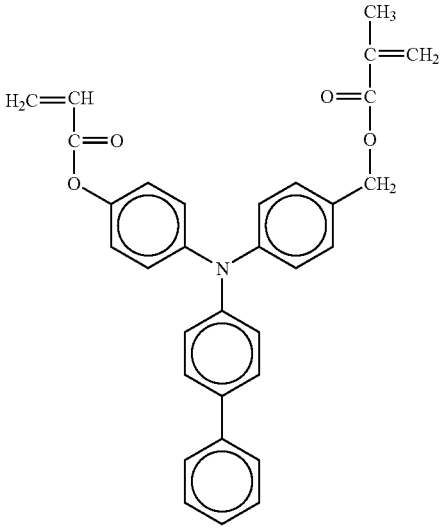
NO. 309
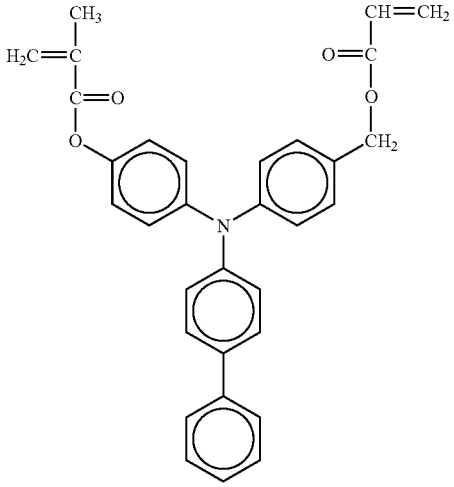

-continued
NO. 310
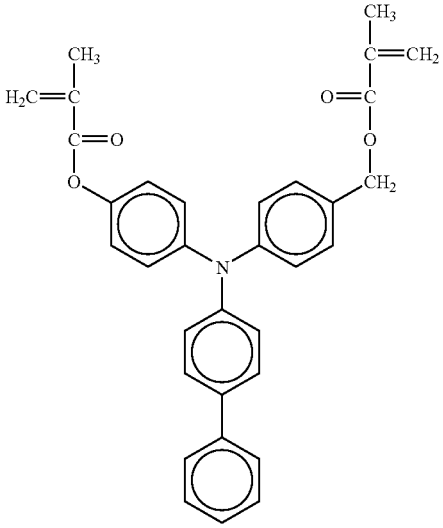
NO. 311
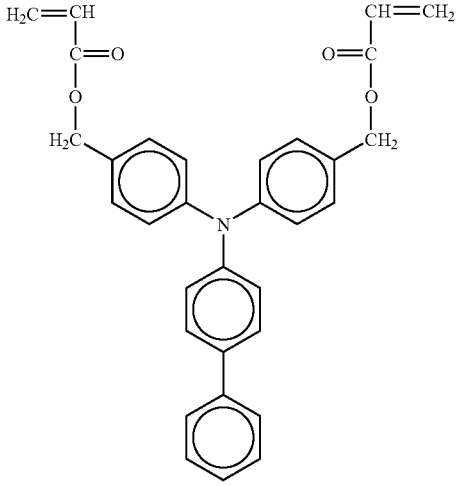
NO. 312
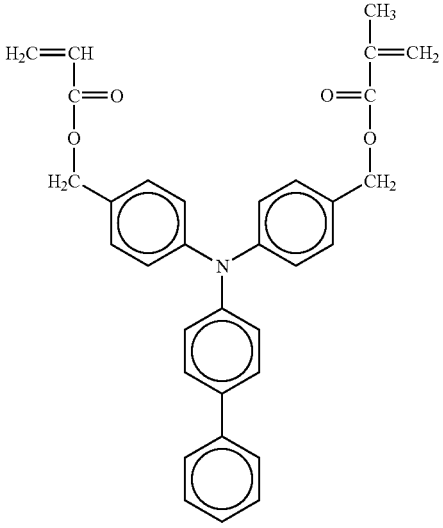
NO. 313
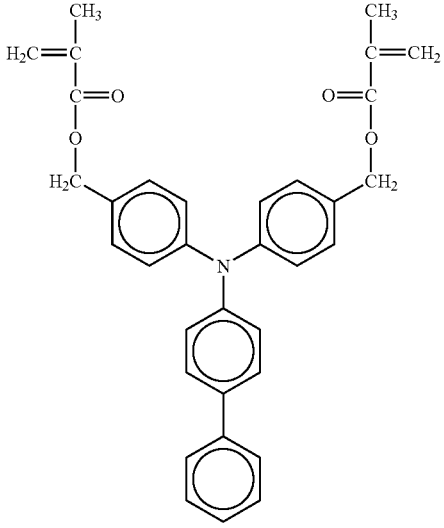
NO. 314
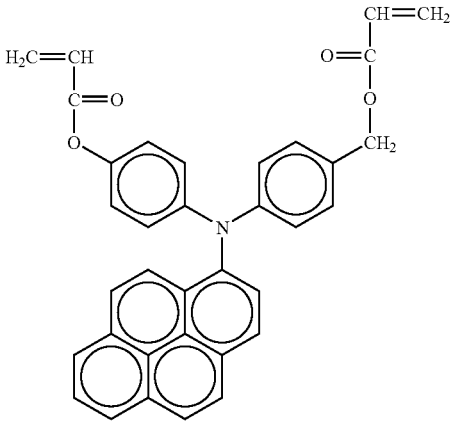
NO. 315
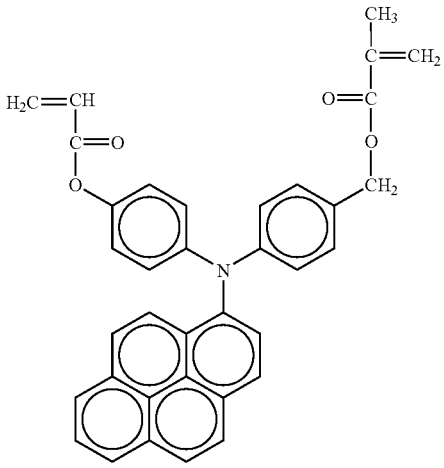

-continued
NO. 316
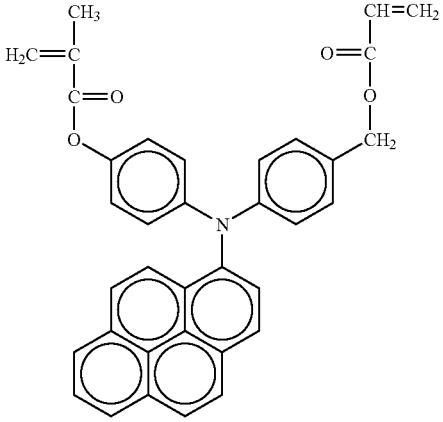
NO. 317
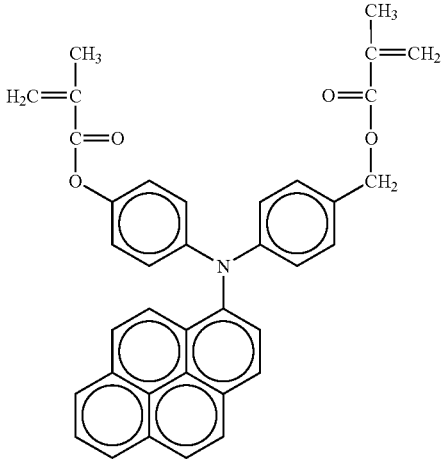
NO. 318
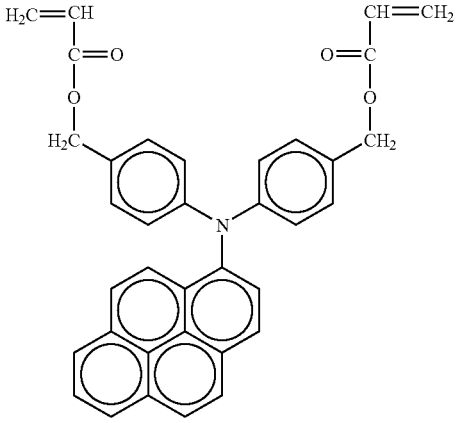
NO. 319
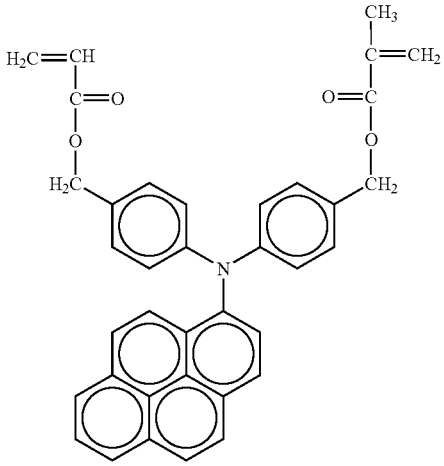
NO. 320
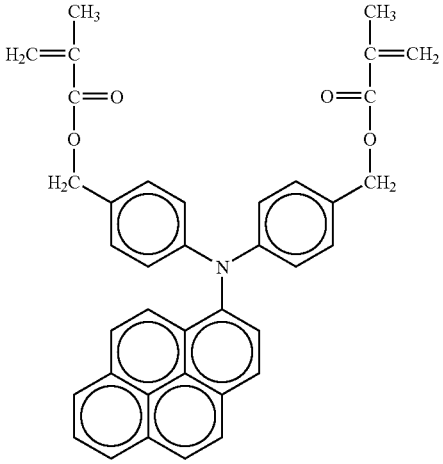
NO. 321
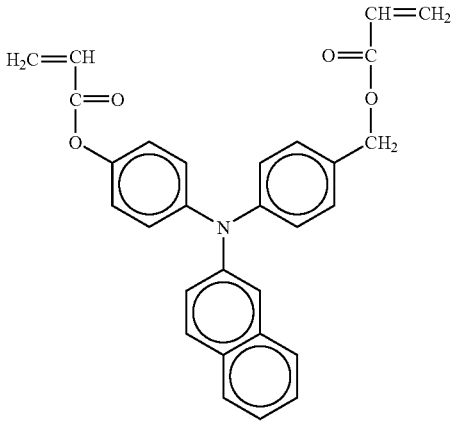

-continued
NO. 322
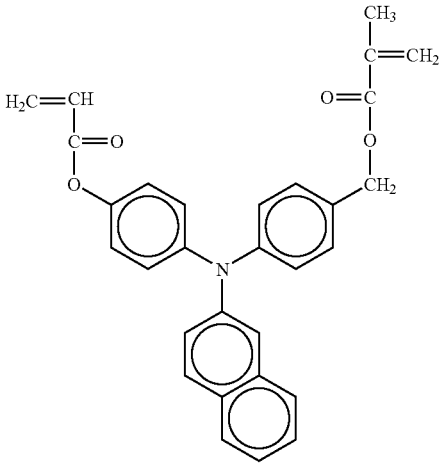
NO. 323
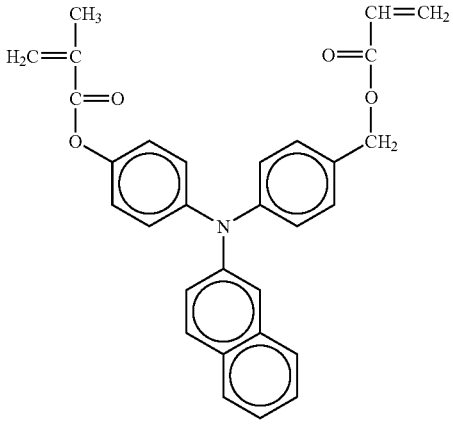
NO. 324
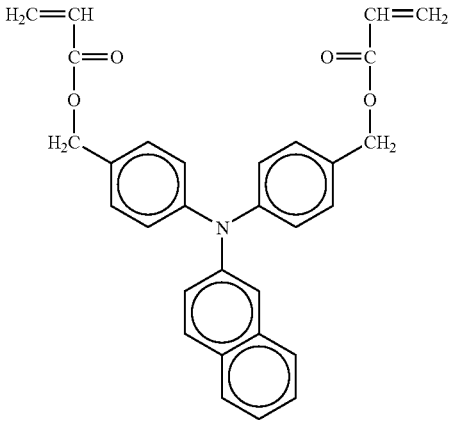
NO. 325
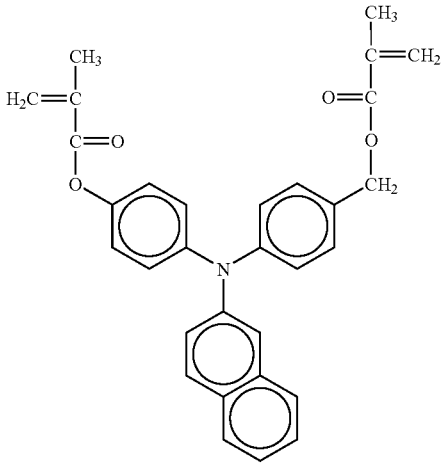
NO. 326
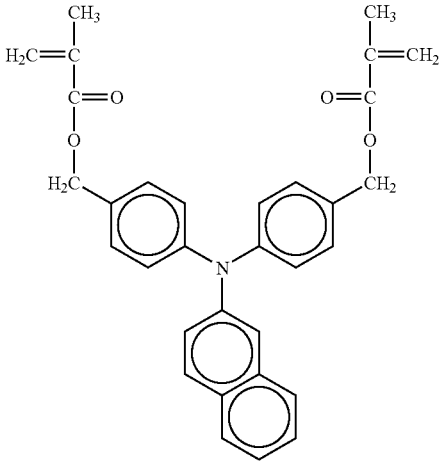
NO. 327
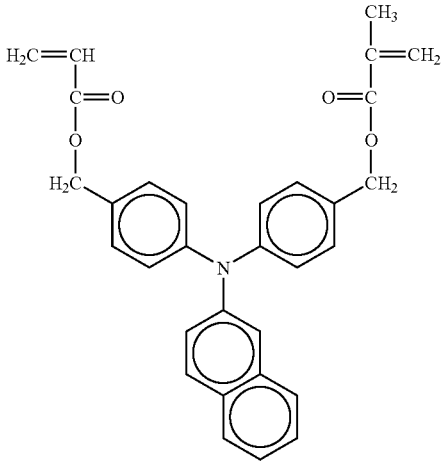

-continued
NO. 328
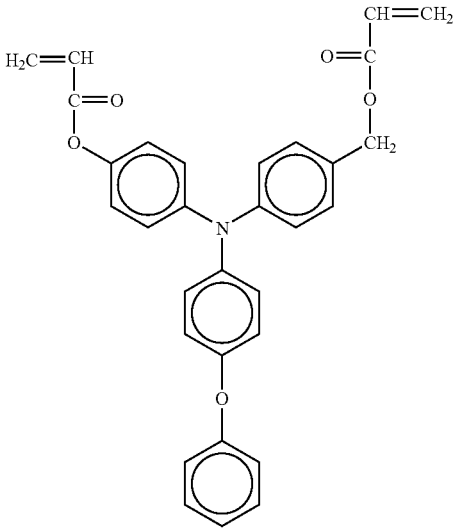
NO. 329
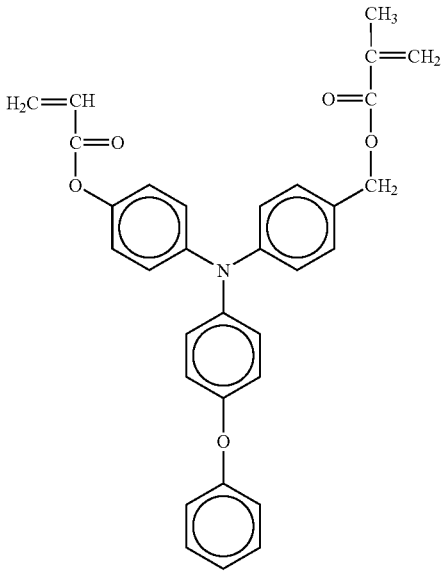
NO. 330
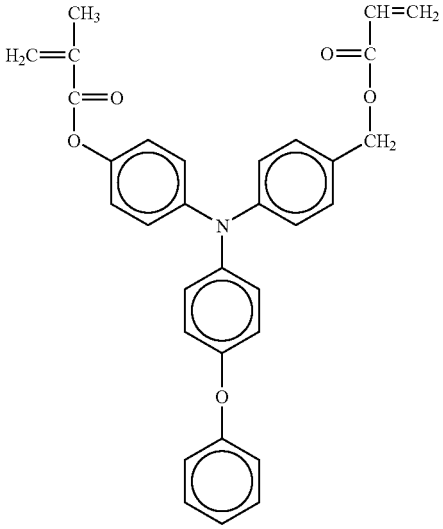
NO. 331
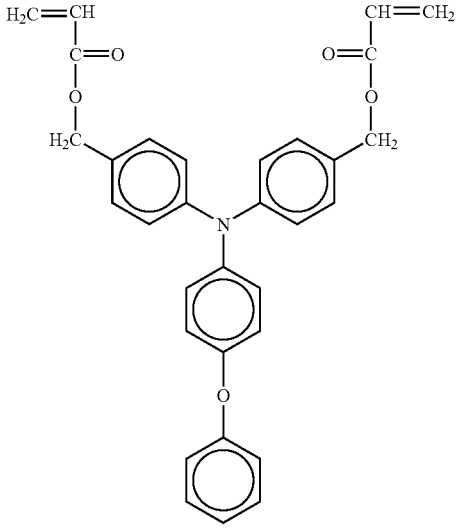

-continued
NO. 332
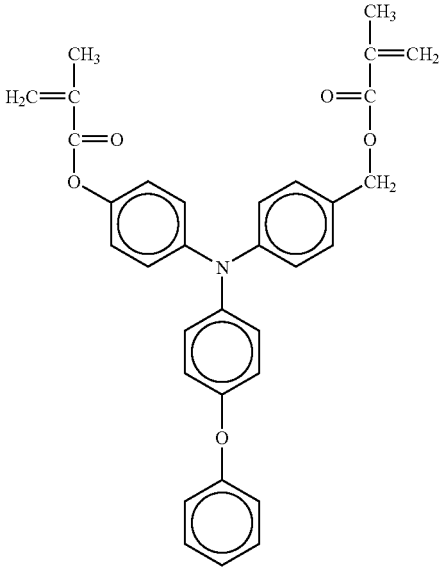
NO. 333
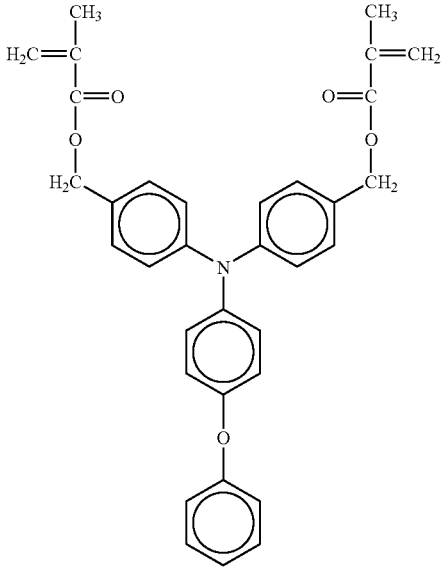
NO. 334
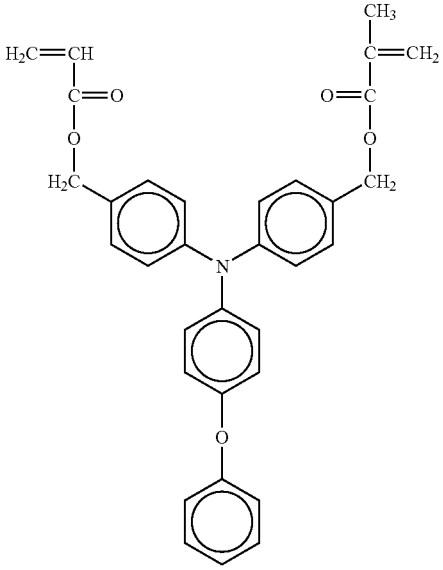
NO. 335
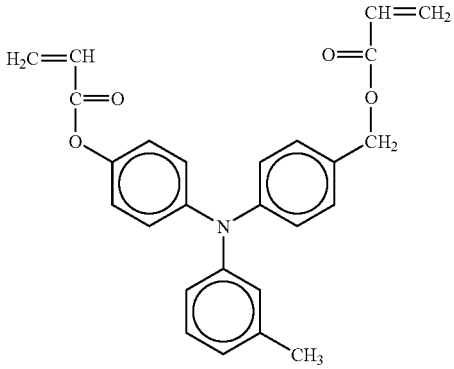
NO. 336
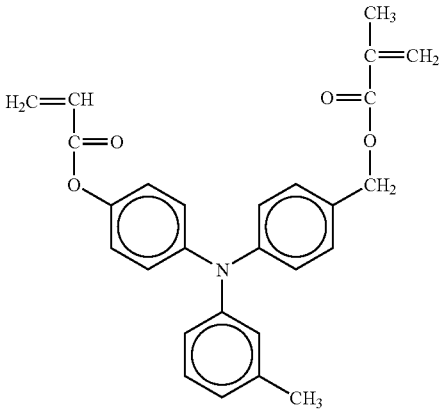
NO. 337
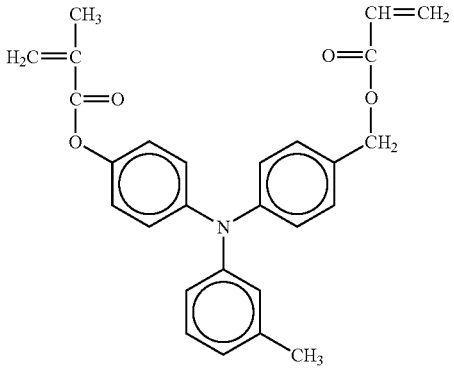

-continued
NO. 338
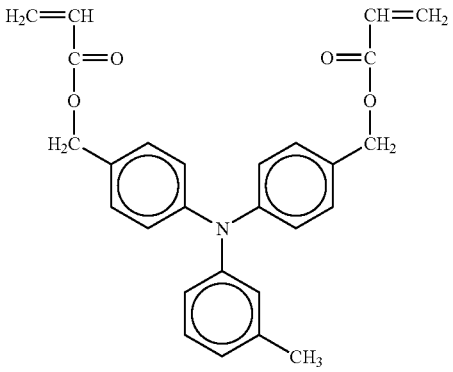
NO. 339
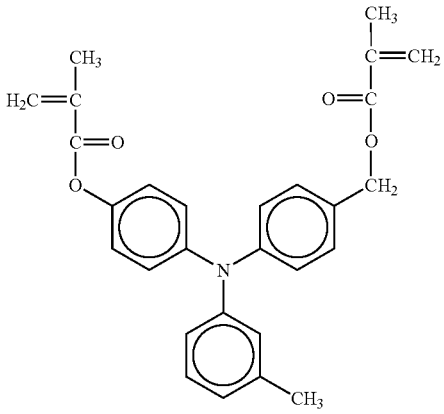
NO. 340
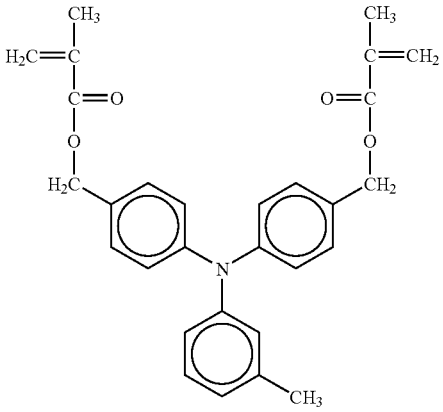
NO. 341
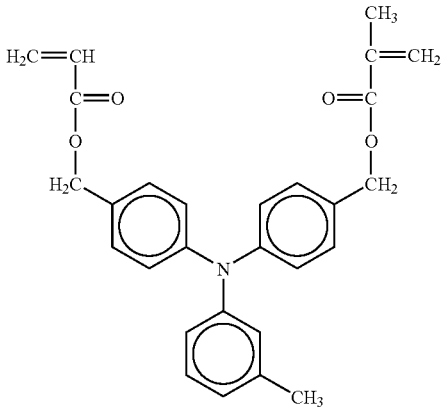
NO. 342
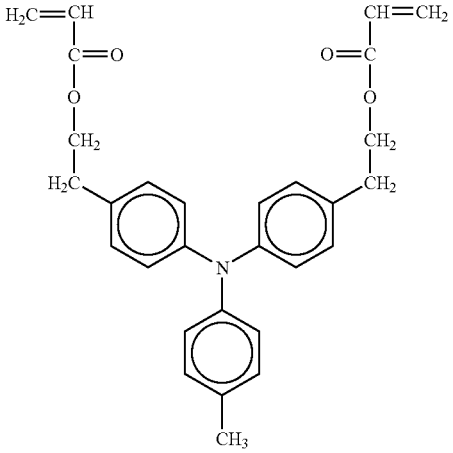
NO. 343
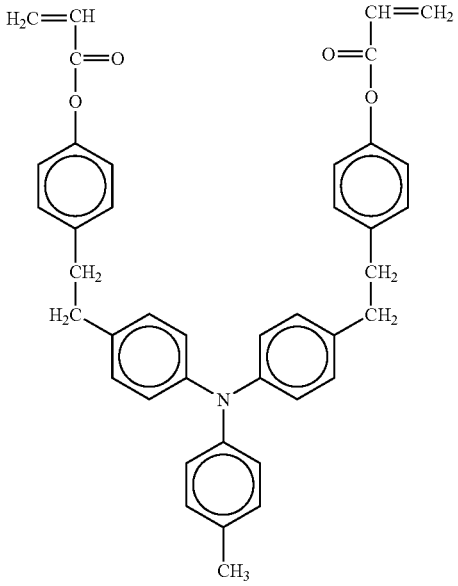

-continued
NO. 344
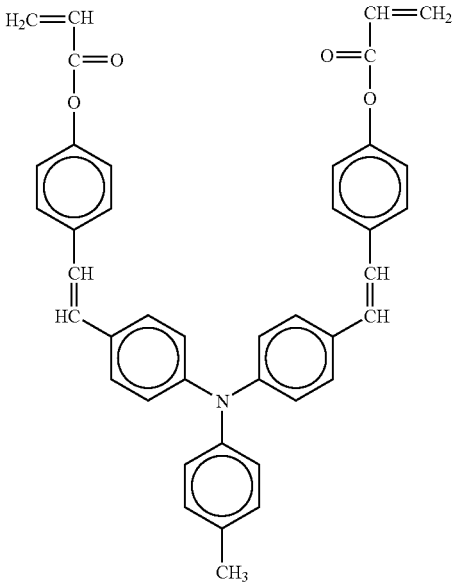
NO. 345
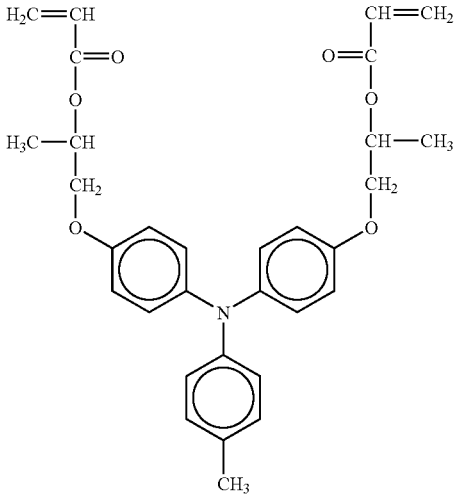
NO. 346
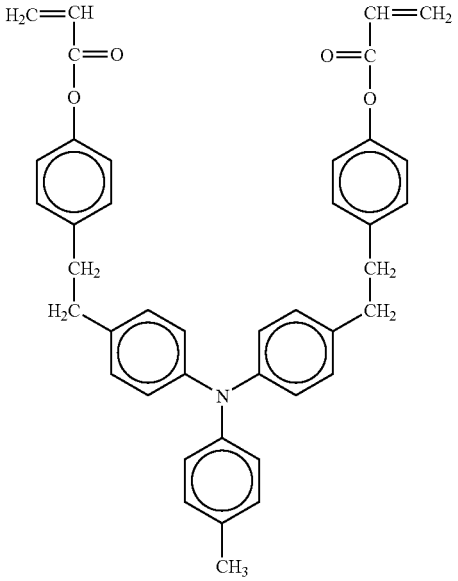
NO. 347
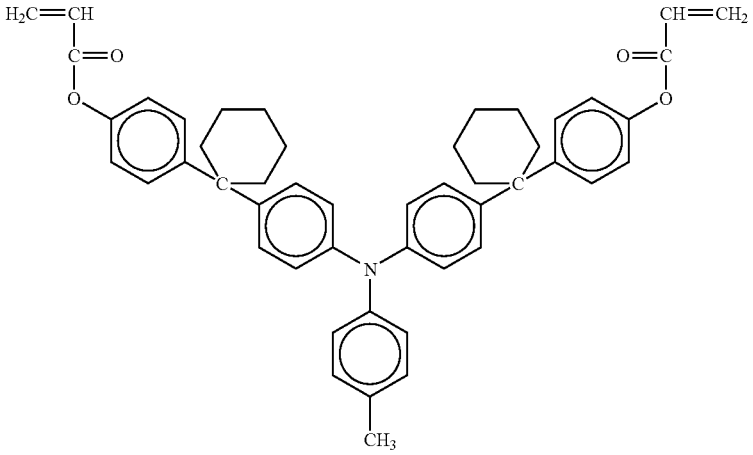

-continued
NO. 348
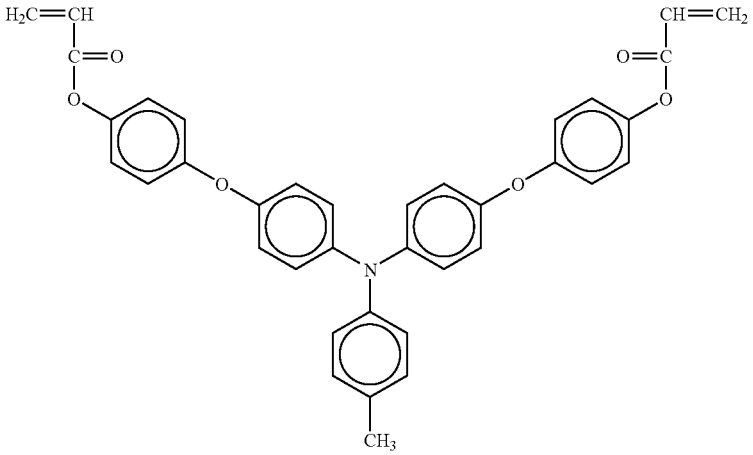
NO. 349
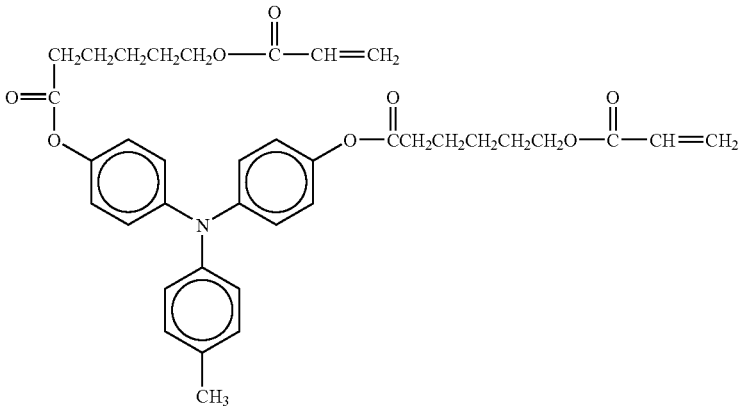
NO. 350
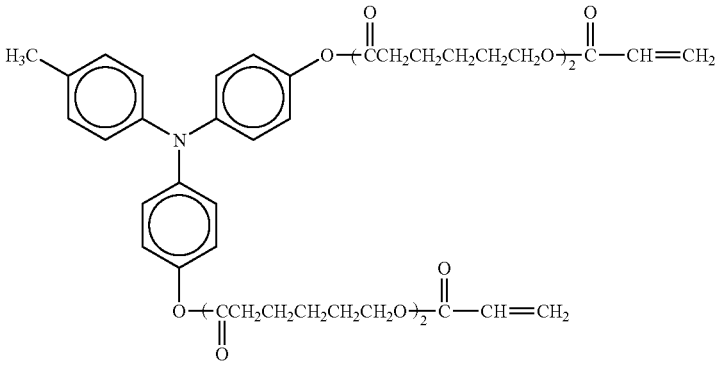

-continued
NO. 351
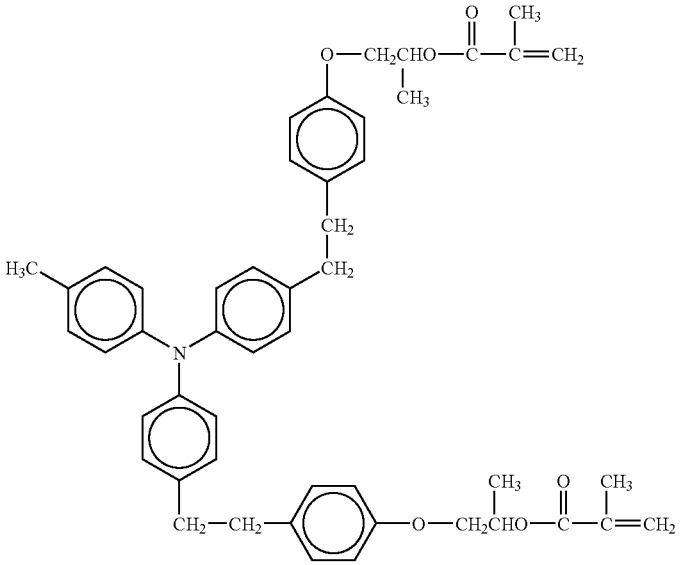
NO. 352
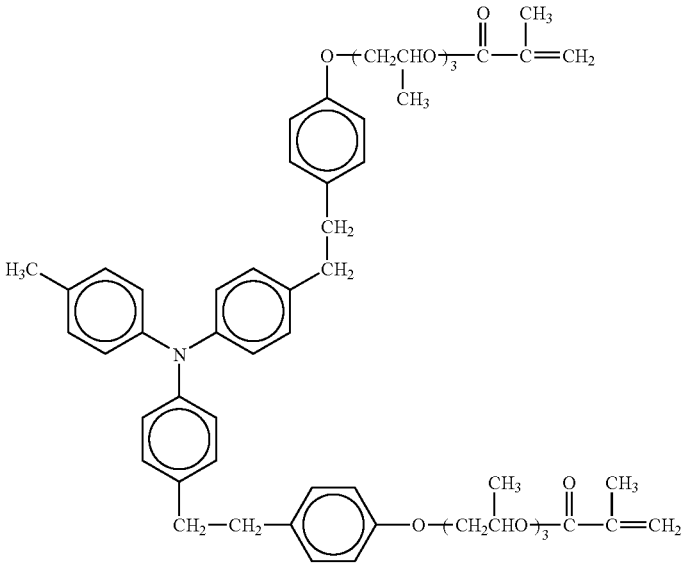
NO. 353
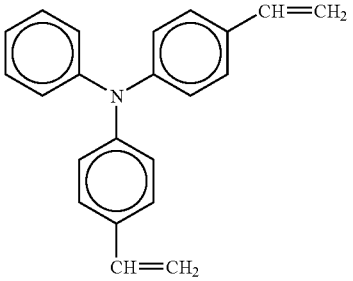
NO. 354
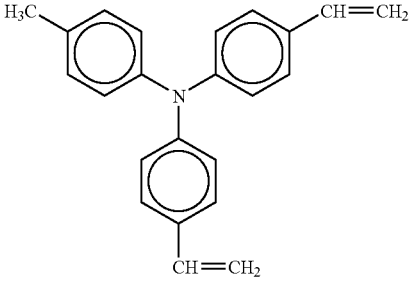

-continued
NO. 355
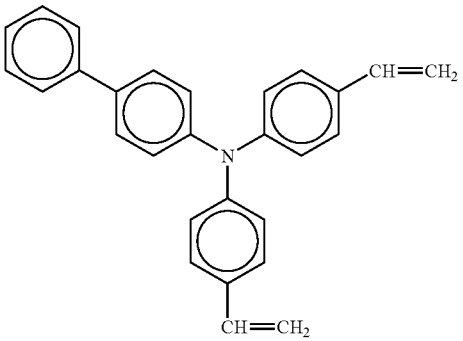
NO. 356
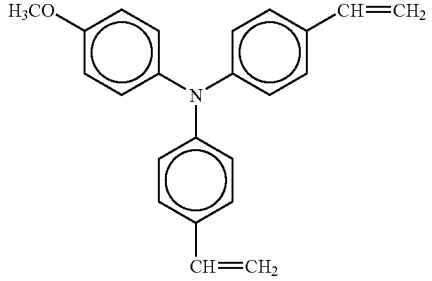
NO. 357
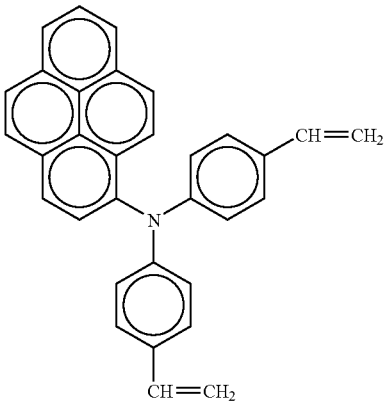
NO. 358
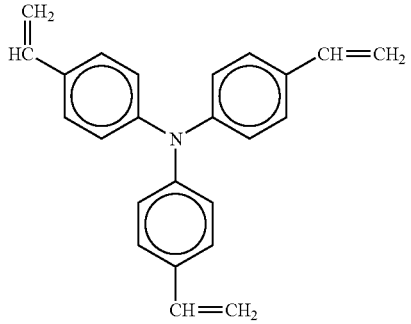
NO. 359
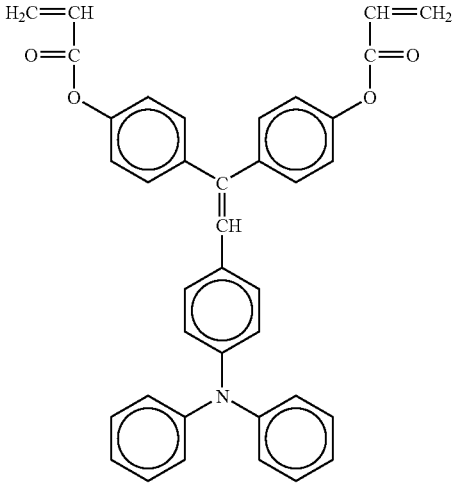
NO. 360
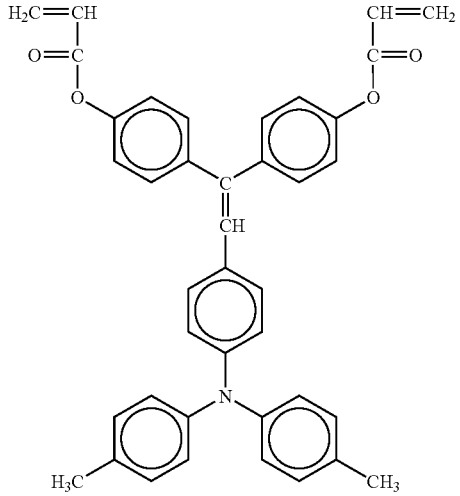

-continued
NO. 361
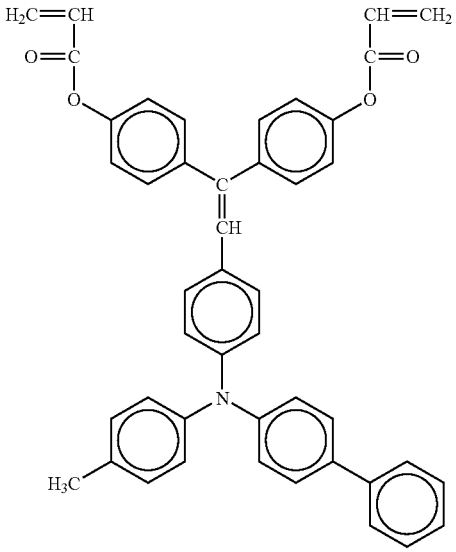
NO. 362
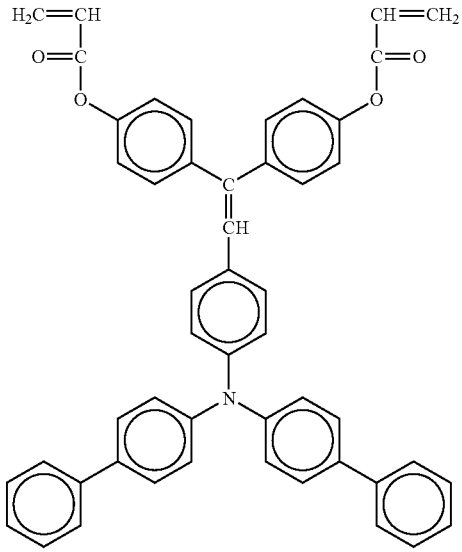
NO. 363
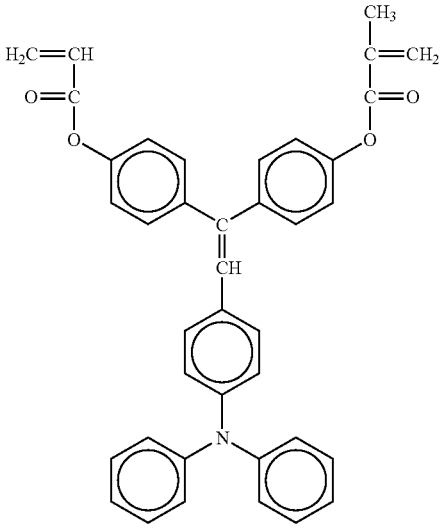
Specific examples of the radical polymerizable compounds having three functionalities and a charge transport structure according to the present invention include the compounds represented by the following formulae No. 364 to No. 384, which should not be construed as limiting the scope of the present invention.

NO. 364
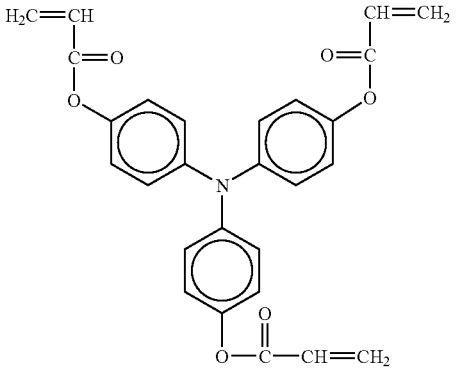
NO. 365
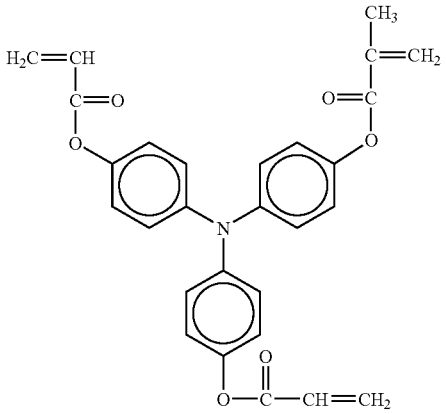
NO. 366
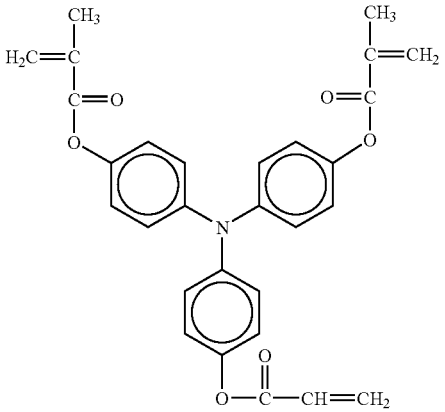
NO. 367
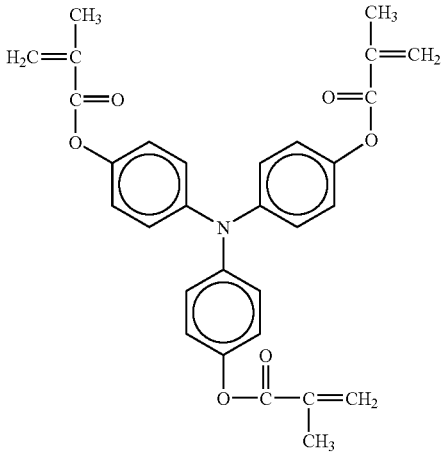
NO. 368
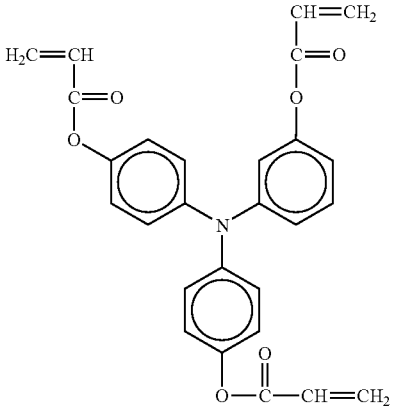
NO. 369
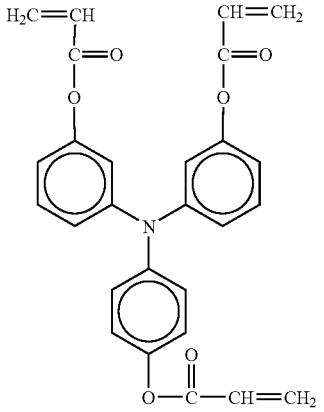

-continued
NO. 370
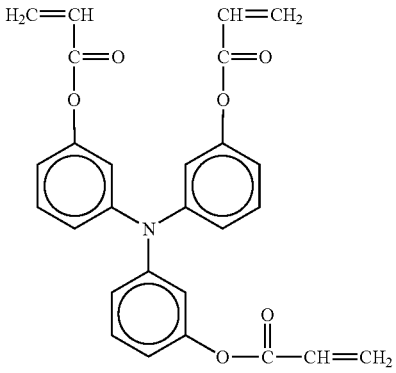
NO. 371
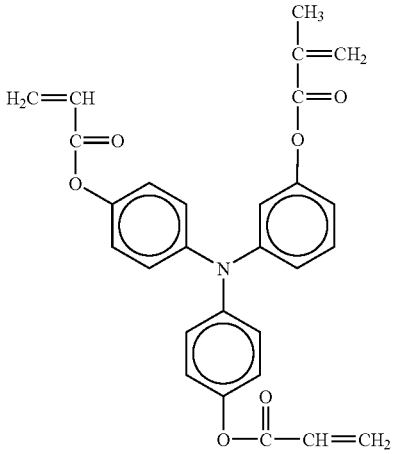
NO. 372
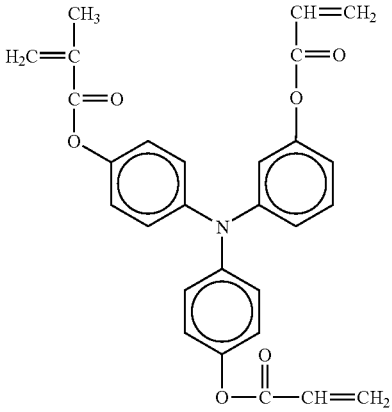
NO. 373
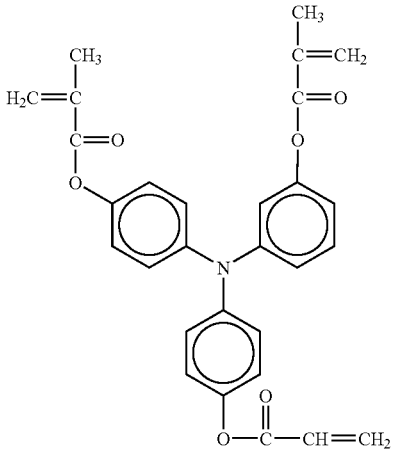
NO. 374
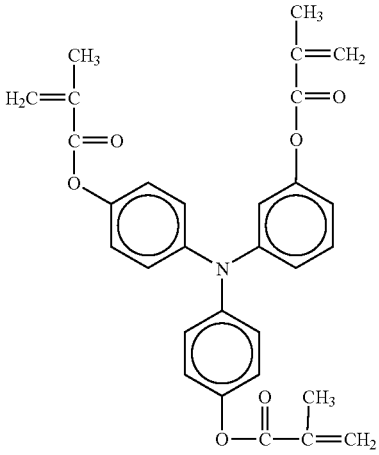
NO. 375
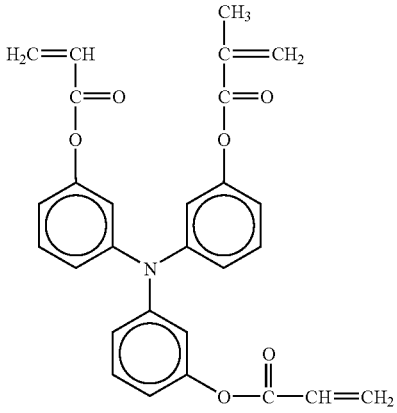

-continued
NO. 376
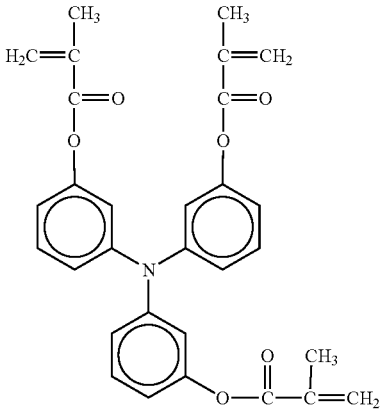
NO. 377
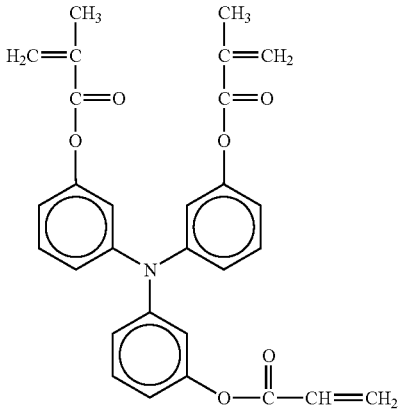
NO. 378
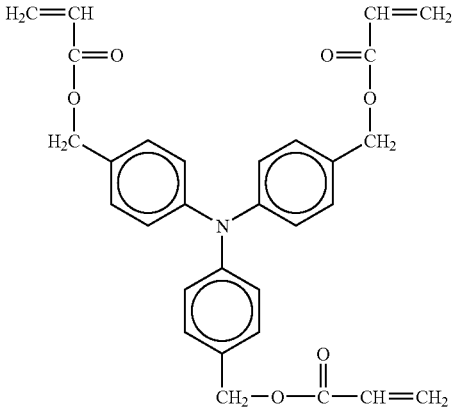
NO. 379
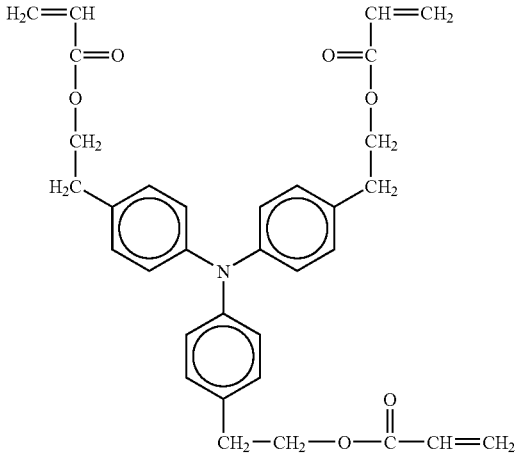
NO. 380
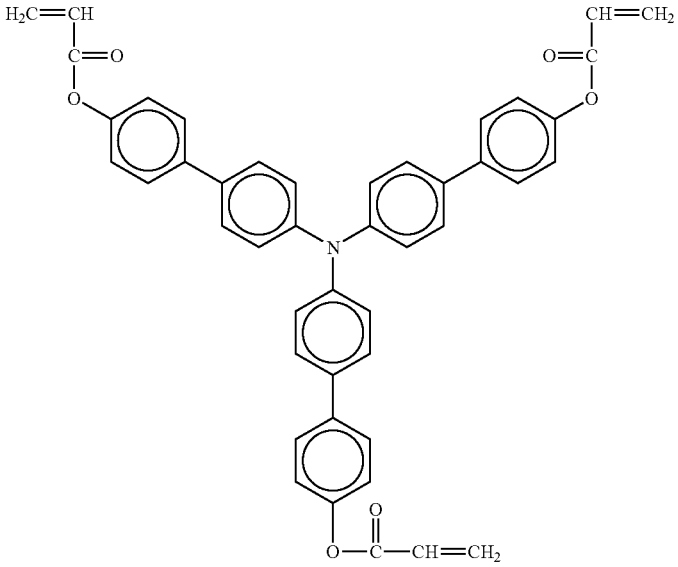

-continued

NO. 381

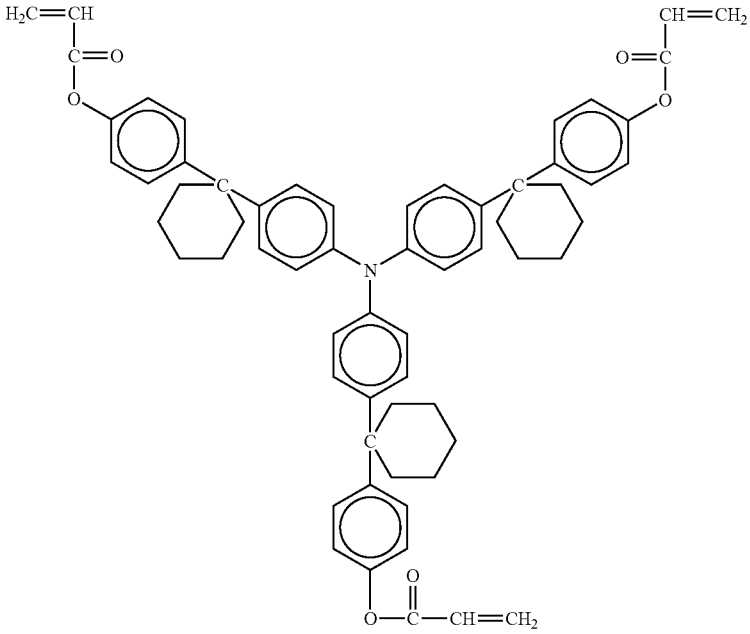

NO. 382

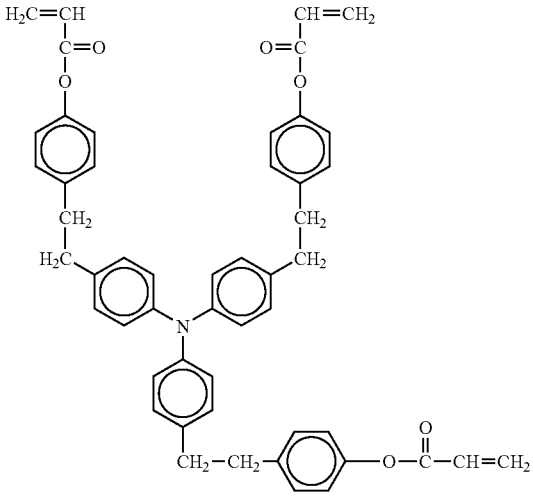

NO. 383

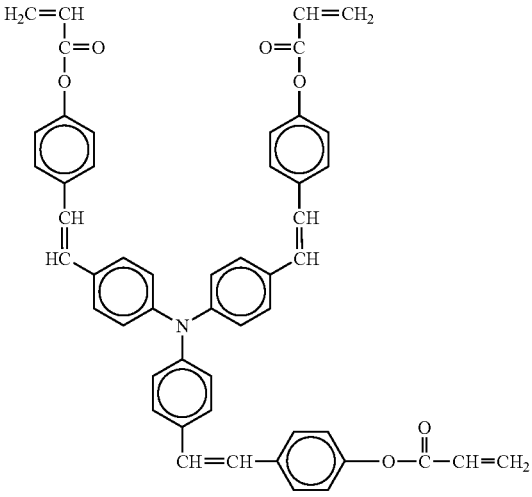

NO. 384

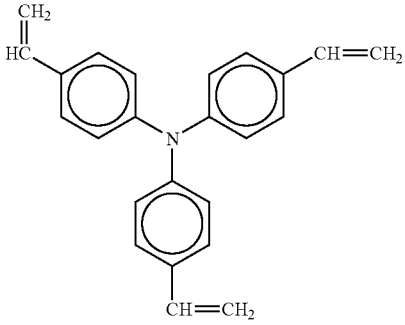

The radical polymerizable compound having a charge transport structure according to the present invention is important for imparting the charge transporting function to the crosslinked layer. The amount of the radical polymerizable compound having a charge transport structure is preferably 20% by mass to 80% by mass, more preferably 30% by mass to 70% by mass, based on the mass of the crosslinked layer. When the amount is less than 20% by mass, the crosslinked layer cannot satisfactorily maintain the charge transporting function, so that in the repeated using of the photoconductor, the impairment of the electrical properties of the photoconductor, such as the lowering of the sensitivity and the elevation of the residual potential is caused. On the other hand, when the amount is more than 80% by mass, the amount of the monomer having three functionalities and no charge transport structure is lowered, so that the lowering of the crosslinkage density in the crosslinked layer is caused and the photoconductor cannot exhibit high wear resistance. Since the electrical properties and wear resistance required for the photoconductor vary depending on the process in which the photoconductor is used, it cannot be sweepingly mentioned that taking into consideration the balance between the above-noted two properties, the above-noted amount is most preferably 30% by mass to 70% by mass.

The crosslinked layer according to the present invention is produced by curing at least the radical polymerizable monomer having three or more functionalities and no charge transport structure and the radical polymerizable compound having a charge transport structure; however, besides these compounds, for imparting to the photoconductor the functions, such as the controlling of the viscosity of the coating liquid for disposing the crosslinked layer, the relaxing of the stress of the crosslinked layer and the lowering of the surface energy and friction coefficience of the crosslinked layer, monofunctional and bifunctional radical polymerizable monomers and a radical polymerizable oligomer can be also used in combination with the above-noted two monomers for producing the crosslinked layer. Examples of these radical polymerizable monomers and oligomers include conventional radical polymerizable monomers and oligomers.

Specific examples of the radical polymerizable monomer having one factionality include 2-ethylhexylacrylate, 2-hydroxyethylacrylate, 2-hydroxypropylacrylate, tetrahydrofurfurylacrylate, 2-ethylhexylcarbitolacrylate, 3-methoxybutylacrylate, benzylacrylate, cyclohexylacrylate, isoamylacrylate, isobutylacrylate, methoxytriethyleneglycolacrylate, phenoxytetraethyleneglycolacrylate, cetylacrylate, isostearylacrylate, stearylacrylate and stylene monomer.

Specific examples of the bifunctional radical polymerizable monomers include 1,3-butanedioldiacrylate, 1,4-butanedioldiacrylate, 1,4-butanedioldimethacrylate, 1,6-hexanedioldiacrylate, 1,6-hexanedioldimethacrylate, diethylene glycoldiacrylate, neopentylglycoldiacrylate, EO-modified bisphenol A diacrylate, EO-modified bisphenol F diacrylate and neopentylglycoldiacrylate.

Specific examples of the above-noted functional monomer include a (meth)acrylate substituted by a fluorine atom, such as octafluoropentylacrylate, 2-perfluorooctylethylacrylate, 2-perfluorooctylethylmethacrylate and 2-perfluoroisononylethylacrylate and a vinyl monomer, acrylate and methacrylate having a polysiloxane group, such as acryloylpolydimethylsiloxaneethyl, methacryloylpolydimethylsiloxaneethyl, acryloylpolydimethylsiloxanepropyl, acryloylpolydimethylsiloxanbutyl and diacryloylpolydimethylsiloxanediethyl which have 20 to 70 recurring units of a siloxane linkage described in JP-B No. 05-60503 and JP-B No. 06-45770.

Examples of the radical polymerizable oligomer include an epoxyacrylate oligomer, an urethaneacrylate oligomer and a polyesteracrylate oligomer. However, when the amount of the monofunctional radical polymerizable monomer, difunctional radical polymerizable monomer or a radical polymerizable oligomer is large, the three-dimensional crosslinkage density of the crosslinked layer is substantially lowered, so that the wear resistance of the photoconductor is lowered. Therefore, the amount of the above-noted monomer or oligomer is restricted to preferably 50 parts by mass or less, more preferably to 30 parts by mass or less, relative to 100 parts by mass of the mass of the radical polymerizable monomer having three or more functionalities.

The crosslinked layer according to the present invention is produced by curing at least the radical polymerizable monomer having three or more functionalities and no charge transport structure and the radical polymerizable compound having a charge transport structure through irradiating a light energy; however, optionally for progressing effectively the curing reaction (crosslinking reaction), a polymerization initiator may be incorporated in the composition of the coating liquid for producing the crosslinked layer.

Examples of the photopolymerization initiator include an acetophenone or ketal photopolymalization initiator, such as diethoxyacetophenone, 2,2-dimethoxy-1,2-diphenylethane-1-one, 1-hydroxy-cyclohexyl-phenyl-ketone, 4-(2-hydroxyethoxy)phenyl-(2-hydroxy-2-propyl) ketone, 2-benzyl-2-dimethylamino-1-(4-morpholinophenyl) butanone-1,2-hydroxy-2-methyl-1-phenylpropane-1-one, 2-methyl-2-morpholino(4-methylthiophenyl) propane-1-one and 1-phenyl-1,2-propanedione-2-(o-ethoxycarbonyl)oxime; a benzoin ether photopolymerization initiator, such as benzoin, benzoin methyl ether, benzoin ethyl ether, benzoin isobutyl ether and benzoin isopropyl ether; a benzophenone photopolymerization initiator, such as benzophenone, 4-hydroxybenzophenone, o-benzoylmethylbenzoate, 2-benzoylnaphthalene, 4-benzoylbiphenyl, 4-benzoyl phenyl ether, acrylated benzophenone and 1,4-benzoylbenzene; a thioxantone photopolymerization initiator, such as 2-isopropylthioxantone, 2-chlorothioxantone, 2,4-dimethylthioxantone, 2,4-diethylthioxantone and 2,4-dichlorothioxantone; and other photopolymerization initiators, such as ethylanthraquinone, 2,4,6-trimethylbenzoyldiphenylphosphine oxide, 2,4,6-trimethylbenzoylphenylethoxyphosphine oxide, bis(2,4,6-trimethylbenzoyl) phenylphosphine oxide, bis (2,4-dimethoxybenzoyl)-2,4,4-trimethylpentylphosphine oxide, methylphenylglyoxy ester, 9,10-phenanthrene, an acridine compound, a triazine compound and an imidazol compound. Further, a compound having a photopolymerization accelerating effect can be also used individually or in combination with the above-noted photopolymerization initiator, as the photopolymerization initiator. Examples of the compound having the photopolymerization accelerating effect include triethanolamine, methyldiethanolamine, 4-dimethylaminoethylbenzoate, 4-dimethylaminoisoamylbenzoate, (2-dimethylamino)ethylbenzoate and 4,4'-dimethylaminobenzophenone.

These photopolymerization initiators may be used individually or in combination.

The amount of the polymerization initiator is preferably 0.5 part by mass to 40 parts by mass, more preferably 1 part by mass to 20 parts by mass, relative to 100 parts by mass of the total mass of the compounds having a radical-polymerizability.

The coating liquid used for disposing the crosslinked layer according to the present invention may optionally comprise various additives, such as a plasticizer, a leveling agent and a low molecular weight-charge transport substance having no radical reactivity for the stress relaxing or adhesion improving of the crosslinked layer.

As these additives, a conventional additive can be used and examples of the plasticizer include a plasticizer used for a general resin, such as dibutylphthalate and dioctylphthalate. The amount of the plasticizer is preferably 20% by mass or less, more preferably 10% by mass or less, based on the total mass of the solid in the coating liquid for disposing the crosslinked layer. Examples of the leveling agent include a silicone oil, such as a dimethyl silicone oil and a methylphenyl silicone oil; and a polymer and oligomer having a perfluoroalkyl group in the side chain. The amount of the leveling agent is preferably 3% by mass, based on the total mass of the solid in the coating liquid for disposing the crosslinked layer.

The crosslinked layer according to the present invention is disposed on the charge transport layer by coating the charge transport layer with a coating liquid comprising at least the radical polymerizable monomer having three or more functionalities and no charge transport structure and the radical polymerizable compound having a charge transport structure; and by curing the resultant coating. When the radical polymerizable monomer is liquid, the coating liquid can be produced by dissolving the other components into the radical polymerizable monomer liquid; however optionally, the coating liquid is diluted by a solvent before using the coating liquid. Example of the solvent for the coating liquid include an alcohol solvent, such as methanol, ethanol, propanol and butanol; a ketone solvent, such as acetone, methyl ethyl ketone, methyl isobutyl ketone and cyclohexanone; an ester solvent, such as ethyl acetate and butyl acetate; an ether solvent, such as tetrahydrofuran, dioxane and propyl ether; a halogenated solvent, such as dichloromethane, dichloroethane, trichloroethane and chlorobenzene; an aromatic solvent, such as benzene, toluene and xylene; and a cellosolve solvent, such as a methyl cellosolve, an ethyl cellosolve and a cellosolve acetate. These solvents may be used individually or in combination. The degree of the dilution by the solvent varies depending on the solubility of the composition of the crosslinked layer, the coating method and the objective thickness of the crosslinked layer, and is random. The coating can be performed by a dip coating, a spray coating, a beads coating or a ring coating.

According to the present invention, after the coating using the above-noted coating liquid for disposing the crosslinked layer, the resultant coating is cured by applying a light energy as an external energy to the coating, so that the crosslinked layer is disposed.

Examples of the source of the light energy include an UV irradiating light source, such as a high-pressure mercury vapor lamp and metal halide lamp which have an emission wavelength in the ultraviolet region; and also a light source for a visible light of which wavelength corresponds to a wavelength of a light absorbed by the radical polymerizable compound or photopolymerization initiator. The amount of an irradiated light is preferably 300 mW/cm$^2$ to 1,000 mW/cm$^2$. When the amount is less than 300 mW/cm$^2$, the curing reaction takes much time sometimes. On the other hand, when the amount is more than 1,000 mW/cm$^2$, the progression of the curing reaction becomes ununiform and the surface of the crosslinked surface layer becomes markedly rough.

When the curing is performed using the light energy, for preventing the hinderance of the crosslinking by oxygen, the oxygen concentration is maintained at 0.001 vol % to 2.0 vol %. Since the normal atmosphere has an oxygen concentration of about 21 vol %, the air in the vessel in which the light energy is irradiated, should be purged by introducing a gas, such as nitrogen, helium and argon into the vessel. By purging the air in the vessel with the above-noted gas and by maintaining the oxygen concentration in the vessel at 0.001 vol % to 2.0 vol %, the crosslinkage density of the crosslinked layer becomes large, so that the film of the crosslinked layer having high surface smoothness can be formed and even when the amount of the irradiated light is small, a relative advantageous film can be formed.

The composition of the coating liquid for disposing the crosslinked layer may comprise a binder resin so long as the surface smoothness, electrical properties and durability of the crosslinked layer are not impaired; however, when the coating liquid for disposing the crosslinked layer comprises a polymer material, such as a binder resin, due to the poor compatibility between the binder resin and a polymer produced according to the curing reaction of a radical polymerizable composition (radical polymerizable monomer or radical polymerizable compound having a charge transport structure), a phase separation is caused in the crosslinked layer, so that the surface of the crosslinked layer becomes extremely rough. Therefore, preferably the binder resin is not used.

With respect to the crosslinked layer according to the present invention, for maintaining the electrical properties of the crosslinked layer, a bulky charge transport structure should be incorporated in the composition of the crosslinked layer and for enhancing the strength of the crosslinked layer, the crosslinkage density in the crosslinked layer should be enhanced. With respect to the curing after the coating for disposing the crosslinked layer, when the curing reaction is progressed rapidly by applying an extremely high external energy to the coating, the curing reaction is progressed ununiformly and the surface of the crosslinked layer becomes extremely uneven. Therefore, since the rate of the curing reaction can be controlled through the intensity of the light irradiation and the amount of the polymerization initiator, the light energy is preferably used as an external energy for the curing.

The photoconductor according to the present invention is produced according to a method comprising preparing a coating liquid for disposing the crosslinked layer, which comprises an acrylate monomer having three acryloyloxy groups and a triarylamine compound having one acryloyloxy group, wherein these two types of acrylate compound are the materials for disposing the crosslinked layer according to the present invention and the amount ratio of these two types of acrylate compound (an acrylate monomer: a triarylamine compound) is 7:3 to 3:7, and which comprises besides the above-noted two types of acrylate compound, a polymerization initiator in an amount of 3% by mass to 20% by mass, based on the total mass of the two types of acrylate compound, and a solvent, disposing the charge transport layer which is the under layer of the crosslinked layer, on the charge generating layer disposed on the undercoat layer disposed on the support, such as an aluminum cylinder, using a triarylamine donor as a charge transport substance and a polycarbonate resin as a binder resin, disposing the crosslinked layer on the charge transport layer by a spray coating using the above-prepared coating liquid which is diluted at the using with a solvent, preferably such as tetrahydrofuran, 2-butanone or ethyl acetate, wherein the amount of the solvent is three times to ten times the total amount of the two types of acrylate compound in the coating liquid; drying the resultant coating as the crosslinked layer at a relative low temperature for a short period (at 25° C. to 80° C. for 1 minute to 10 minutes); curing the crosslinked layer by applying a light energy, such as a UV light energy, wherein for irradiating the UV light, a metal halide lamp is used and the irradiating of the UV light is performed under the condition where the illuminance (at a wavelength of 365 nm) of the UV light is preferably 300 mW/cm$^2$ to 1,000 mW/cm$^2$, for example the UV light having an illuminance of 600 mW/cm$^2$ is irradiated for 45 sec to 360 sec during the curing, while rotating the drum for irradiating the light to the whole surface of the drum uniformly, accompanied by controlling the temperature of the drum under 100° C., and heating the crosslinked layer at 100°

C. to 150° C. for 10 minutes to 30 minutes for distilling off the residual solvent, thereby producing the photoconductor according to the present invention.

Hereinafter, with respect to the photoconductor according to the present invention, explanations are given referring to the layers structure of the photoconductor.

<Layers Structure of Photoconductor>

With respect to the photoconductor according to the present invention, explanations are given referring to FIGs.

Figure 1B:
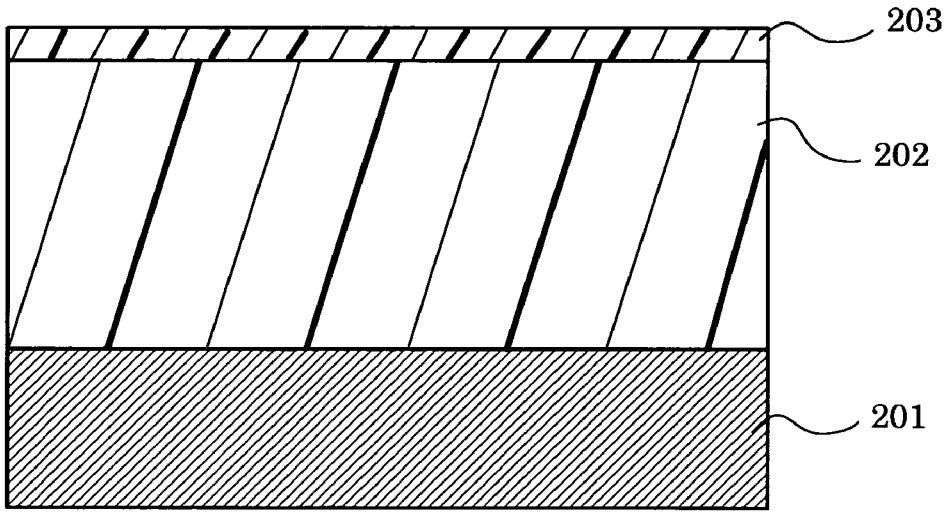
FIG. 1B is a sectional view schematically showing another example of the photoconductor according to the present invention, which comprises the crosslinked layer 203, the photosensitive layer 202 and the support 201.

FIGS. 1A and 1B are sectional views schematically showing an example of the photoconductor according to the present invention, which are the photoconductor in a single layer structure in which a photosensitive layer 202 having both a charge generating function and a charge transporting function simultaneously is disposed on an support 201. FIG. 1A shows an example of the photosensitive layer 202 comprising only a crosslinked layer 203 and FIG. 1B shows an example of the photosensitive layer 202 comprising a crosslinked layer 203 and an underlayer in the photosensitive layer 202.

Figure 2A:
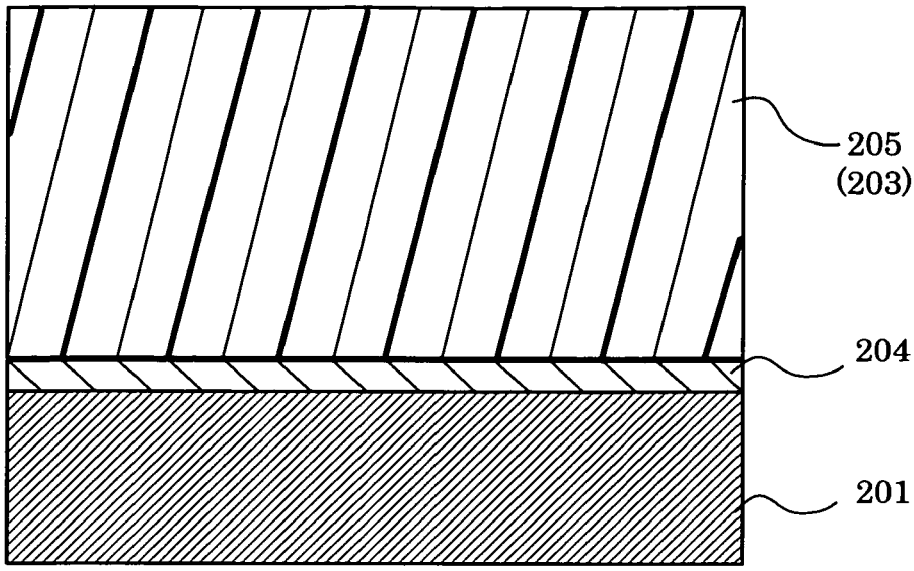
FIG. 2A is a sectional view schematically showing another example of the photoconductor according to the present invention, which comprises the charge transport layer 205, the charge generating layer 204 and the support 201.
Figure 2B:
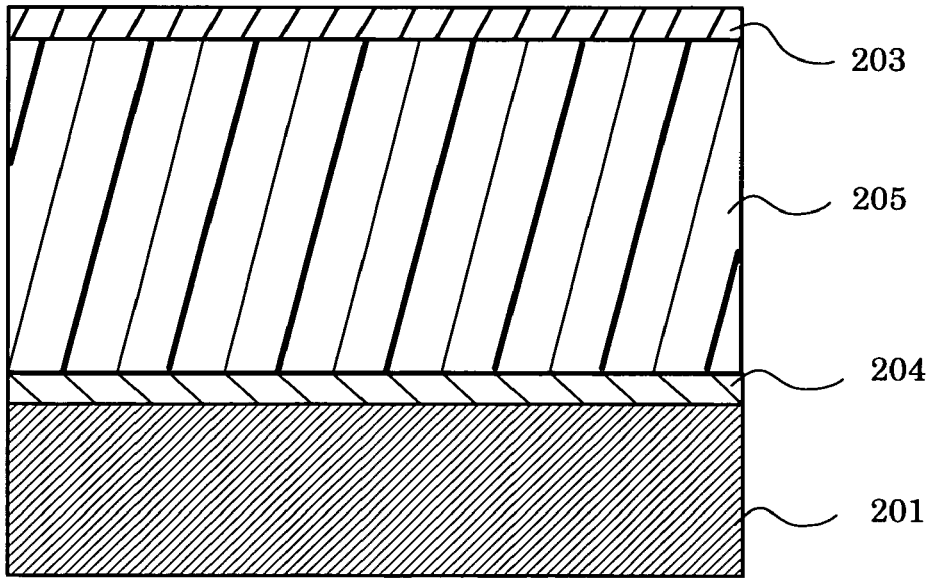
FIG. 2B is a sectional view schematically showing another example of the photoconductor according to the present invention, which comprises the crosslinked layer 203, the charge transport layer 205, the charge generating layer 204 and the support 201.

FIGS. 2A and 2B are sectional views schematically showing an example of the photoconductor according to the present invention, which are the photoconductor in a laminated-layers structure in which a charge generating layer 204 having a charge generating function and a charge transport layer 205 having a charge transporting function are disposed on an support 201 in this order. FIG. 2A shows an example of the charge transport layer 205 comprising only a crosslinked layer 203 and FIG. 2B shows an example of the charge transport layer 205 comprising a crosslinked layer 203 and an underlayer in the charge transport layer 205.

<Support>

The support is not restricted so long as the support exhibits a conductivity of $10^{10}$ Ω·cm or less in terms of the volume resistance and may be selected depending on the application. Examples of the support include a plastic and paper in the form of a film or cylinder, wherein the plastic and paper are coated with a metal, such as aluminum, nickel, chromium, nichrome, copper, gold, silver, platinum, or with a metal oxide, such as tin oxide and indium oxide, by a metallizing or sputtering, and a plate and pipe of aluminum, an aluminum alloy, nickel or a stainless steel, wherein the pipe of a metal or metal alloy is produced by shaping the plate of a metal or metal alloy to a raw pipe according to an extrusion method or drawing method and by subjecting the raw pipe to the surface treatment, such as a cutting, a super-finishing and a polishing. An endless nickel belt and endless stainless steel belt disclosed in JP-A No. 52-36016 can be also used as the support.

As others, a substance produced by coating the above-noted support with a dispersion in which conductive particles are dispersed in a proper binder resin can be also used as the support according to the present invention.

Examples of the conductive particles include particles of a carbon black; an acetylene black; a metal, such as aluminum, nickel, iron, nichrome, copper, zinc and silver; and a metal oxide, such as conductive tin oxide and ITO. Examples of the binder resin which is used in combination with the conductive particles include a thermoplastic resin, a thermosetting resin or a light curing resin, such as a polystyrene resin, a styrene-acrylonitrile copolymer, a styrene-butadiene copolymer, a styrene-maleic anhydride copolymer, a polyester resin, a polyvinyl chloride resin, a vinyl chloride-vinyl acetate copolymer, a polyvinyl acetate resin, a polyvinylidene chloride resin, a polyarylate resin, a phenoxy resin, a polycarbonate resin, a cellulose acetate resin, an ethyl cellulose resin, a polyvinyl butyral resin, a polyvinyl formal resin, a polyvinyl toluene resin, a poly-N-vinylcarbazole resin, an acrylic resin, a silicone resin, an epoxy resin, a melamine resin, an urethane resin, a phenolic resin and an alkyd resin. The conductive layer can be disposed on the support by coating the support with a dispersion in which conductive particles and a binder resin are dispersed in a proper solvent, such as tetrahydrofuran, dichloromethane, methyl ethyl ketone and toluene.

Further, a substance produced by disposing the conductive layer on the proper support having the form of a cylinder using a heat-shrinkable tubing produced by incorporating conductive particles in a material, such as a polyvinyl chloride resin, a polypropylene resin, a polyester resin, a polystyrene resin, a polyvinylidene chloride resin, a polyethylene resin, a chloride rubber and Teflon (registered trade mark), can be also preferably used as the support according to the present invention.

<Photosensitive Layer>

Next, with respect to the photosensitive layer, explanations are given. The photosensitive layer may be in a laminated-layers structure or in a single layer structure.

The photosensitive layer in a laminated-layers structure comprises the charge generating layer having a charge generating function and the charge transport layer having a charge transporting function. The photosensitive layer in a single layer structure has both the charge generating function and the charge transporting function simultaneously.

Hereinbelow, with respect to the photosensitive layer in a laminated layers structure and the photosensitive layer in a single layer structure respectively, explanations are given.

<Photosensitive Layer in Laminated Layers Structure>

(Charge Generating Layer)

The charge generating layer is a layer comprising mainly a charge generating material having charge generating property and may be used in combination with a binder resin as needed. The charge generating materials may be classified into inorganic materials and organic materials.

Examples of inorganic materials include crystalline selenium, amorphous selenium, selenium-tellurium, selenium-tellurium-halogen, selenium-arsenic compound, and amorphous silicon. The amorphous silicon may have dangling bonds terminated with a hydrogen atom or halogen atom, or it may be doped with boron or phosphorus.

Examples of the organic material include a conventional material, such as a phthalocyanine pigment (e.g., a metal phthalocyanine and a phthalocyanine containing no metal), an azulenium salt pigment, a methine squarate pigment, an azo pigment having a carbazole skeleton, an azo pigment having a triphenylamine skeleton, an azo pigment having a diphenylamine skeleton, an azo pigment having a dibenzothiophene skeleton, an azo pigment having a fluorenone skeleton, an azo pigment having an oxadiazole skeleton, an azo pigment having a bis-stilbene skeleton, an azo pigment having a distyryloxadiazole skeleton, an azo pigment having a distyrylcarbazole skeleton, a perylene pigment, anthraquinone and multicyclic quinone pigments, a quinoneimine pigment, diphenylmethane and triphenylmethane pigments, benzoquinone and naphthoquinone pigments, cyanine and azomethine pigments, an indigoido pigment and a bisbenzimidazole pigment. These charge generating substances may be used individually or in combination.

Examples of the binder resin used for disposing the charge generating layer include a polyamide resin, a polyurethane resin, an epoxy resin, a polyketone resin, a polycarbonate resin, a silicone resin, an acrylic resin, a polyvinylbutylal resin, a polyvinylformal resin, a polyvinyl ketone resin, a polystyrene resin, a poly-N-vinylcarbazol resin and a polyacrylamide resin. These binder resins may be used individually or in combination. Examples of the binder resin besides the above-noted binder resins include a charge transpotable polymer having a charge transporting function, such as a polycarbonate resin, polyester resin, polyurethane resin, polyether resin, polisiloxane resin and acrylic resin which have an aryl amine skeleton, benzidine skeleton, hydrazone skeleton, carbazol skeleton, stilbene skeleton or pyrazoline skeleton; and a charge transport polymer having a polysilane skeleton.

Specific examples of the above-exemplified former binder resins include charge transport polymer materials described in patent documents, such as JP-A Nos. 01-001728, 01-009964, 01-013061, 01-019049, 01-241559, 04-011627, 04-175337, 04-183719, 04-225014, 04-230767, 04-320420, 05-232727, 05-310904, 06-234836, 06-234837, 06-234838, 06-234839, 06-234840, 06-234841, 06-239049, 06-236050, 06-236051, 06-295077, 07-056374, 08-176293, 08-208820, 08-211640, 08-253568, 08-269183, 09-062019, 09-043883, 09-71642, 09-87376, 09-104746, 09-110974, 09-110976, 09-157378, 09-221544, 09-227669, 09-235367, 09-241369, 09-268226, 09-272735, 09-302084, 09-302085 and 09-328539.

Specific examples of the above-exemplified latter binder resins include polysilylene polymers described in patent documents, such as JP-A Nos. 63-285552, 05-19497, 05-70595 and 10-73944.

The charge generating layer may comprise a charge transpotable substance having a low molecular weight. Preferred examples of the charge transpotable substance having a low molecular weight which can be used for disposing the charge generating layer in combination with a charge generating substance include an electron-hole transport substance and an electron transpotable substance.

Preferred examples of the electron transpotable substance include an electron acceptor substance, such as chloranil, bromanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophene-4-one, 1,3,7-trinitrodibenzothiophene-5,5-dioxide and a diphenoquinone derivative. These electron transport substances may be used individually or in combination.

Preferred examples of the electron-hole transport substance include an electron donor substance, such as an oxazole derivative, an oxadiazole derivative, an imidazole derivative, a monoaryl amine derivative, a diaryl amine derivative, a triaryl amine derivative, a stilbene derivative, an α-phenylstilbene derivative, a benzidine derivative, a diarylmethane derivative, a triarylmethane derivative, a 9-styrylanthracene derivative, a pyrazoline derivative, a divinylbenzene derivative, a hydrazone derivative, an indene derivative, a butadiene derivative, a pyrene derivative, a bis-stilbene derivative, an enamine derivative, and other conventional substances. These electron-hole transport substances may be used individually or in combination.

In general, the charge generating layer 35 may be formed by way of film forming processes under a vacuum atmosphere or casting processes by use of a solution or dispersion.

The former processes include the vacuum deposition, glow discharge electrolysis, ion plating, sputtering, reactive-sputtering, and CVD processes, which may form satisfactory inorganic materials or organic materials.

The method for disposing the charge generating layer on the support by the casting method comprises, for example, dispersing the organic or inorganic charge generating substance and optionally together with a binder resin in a solvent using an apparatus, such as a ball mill, an attritor, a sand mill and a beads mill, thereby obtaining a dispersion, and coating the support with a coating liquid prepared by diluting properly the above-obtained dispersion. Examples of the above-noted solvent include tetrahydrofuran, dioxane, dioxolane, toluene, dichloromethane, monochlorobenzene, dichloroethane, cyclohexanone, cyclopentanone, anisole, xylene, methyl ethyl ketone, acetone, ethyl acetate and butyl acetate. The above-note dispersion may optionally comprise a leveling agent, such as a dimethyl silicone oil and a methylphenyl silicone oil. Examples of the method for the above-noted coating include a dip coating method, a spray coating method, a beads coating method and a ring coating method.

The charge generating layer has a thickness of preferably 0.01 μm to 5 μm, more preferably 0.05 μm to 2 μm.

(Charge Transport Layer)

The charge transport layer exhibits charge transport property, and the crosslinked layer having a charge transport structure in the present invention may be effectively utilized as the charge transport layer. When the crosslinked layer is the entire charge transport layer, a coating liquid containing the radical polymerizable monomer having three or more functionalities and no charge transport structure and the radical polymerizable compound having one functionality and a charge transport structure (hereinafter, referring to as "radical polymerizable composition" in the present invention) is applied on the charge generating layer, followed by drying as required, and cured by use of external energy thereby to form the crosslinked layer. Preferably, the thickness of the crosslinked layer is 10 μm to 30 μm, more preferably is 10 μm to 25 μm. When the thickness is thinner than 10 μm, the charging potential may not be maintained, and when the thickness is above 30 μm, the crosslinked layer may separate from the underlayer owing to volume contraction upon curing.

When the charge transport layer has a laminated structure comprising the crosslinked layer formed on the charge transport layer, the undercoat layer of the charge transport layer may be formed by way of dissolving or dispersing a charge transport substance and a binder resin in a proper solvent and applying the resulting liquid on the charge generating layer, followed by drying, then the coating liquid containing the "radical polymerizable composition" in the present invention is applied and crosslinked by use of the external energy as described above.

Examples of the charge transport substance include an electron transport substance, an electron-hole transport substance and a charge transport polymer which are described in the above section of the charge generating layer. As noted above, by using the charge transport polymer, the solubility of the charge transport layer during disposing the crosslinked layer by the coating, can be lowered, therefore, the using of the charge transport polymer is particularly preferred.

Examples of the binder resin include a thermoplastic or thermosetting resin, such as a polystyrene resin, a styrene-acrylonitrile copolymer, a styrene-butadiene copolymer, a styrene-maleic anhydride copolymer, a polyester resin, a polyvinyl chloride resin, a vinyl chloride-vinyl acetate copolymer, a polyvinyl acetate resin, a polyvinylidene chloride resin, a polyarylate resin, a phenoxy resin, a polycarbonate resin, a cellulose acetate resin, an ethyl cellulose resin, a polyvinylbutyral resin, a polyvinylformal resin, a polyvinyltoluene resin, a poly-N-vinylcarbazole resin, an acrylic resin, a silicone resin, an epoxy resin, a melamine resin, an urethane resin, a phenolic resin and an alkyd resin.

The amount of the charge transport substance is preferably 20 parts by mass to 300 parts by mass, more preferably 40 parts by mass to 150 parts by mass, relative to 100 parts by mass of the mass of the binder resin, with proviso that when a charge transport polymer is used as the charge transport substance, the charge transport polymer may be used individually or in combination with the binder resin.

The solvents utilized with the charge transport layer may be the same as those in terms of the charge generating layer described above. Preferably, the solvents can dissolve both of the charge transport substance and the binder resin. The charge transport layer may be coated in the similar way as the charge generating layer.

The charge transport layer may include additives such as plasticizers and leveling agents depending on requirements. Specific examples of the plasticizers include known ones, which are used for plasticizing resins, such as dibutyl phthalate, dioctyl phthalate and the like. The additive amount of the plasticizer is 0 to 30 parts by mass, relative to 100 parts by mass of the binder resin. Specific examples of the leveling agents include silicone oils such as dimethyl silicone oil, and methyl phenyl silicone oil; polymers or oligomers including a perfluoroalkyl group in their side chain, and the like. The additive amount of the leveling agents is 0 to 1 part by mass based on 100 parts by mass of the binder resin.

The underlayer of the charge transport layer has a thickness of preferably 5 μm to 40 μm, more preferably 10 μm to 30 μm.

When the crosslinked layer is disposed in the surface of the charge transport layer, as noted above in the section of the disposing method of the crosslinked layer, the crosslinked layer is disposed according to a method comprising coating the charge generating layer with a coating liquid comprising a radical polymerizable composition according to the present invention, drying optionally the resultant coating as the crosslinked layer, and curing the coating by applying a light energy to the coating, thereby disposing the crosslinked layer. At this time, the crosslinked layer has a thickness of preferably 1 μm to 20 μm, more preferably 2 μm to 10 μm. When the thickness of the crosslinked layer is less than 1 μm, the durability of the photoconductor is scattered due to the irregularity of the film thickness of the crosslinked layer. On the other hand, when the thickness of the crosslinked layer is more than 20 μm, the thickness of the whole charge transport layer becomes too large and accordingly due to the diffusion of the charge, the reproducibility of the image is lowered.

<Photosensitive Layer in Single Layer Structure>

The photosensitive layer in a single layer structure is a layer having the charge generating function and charge transporting function simultaneously. The crosslinked layer having a charge transport structure according to the present invention can be preferably used as a photosensitive layer in a single layer structure by incorporating a charge generating substance having a charge generating function in the composition used for disposing the crosslinked layer. As noted above in the disposing method of the charge generating layer by the casting method using a dispersion, the crosslinked layer is disposed according to a method comprising preparing a coating liquid for disposing the crosslinked layer by dispersing a charge generating substance together with a coating liquid comprising a radical polymerizable composition in a solvent, coating the support or the undercoat layer with the prepared coating liquid, drying optionally the resultant coating as the crosslinked layer, and curing the coating by applying an external energy to the coating, thereby disposing the crosslinked layer. As another method for preparing the above-noted coating liquid for disposing the crosslinked layer, the charge generating substance may be dispersed in a solvent beforehand and the resultant dispersion of the charge generating substance may be mixed with a coating liquid comprising a radical polymerizable composition for preparing the coating liquid for disposing the crosslinked layer according to the present invention. At this time, the crosslinked layer has a thickness of preferably 10 μm to 30 μm, more preferably 10 μm to 25 μm. When the thickness of the crosslinked layer is less than 10 μm, a satisfactory charging potential of the photoconductor cannot be maintained. On the other hand, when the thickness of the crosslinked layer is more than 30 μm, the peeling of the crosslinked layer from the support or the undercoat layer is easily caused due to the volume contraction of the crosslinked layer during the curing.

Also, when the crosslinked layer is a surface part having a single-layered structure of the photosensitive layer, the undercoat layer of the photosensitive layer is formed by dissolving or dispersing a charge generating substance, a charge transport substance, and a binder resin in a proper solvent and applying it, followed by drying. Also, a plasticizer, a leveling agent and the like may be added as needed. The dispersion process of the charge generating substance, the charge generating substance, the charge transport substance, the plasticizer, and the leveling agent may be the same as described in terms of the charge generating layer and the charge transport layer. As for the binder resin, in addition to the binder resins described for the charge transport layer, the binder resins described for the charge generating layer may be employed in combination. Also, the charge transport polymer may be used, which is favorable in reducing the inclusion of the photosensitive composition of the lower layer into the crosslinked layer. Preferably, the undercoat layer of the photosensitive layer has a thickness of properly 5 μm to 30 μm, preferably 10 to 25 μm.

When the crosslinked layer is disposed in the surface of the photosensitive layer in a single layer structure, on the underlayer in the photosensitive layer, the crosslinked layer is disposed according to a method comprising coating the underlayer in the photosensitive layer with a coating liquid comprising the radical polymerizable composition and charge generating substance according to the present invention, drying optionally the resultant coating, and curing the resultant coating by applying a light energy, thereby disposing the crosslinked layer. The crosslinked layer has a film thickness of preferably 1 μm to 20 μm, more preferably 2 μm to 10 μm. When the film thickness is less than 1 μm, due to the irregularity of the film thickness, the durability of the photoconductor is scattered. When the film thickness is 20 μm or less, the electrical properties of the photoconductor are advantageous.

In the photosensitive layer in a single layer structure, the amount of the charge generating substance, binder resin and charge transport substance respectively is preferably 1% by mass to 30% by mass, 20% by mass to 80% by mass and 10% by mass to 70% by mass respectively, based on the total mass of the photosensitive layer.

<Intermediate Layer>

In the photoconductor according to the present invention, when the crosslinked layer is disposed in the surface of the photosensitive layer, for suppressing the invading of a component of the underlayer in the photosensitive layer into the crosslinked layer or improving the adhesion of the crosslinked layer to the underlayer in the photosensitive layer, an intermediate layer can be disposed. The intermediate layer prevents the hindrance of the curing reaction and unevenness of the surface of the crosslinked layer due to the invading of a component of the underlayer in the photosensitive layer into the crosslinked layer comprising a radical polymerizable composition. By disposing the intermediate layer, the adhesion between the underlayer in the photosensitive layer and the crosslinked layer can be improved.

Generally, the intermediate layer comprises mainly a binder resin. Examples of the binder resin include a polyamide resin, an alcohol-soluble nylon resin, a water-soluble polyvinylbutyral resin, a polyvinylbutyral resin and a polyvinylalcohol resin. Examples of the disposing method of the intermediate layer include a general coating method. The intermediate layer has a thickness of preferably 0.05 μm to 2 μm.

<Undercoat Layer>

In the photoconductor of the present invention, an undercoat layer may be provided between conductive support 31 and the photosensitive layer. The undercoat layer is typically formed of resins. The resins are preferably solvent-resistant against common solvents since the photosensitive layer containing an organic solvent is usually coated on the undercoat layer. Examples of the resin include water-soluble resins such as polyvinyl alcohol, casein, sodium polyacrylate, alcohol-soluble resins such as copolymer nylon and methoxymethylated nylon, and curing resins which form a three-dimensional network such as polyurethane, melamine resins, phenol resins, alkyd-melamine resins, and epoxy resins.

Also, metal oxide fine powder pigments such as titanium oxide, silica, alumina, zirconium oxide, tin oxide or indium oxide may be added to the undercoat layer to prevent Moire patterns, and to reduce residual potential. Among these, titanium oxide is most preferable from the viewpoint of decrease of residual potential, prevention of Moire patterns, and suppression of background smear.

These undercoat layer may be formed using a suitable solvent and by way of a coating method as described in terms of the charge transport layer. A silane coupling agent, titanium coupling agent or chromium coupling agent, etc. can be used as the undercoat layer of the present invention. Also, $Al_2O_3$ prepared by anodic oxidation, organic materials such as polyparaxylylene (parylene) and inorganic materials such as $SiO_2$, $SnO_2$, $TiO_2$, ITO, $CeO_2$ prepared by the vacuum thin film-forming process, can be used for the undercoat layer. The thickness of the undercoat layer is preferably 0 μm to 5 μm.

<Anti-Oxidant>

In the present invention, anti-oxidants may be incorporated into the respective layers of crosslinked layer, charge generating layer, charge transport layer, undercoat layer, intermediate layer etc. in order to improve the environmental resistance, in particular to prevent the sensitivity decrease and the residual potential increase.

The anti-oxidant available for the respective layers may be exemplified as follows, but not limited to.

(Phenol Compounds)

2,6-di-t-butyl-p-cresol, butylhydroxyanisole, 2,6-di-t-butyl-4-ethylphenol, stearyl-β-(3,5-di-t-butyl-4-hydroxyphenyl)propionate, 2,2'-methylene-bis-(4-methyl-6-t-butylphenol), 2,2'-methylene-bis-(4-ethyl-6-t-butylphenol), 4,4'-thiobis-(3-methyl-6-t)-butylphenol, 4,4'-butylydenebis-(3-methyl-6-t-butylphenol), 1,1,3-tris-(2-methyl-4-hydroxy 5-t-butylphenyl)butane, 1,3,5-trimethyl-2,4,6-tris-(3,5-di-t-butyl-4-hydroxybenzyl)benzene, tetrakis-[methylene 3-(3',5'-di-t-butyl-4'-hydroxy-phenyl)propionate]methane, bis-[3,3'-bis-(4'-hydroxy-3'-t-butylphenyl)butylic acid]glycolester, tocopherols, etc.

(p-Phenylenediamine Compound)

N-phenyl-N'-isopropyl-p-phenylene diamine, N,N'-di-sec-butyl-p-phenylene diamine, N-phenyl-N-sec-butyl-p-phenylene diamine, N,N'-di-isopropyl-p-phenylene diamine, N,N'-dimethyl-N,N'-di-t-butyl-p-phenylene diamine, etc.

(Hydroquinone Compound)

2,5-di-t-octyl hydroquinone, 2,6-di-dodecyl hydroquinone, 2-dodecyl hydroquinone, 2-dodecyl 5-chlorohydroquinone, 2-t-octyl 5-methyl hydroquinone, 2-(2-octadecenyl)-5-methyl hydroquinone, etc.

(Organosulfur Compound)

dilauril-3,3'-thiodipropionate, distearil-3,3'-thiodipropionate, tetradecyl-3,3'-thiodipropionate.

(Organophosphorus Compound)

triphenyl phosphine, tri(nonylphenyl)phosphine, tri(dinonyl phenyl) phosphine, tri-cresil phosphine, tri(2,4-dibutyl phenoxy)phosphine, etc.

These compounds are known as the anti-oxidants of rubber, plastic, fatty and oil, and are commercially available. The content of the anti-oxidant is preferably 0.01% by mass to 10% by mass based on the total mass of the layer to be incorporated.

<Image Forming Process and Image Forming Apparatus>

The image forming processes and apparatuses according to the present invention will be explained with reference to figures. In the image forming processes and apparatuses, the photoconductor comprising the crosslinked layer is employed, and charging, exposing, and developing are carried out using the photoconductor, followed by transferring, fixing, and cleaning.

Figure 3:
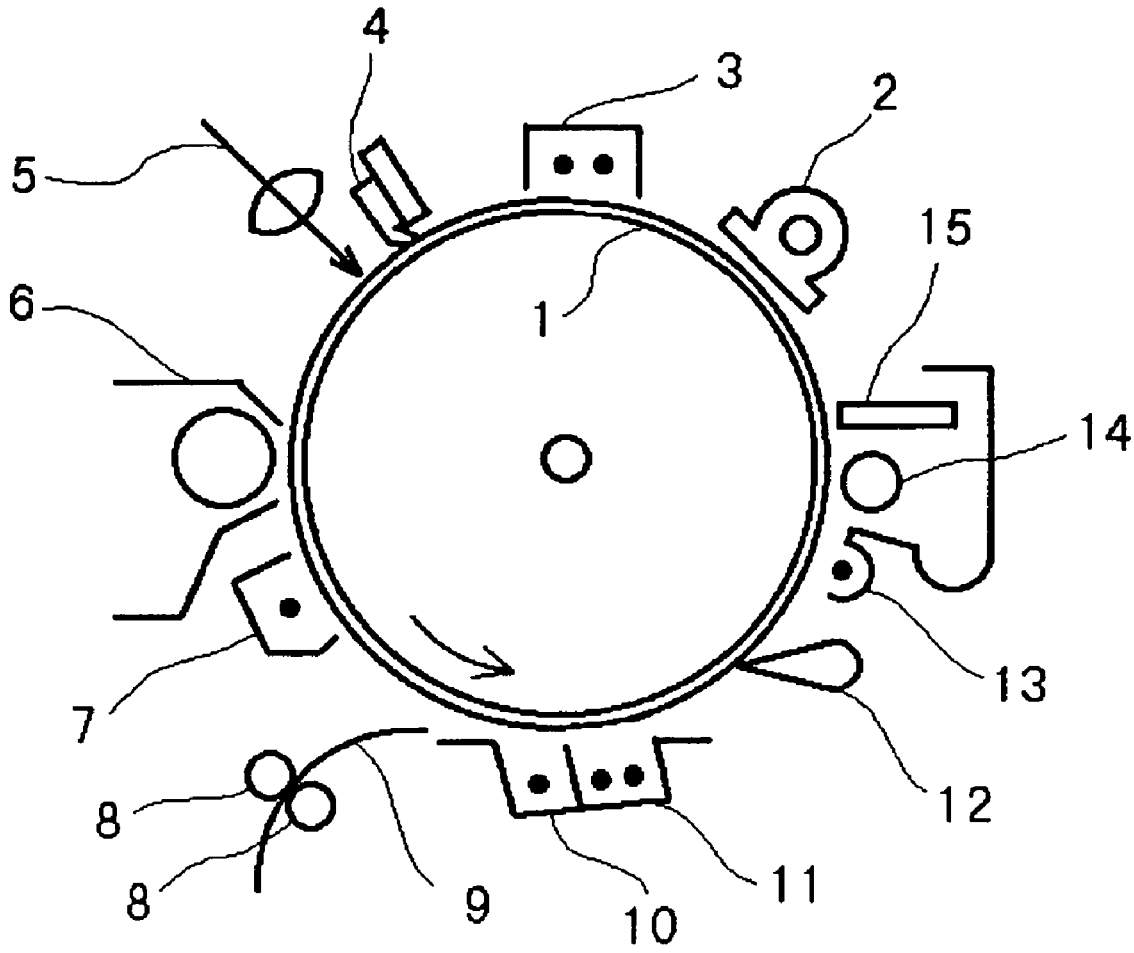
FIG. 3 is an explanatory view schematically showing an example of the image forming apparatus according to the present invention.

FIG. 3 is a schematic view illustrating an exemplary image forming apparatus. A charger 3 is used as a charging unit for evenly charging a photoconductor. Examples of the charging unit include a corotron device, scorotron device, solid discharging device, pin electrode device, roller charging device, conductive brush device and the like.

The image forming unit 5 is employed for forming an electrostatic latent image on photoconductor 1 charged evenly. As for the light source, light emitters such as a fluorescent lamp, tungsten lamp, halogen lamp, mercury lamp, sodium lamp, light emitting diode (LED), semiconductor laser (LD), and electro luminescence may be employed. For providing light only at a desired spectral region, filters such as a sharply cutting filter, bandpass filter, near-infrared cutting filter, dichroic filter, interference filter, and conversion filter for color temperature may be employed.

The developing unit 6 is employed for visualizing the latent electrostatic image formed on the photoconductor 1. The developing may be of one-component developing, two-component developing using a dry toner, or wet developing using a wet toner. When a positive (negative) charge is applied to the photoconductor and image exposure is performed, a positive (negative) electrostatic latent image will be formed on the photoconductor surface. If the latent image is developed with a toner (charge detecting particles) of negative (positive) polarity, a positive image will be obtained, and a negative image will be obtained if the image is developed with a toner of positive (negative) polarity.

Further, transferring charger 10 is employed to transfer the visualized toner image from the photoconductor to transferring body 9. In order conduct the transferring properly, pre-transferring charger 7 may be utilized. In order to carry out the transferring, such processes or ways may be employed as electrostatic transferring using a transfer charger and a bias roller, mechanical transferring process such as adhesion transfer, pressure transfer and the like, and the magnetic transferring process. The charging unit may be employed for carrying out the electrostatic transferring process.

In order to separate transferring body 9 from the photoconductor 1, separation charger 11 or separation claw 12 may be utilized. Additionally, other separation means may be employed such as electrostatic adsorption-induction, stripping using a side belt, stripping by tip grip transportation, self stripping and the like. The separation charger 11 can be employed for the charging unit.

Fur brush 14 and/or cleaning blade 15 may be employed in order to remove the toner remaining on the photoconductor after the transferring. Further, in order to carry out the cleaning more effectively, pre-cleaning charger 13 may be employed. Other cleaning means include the wave process, magnet brush process and the like, which may be used alone or in combination.

A discharging unit may be employed in order to remove the latent image on the photoconductor, depending on the requirement. The discharging means may be discharging lamp 2 and a discharging charger, which may utilize the light source for light exposure and the charging unit, respectively, and also eraser 4 may be employed. Reference number 8 indicates a paper-feed roller.

In addition, processes for script reading, paper supplying, fixing, and paper releasing may be carried out conventionally.

In FIG. 3, 4 represents an eraser and 8 represents a resist roller.

Figure 4:
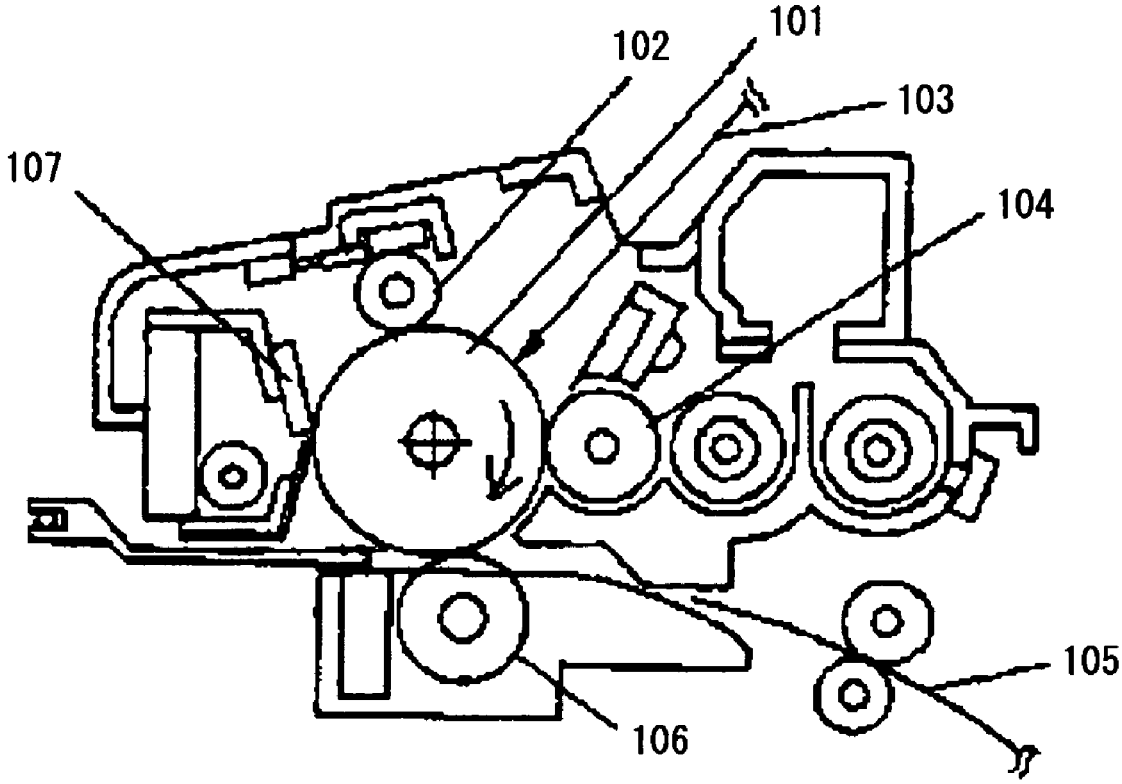
FIG. 4 is an explanatory view schematically showing an example of a process cartridge according to the present invention.

The photoconductors according to the present invention may be advantageously mounted to image forming apparatuses such as copiers, facsimiles, laser printers, and composite apparatuses. In an aspect, the photoconductors are attached to process cartridges and the process cartridges are mounted detachably to the image forming apparatuses, thereby providing users with conveniences of repeated and prolonged usages of photoconductors. FIG. 4 shows an exemplary process cartridge.

The process cartridge for image forming apparatuses comprises photoconductor 101, and at least one of charging unit 102, development unit 104, transferring unit 106, cleaning unit 107, and charging eliminating unit 108, and is detachably mounted to a main body of the image forming apparatuses.

With respect to the image forming process by use of the apparatus shown in FIG. 4, an electrostatic latent image is formed on photoconductor 101 through charging by means of charging unit 102 and exposing by means of light exposing unit 103, the electrostatic latent image is developed by means of developing unit 104 using a toner, the developed image is transferred and printed by means of transferring unit 106 on transfer material 105, while photoconductor 101 being rotated. Then, the surface of the photoconductor 101 is cleaned by cleaning unit 107 and also is charge-eliminated by means of charge-eliminating unit 108. These procedures are repeated and printings are provided repeatedly. In the present invention, in addition to the photoconductors according to the present invention, process cartridges are provided that comprise the photoconductor and at least one unit selected from the group consisting of charging unit, developing unit, transferring unit, cleaning unit, and discharging unit, thus the photoconductor and at least one unit are provided integrally.

The present invention provides a process cartridge, which comprises a photoconductor comprising the crosslinked layer according to the present invention and at least one of a charging unit, a developing unit, a transferring unit, a cleaning unit and a destaticizing unit, wherein the photoconductor and at least one of other units are integrated.

As clearly seen from the above description, the photoconductors according to the present invention can be widely employed in copiers and also in various electrophotography fields such as laser beam printers, CRT printers, LED printers, liquid crystal printers, and laser engravings.

<Example of Synthesizing Compound Having Charge Transport Structure>

The compounds having a charge transport structure adapted to the present invention may be synthesized, for example, by the process described in Japanese Patent No. 3164426. An example is as follows:

(1) Synthesis of Hydroxy Group-Substituted Triarylamine Compound of Formula B

To 240 ml of sulfolane, 113.85 grams (0.3 mol) of methoxy group-substituted triarylamine compound of Formula A and 138 grams (0.92 mol) of sodium iodide are added and heated to 60° C. while flowing nitrogen gas. In the solution, 99 grams (0.91 mol) of trimethylchlorosilane is dropwisely added for 1 hour and stirred at about 60° C. for 4.5 hours, and the reaction was completed. About 1500 ml of toluene was added to the reactant, then the reaction product was cooled to room temperature and repeatedly rinsed with water and an aqueous sodium carbonate solution.

Then, the solvent was removed from the solution and the residue was purified by means of a column chromatography (adsorption medium: silica gel, developing solvent: toluene/ethyl acetate=20/1). The resulting light yellow oil was crystallized with adding cyclohexane. Consequently, 88.1 grams of white crystal expressed by Formula B having a melting point of 64.0 to 66.0° C. was obtained in the yield of 80.4%.

TABLE 1

| Elemental analysis (%) | C | H | N |
|---|---|---|---|
| Measured | 85.06 | 6.41 | 3.73 |
| Calculated | 85.44 | 6.34 | 3.83 |

Formula A

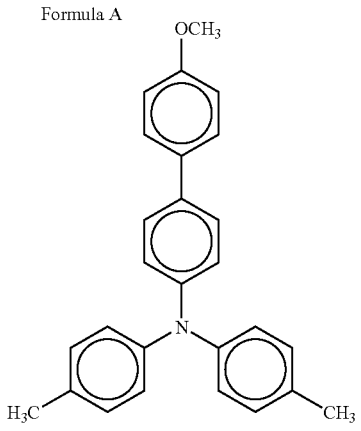

TABLE 1-continued

| Elemental analysis (%) | C | H | N |
|---|---|---|---|

Formula B

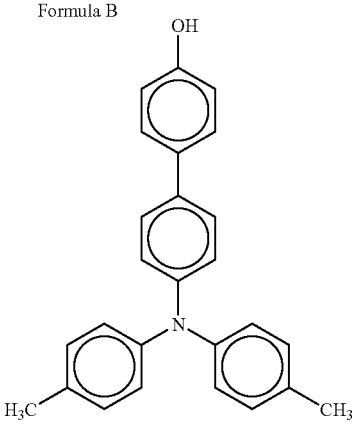

(2) Triarylamino Group-Substituted Acrylate Compound (Compound No. 54)

The hydroxy group-substituted triarylamine compound expresses by Formula B of 82.9 grams (0.227 mol) obtained in above (1) was dissolved in 400 grams of tetrahydrofuran, and an aqueous sodium hydroxide solution, containing 12.4 grams of NaOH and 100 grams of water, was dropwisely added thereto. The resulting solution was cooled to 5° C. and 25.2 grams (0.272 mol) of acrylic acid chloride was added thereto over 40 minutes. Then, the reactant was stirred at 5° C. for 3 hours and the reaction was completed. The reaction product was poured into water and was extracted with toluene. The extract was repeatedly rinsed with an aqueous sodium bicarbonate solution and water. The solvent was removed from the solution and the residue was purified by means of a column chromatography (adsorption medium: silica gel, developing solvent: toluene). The resulting colorless oil was crystallized within n-hexane. Consequently, 80.73 grams of white crystal of the compound No. 54 having a melting point of 117.5 to 119.0° C. was obtained with the yield of 84.8%.

TABLE 2

| | Element analysis (%) | | |
|---|---|---|---|
| | C | H | N |
| Measured | 83.13 | 6.01 | 3.16 |
| Calculated | 83.02 | 6.00 | 3.33 |

As is clear from the above-noted detailed and specific explanations, according to the present invention, by producing a photoconductor comprising a photosensitive layer disposed on an support, wherein the photosensitive layer comprises a crosslinked layer and the crosslinked layer is produced by curing a radical polymerizable monomers having three or more functionalities and no charge transport structure and a radical polymerizable compound having a charge transport structure through irradiating a light energy in an atmosphere having a low oxygen concentration of 0.001 vol % to 2.0 vol %, a photoconductor which has high wear resistance, advantageous electrical properties, high durability and high performance, can be obtained.

Also, by using a manufacturing method of a photoconductor comprising a photosensitive layer disposed on an support, wherein the photosensitive layer comprises at least a crosslinked layer and the crosslinked layer is produced by curing a radical polymerizable monomer having three or more functionalities and no charge transport structure and a radical polymerizable compound having a charge transport structure through irradiating a light energy in an atmosphere having a low oxygen concentration of 0.001 vol % to 2.0 vol %, a photoconductor which has high wear resistance, advantageous electrical properties, high durability and high performance, can be obtained.

Accordingly, using the thus obtained photoconductor, an image forming process, image forming apparatus and process cartridge which has high performance and high reliability and which can provide an advantageous image for a long term, can be provided.

Next, with respect to the present invention, explanations are given further in detail referring to Examples, which should not be construed as limiting the scope of the present invention. In Examples, "parts" means "parts by mass".

EXAMPLE 1

An undercoat layer was disposed on a support made of aluminum (having an outer diameter of 30 mm) by coating the support with the following coating liquid according to a dip coating so that the undercoat layer had a thickness of 3.5 μm after drying the coating.

<Coating Liquid for Disposing Undercoat Layer>

| Composition of Coating Liquid | |
|---|---|
| Alkyd resin (manufactured and sold by Dainippon Ink & Chemicals Inc.; trade name: Beckozole 1307-60-EL) | 6 parts |
| Melamine resin(manufactured and sold by Dainippon Ink & Chemicals Inc.; trade name: Super Beckamine G-821-60) | 4 parts |
| Titanium oxide(manufactured and sold by Ishihara Sangyo Kaisha Ltd.; trade name: CR-EL) | 40 parts |
| Methyl ethyl ketone | 50 parts |

A charge generating layer was disposed on the above-disposed undercoat layer by coating the undercoat layer with a coating liquid for disposing the charge generating layer, which comprised a bisazo pigment represented by the following formula according to a dip coating, and the resultant coating was dried by the heating so that the charge generating layer had a thickness of 0.2 μm.

<Coating Liquid for Disposing Charge Generating Layer>

| Composition of Coating Liquid | |
|---|---|
| Bisazo pigment represented by the following formula | 2.5 parts |

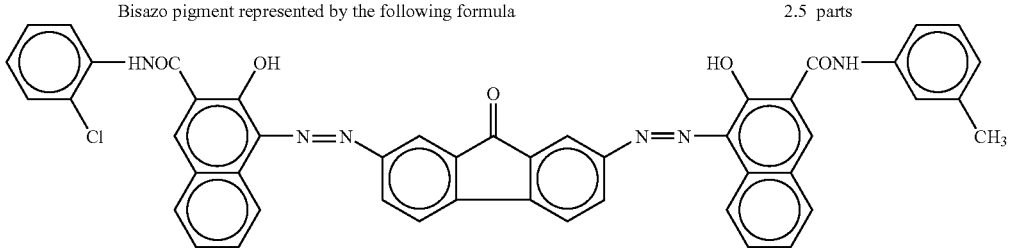

| | |
|---|---|
| Polyvinylbutylal (manufactured and sold by UCC; trade name: XYHL) | 0.5 part |
| Cyclohexanone | 200 parts |
| Methyl ethyl ketone | 80 parts |

A charge transport layer was disposed on the above-disposed charge generating layer by coating the charge generating layer with a coating liquid for disposing the charge transport layer, which had the following composition according to a dip coating, and the resultant coating was dried by the heating so that the charge generating layer had a thickness of 22 μm.

<Coating Liquid for Disposing Charge transport Layer>

| Composition of Coating Liquid | |
|---|---|
| Bisphenol Z polycarbonate | 10 parts |
| Charge transport substance having a low molecular weight represented by the following formula | 10 parts |

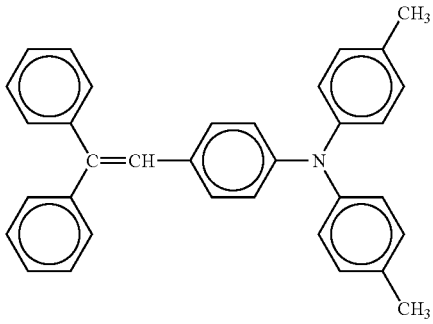

| | |
|---|---|
| Tetrahydrofuran | 80 parts |
| 1% tetrahydrofuran solution of silicone oil (manufactured and sold by Shin-Etsu Chemical Co., Ltd.; trade name: KF 50) | 0.2 part |

On the above-disposed charge transport layer, a crosslinked layer having a thickness of 4.0 μm was disposed according to a method comprising spray-coating the charge transport layer with a coating liquid for disposing the crosslinked layer, which had the following composition, irradiating a light to the resultant coating in a light energy irradiating vessel in which air was purged with nitrogen gas until the oxygen concentration was lowered to 0.6 vol % to 1.2 vol % and the oxygen concentration was maintained, using a metal halide lamp under the condition where the illuminance was 450 mW/cm$^2$ and the irradiating time was 120 sec, and drying the coating at 130° C. for 30 minutes, thereby obtaining the photoconductor according to the present invention.

<Coating Liquid for Disposing Crosslinked Layer>

| Composition of Coating Liquid | |
|---|---|
| Trimethylolpropanetriacrylate*1 (manufactured and sold by Nippon Kayaku Co., Ltd.; trade name: KAYARAD TMPTA; having a molecular weight of 296, a functionality of 3 and a ratio (molecular weight/functionality) of 99) | 8 parts |
| Caprolactone-modified dipentaerythritolhexaacrylate*2 (manufactured and sold by Nippon Kayaku Co., Ltd.; trade name: KAYARAD DPCA 120; having a molecular weight of 1,947, a functionality of 6 and a ratio (molecular weight/functionality) of 325) | 2 parts |
| Radical polymerizable compounds having one functionality and a charge transport structure (Compound No. 54) | 10 parts |
| 1-hydroxy-cyclohexyl-phenyl-ketone*3(manufactured and sold by Ciba Specialty Chemicals Corporation; trade name: Irgacure 184) | 1 part |
| Tetrahydrofuran | 80 parts |

wherein "Trimethylolpropanetriacrylate*1" and "Caprolactone-modified dipentaerythritolhexaacrylate*2" are respectively a radical polymerizable monomer having three or more functionalities and no charge transport structure, and "1-hydroxy-cyclohexyl-phenyl-ketone*3" is a photopolymerization initiator.

EXAMPLE 2

The photoconductor of Example 2 was produced in substantially the same manner as in Example 1, except that in the light energy irradiating vessel, air was purged with argon gas until an oxygen concentration was lowered to 0.05 vol % to 0.12 vol %.

EXAMPLE 3

The photoconductor of Example 3 was produced in substantially the same manner as in Example 1, except that as the radical polymerizable compound having a charge transport structure, Compound No. 182 was used. The thickness of the crosslinked layer of the obtained photoconductor was measured and found to be 4.4 μm.

EXAMPLE 4

The photoconductor of Example 4 was produced in substantially the same manner as in Example 1, except that as the radical polymerizable compound having a charge transport structure, Compound No. 109 was used. The thickness of the crosslinked layer of the obtained photoconductor was measured and found to be 5.2 μm.

COMPARATIVE EXAMPLE 1

The photoconductor of Comparative Example 1 was produced in substantially the same manner as in Example 1, except that in the light energy irradiating vessel, air was not purged.

COMPARATIVE EXAMPLE 2

The photoconductor of Comparative Example 2 was produced in substantially the same manner as in Example 3, except that in the light energy irradiating vessel, air was not purged.

COMPARATIVE EXAMPLE 3

The photoconductor of Comparative Example 3 was produced in substantially the same manner as in Example 4, except that in the light energy irradiating vessel, air was not purged.

COMPARATIVE EXAMPLE 4

The photoconductor of Comparative Example 4 was produced in substantially the same manner as in Example 1, except that in the light energy irradiating vessel, air was purged with nitrogen gas until an oxygen concentration was lowered to 5.2 vol % to 6.1 vol %.

COMPARATIVE EXAMPLE 5

The photoconductor of Comparative Example 5 was produced in substantially the same manner as in Example 1, except that in the light energy irradiating vessel, air was purged with nitrogen gas until an oxygen concentration was lowered to 2.9 vol % to 4.2 vol %.

COMPARATIVE EXAMPLE 6

The photoconductor of Comparative Example 6 was produced in substantially the same manner as in Example 1, except that in the photoconductor, the crosslinked layer was not disposed.

(Measurement of Rz)

With respect to each of the photoconductors produced in Example 1 to Comparative Example 6, the ten-point height of irregularities was measured according to JIS B0601-1994 using a surface roughness measuring apparatus (manufactured and sold by Tokyo Seimitsu Co., Ltd.; trade name: SURFCOM 1400 D). The result of the measurement is shown in Table 3.

TABLE 3

| Ten-point height of irregularities (Rz) | |
|---|---|
| | Rz (μm) |
| Example 1 | 0.24 |
| Example 2 | 0.15 |
| Example 3 | 0.34 |
| Example 4 | 0.23 |
| Comp. Ex. 1 | 0.68 |
| Comp. Ex. 2 | 0.82 |
| Comp. Ex. 3 | 0.72 |
| Comp. Ex. 4 | 0.62 |
| Comp. Ex. 5 | 0.55 |
| Comp. Ex. 6 | 0.15 |

(Image Forming Test Using Actual Printer)

Each of the photoconductors produced in Example 1 to Comparative Example 6 was subjected to the image forming test (at the start of the test, the photoconductor in an actual printer had a charging potential of −700 V) in an amount of 100,000 sheets of the image printing paper (manufactured and sold by NBS RICOH Co., Ltd.; trade name: My Paper; having a size of A4) using a converted machine of a printer (manufactured and sold by RICOH Company Ltd.; trade name: imagio Neo 270; equipped with a laser diode having a wavelength of 655 nm as a light source for exposing the image), thereby evaluating the wear properties of the photoconductor, the electric potential of the photoconductor in the actual printer, the quality of the formed image and the crying of the cleaning blade of the photoconductor. The result of the evaluation is shown in Tables 4 to 7.

In Comparative Example 6, since the wear degree of the photoconductor was too large after 50,000 sheets of the paper was printed, the image forming test was stopped.

TABLE 4

| Wear Proprties of Photoconductor (unit: μm) | | |
|---|---|---|
| | Number of Printed Sheets | |
| | 50,000 | 100,000 |
| Example 1 | 0.71 | 1.35 |
| Example 2 | 0.65 | 1.27 |
| Example 3 | 0.62 | 1.15 |
| Example 4 | 0.61 | 1.11 |
| Comp. Ex. 1 | 2.15 | 4.42 |
| Comp. Ex. 2 | 1.89 | 3.99 |
| Comp. Ex. 3 | 1.84 | 3.78 |
| Comp. Ex. 4 | 1.23 | 2.49 |
| Comp. Ex. 5 | 1.21 | 2.32 |
| Comp. Ex. 6 | 5.34 | — |

TABLE 5

| Electric Potential of Photoconductor in Actual Printer (unit: Volt) | | | | | | |
|---|---|---|---|---|---|---|
| | Number of Printed Sheets | | | | | |
| | 0 | | 50,000 | | 100,000 | |
| | Unexposed Portion | Exposed Portion | Unexposed Portion | Exposed Portion | Unexposed Portion | Exposed Portion |
| Ex. 1 | −700 | −80 | −690 | −90 | −690 | −95 |
| Ex. 2 | −700 | −80 | −705 | −85 | −695 | −80 |
| Ex. 3 | −700 | −120 | −705 | −115 | −700 | −115 |
| Ex. 4 | −700 | −95 | −695 | −95 | −700 | −90 |
| Comp. Ex. 1 | −700 | −70 | −705 | −75 | −710 | −85 |
| Comp. Ex. 2 | −700 | −110 | −705 | −115 | −705 | −125 |
| Comp. Ex. 3 | −700 | −90 | −705 | −90 | −705 | −95 |
| Comp. Ex. 4 | −700 | −80 | −700 | −85 | −705 | −85 |
| Comp. Ex. 5 | −700 | −80 | −705 | −85 | −710 | −85 |
| Comp. Ex. 6 | −700 | −55 | −750 | −60 | — | — |

TABLE 6

| Evaluation of Image Quality (S3 Chart) | | | |
|---|---|---|---|
| | Number of Printed Sheets | | |
| | 0 | 50,000 | 100,000 |
| Example 1 | A | A | A |
| Example 2 | A | A | A |
| Example 3 | A | A | B |
| Example 4 | A | A | A |
| Comp. Ex. 1 | B | C | C |
| Comp. Ex. 2 | B | B | C |
| Comp. Ex. 3 | B | C | C |
| Comp. Ex. 4 | A | A | B |
| Comp. Ex. 5 | A | A | B |
| Comp. Ex. 6 | A | B | — |

Image failure in the form of a stripe
A: not caused
B: caused locally
C: caused in the whole image

TABLE 7

| Blade Crying | |
|---|---|
| | Blade Crying |
| Example 1 | A |
| Example 2 | A |
| Example 3 | A |
| Example 4 | A |
| Comp. Ex. 1 | B |
| Comp. Ex. 2 | B |
| Comp. Ex. 3 | B |
| Comp. Ex. 4 | B |
| Comp. Ex. 5 | B |
| Comp. Ex. 6 | A |

Blade Crying
A: not caused
B: caused

What is claimed is:

1. A manufacturing method of a photoconductor comprising:

disposing a crosslinked layer as the outermost surface layer in the photoconductor by curing at least one radical polymerizable monomer having three or more functionalities and no charge transport structure and a radical polymerizable compound having a charge transport structure through irradiating a light energy in an atmosphere having a low oxygen concentration of 0.001 vol % to 2.0 vol %, wherein the photoconductor comprises the photosensitive layer disposed on a support and the photosensitive layer comprises the crosslinked layer, and wherein the radical polymerizable compound having a charge transport structure is at least one selected from the group consisting of the radical polymerizable compounds represented by the following formulae (3) and (4):

Formula (3)

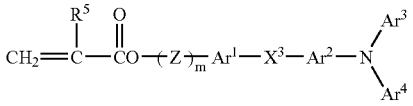

Formula (4)

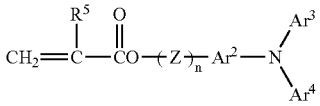

wherein $R^5$ represents any one of a hydrogen atom, a halogen atom, an alkyl group which may have a substituent, an alalkyl group which may have a substituent, an aryl group which may have a substituent, a cyano group, a nitro group, an alkoxy group, a —$COOR^6$ group ($R^6$ represents any one of a hydrogen atom, an alkyl group which may have a substituent, an alalkyl group which may have a substituent and an aryl group which may have a substituent), a halogenated carbonyl group and a —$CONR^7R^8$ group ($R^7$ and $R^8$ represent independently any one of a hydrogen atom, a halogen atom, an alkyl group which may have a substituent, an alalkyl group which may have a substituent, an aryl group which may have a substituent); $Ar^1$ and $Ar^2$ may be the same as or different from each other, and represent an unsubstituted or substituted arylene group; $Ar^3$ and $Ar^4$ may be the same as or different from each other, and represent an unsubstituted or substituted aryl group; X represents any one of a single bond, an unsubstituted or substituted alkylene group, an unsubstituted or substituted cycloalkylene group, an unsubstituted or substituted alkylene ether group, an oxygen atom, a sulfur atom and a vinylene group; Z represents any one of an unsubstituted or substituted alkylene group, an unsubstituted or substituted alkylene ether group and an alkyleneoxycarbonyl group; and m and n are independently an integer of 0 to 3, and wherein the radical polymerizable monomer having three or more functionalities and no charge transport structure is at least one selected from the group consisting of trimethylolpropanetriacrylate, a trimethylolpropanetrimethacrylate, an HPA-modified trimethylolpropanetriacrylate, an EO-modified trimethylolpropanetriacrylate, a PO-modified trimethylolpropanetriacrylate, a caprolactone-modified trimethylolpropanetriacrylate, a HPA-modified trimethyloipropanetriacrylate, a pentaerythritoltriacrylate, a pentaerythritoltetraacrylate, a glyceroltriacrylate, a ECH-modified glyceroltriacrylate, a EO-modified glyceroltriacrylate, a PO-modified glyceroltriacrylate, a tris(acryloxyethyl) isocyanulate, a dipentaerythritolhexaacrylate, a caprolactone-modified dipentaerythritolhexaacrylate, a dipentaerythritolhydroxypentaacrylate, a dimethylolpropanetetraacrylate (DTMPTA), an EO-modified phosphoric acid triacrylate, 2,2,5,5-tetrahydroxymethylcyclopentanonetetraacrylate, an alkyl-modified dipentaerythritol pentaacrylate, an alkyl-modified dipentaerythritol tetraacrylate, an alkyl-modified dipentaerythritol triacrylate, and a pentaerythritol ethoxytetraacrylate.

2. The manufacturing method of a photoconductor according to claim 1, wherein the radical polymerizable compound having a charge transport structure is a radical polymerizable compounds having one functionality and a charge transport structure.

3. The manufacturing method of a photoconductor according to claim 1, wherein the radical polymerizable monomer having three or more functionalities and no charge transport structure has at least one of an acryloyloxy group and a methacryloyloxy group.

4. The manufacturing method of a photoconductor according to claim 1, wherein the radical polymerizable compound having a charge transport structure has at least one of an acryloyloxy group and a methacryloyloxy group.

5. The manufacturing method of a photoconductor according to claim 1, wherein the radical polymerizable compound having a charge transport structure has a triarylamine structure.

6. The manufacturing method of a photoconductor according to claim 2, wherein the radical polymerizable compound having a charge transport structure is at least one selected from the group consisting of the radical polymerizable compounds represented by the following Formula (8):

Formula (8)

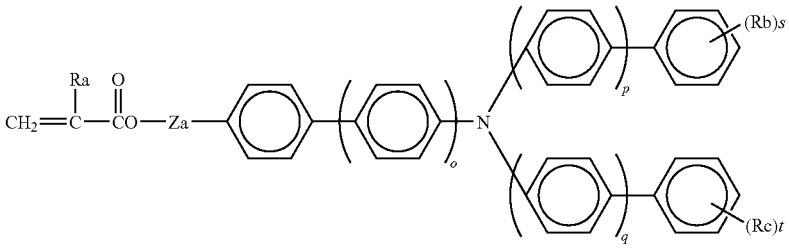

wherein o, p and q are independently an integer of 0 or 1; Ra represents any one of a hydrogen atom and a methyl group; Rb and Rc represent a $C_1$ to $C_6$ alkyl group (a substituent other than a hydrogen atom), plural Rbs may be different from each other and plural Rcs may be different from each other; s and t are independently an integer of 0 to 3; Za represents any one of a single bond, a methylene group, an ethylene group and groups represented by the following formulae:

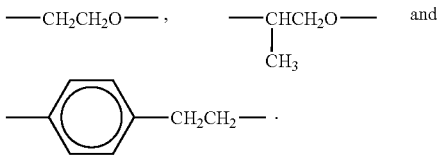

7. The manufacturing method of claim 1, wherein the light energy is external energy.

8. The manufacturing method of claim 1, wherein the light energy is UV light.

9. The manufacturing method of claim 1, wherein the light energy has a wavelength of 365 nm.

10. The manufacturing method of claim 1, wherein the light energy is UV light having an illuminance of from 300 $mW/cm^2$ to 1000 $mW/cm^2$.

11. The manufacturing method of claim 1, further comprising:

drying the photoconductor after the crosslinked layer is disposed on the photoconductor.

12. The manufacturing method of claim 1, wherein the light energy is from a metal halide lamp.

13. The manufacturing method of a photoconductor of claim 1, wherein the radical polymerizable monomer having three or more functionalities and no charge transport structure is at least one selected from the group consisting of an alkyl-modified pentaerythritoltriacrylate, an alkyl-modified pentaerythritoltetraacrylate, and an alkyl-modified dipentaerythritolpentaacrylate.

14. The manufacturing method of a photoconductor of claim 1, wherein the radical polymerizable monomer having three or more functionalities and no charge transport structure is at least one selected from the group consisting of trimethylolpropanetriacrylate, a trimethylolpropanetrimethacrylate, a pentaerythritoltriacrylate, a pentaerythritoltetraacrylate, a dipentaerythritolhexaacrylate, a caprolactone-modified dipentaerythritolhexaacrylate, a dipentaerythritolhydroxypentaacrylate, a pentaerythritolethoxytetraacrylate, and a dimethylolpropanetetraacrylate.

* * * * *